US008689450B2

(12) United States Patent
Constantine et al.

(10) Patent No.: US 8,689,450 B2
(45) Date of Patent: Apr. 8, 2014

(54) KNIFE HAVING A REVERSIBLE CARRIAGE

(75) Inventors: Richard Steven Constantine, Milford, CT (US); Man For Ma, New Territories (HK); Anthony Sgroi, Jr., Wallingford, CT (US)

(73) Assignee: Acme United Corporation, Fairfield, CT (US)

( * ) Notice: Subject to any disclaimer, the term of this patent is extended or adjusted under 35 U.S.C. 154(b) by 219 days.

(21) Appl. No.: 13/097,647

(22) Filed: Apr. 29, 2011

(65) Prior Publication Data

US 2012/0272529 A1 Nov. 1, 2012

(51) Int. Cl.
*B26B 1/08* (2006.01)

(52) U.S. Cl.
USPC ..... 30/162; 30/335

(58) Field of Classification Search
USPC ..... 30/162, 335, 124, 125, 336, 2; D8/51, D8/98, 99
See application file for complete search history.

(56) References Cited

U.S. PATENT DOCUMENTS

| | | | | | |
|---|---|---|---|---|---|
| 2,477,986 | A * | 8/1949 | Kennerley | 30/162 |
| 2,662,284 | A * | 12/1953 | Unsinger | 30/162 |
| 3,577,637 | A * | 5/1971 | Braginetz | 30/162 |
| 3,593,417 | A * | 7/1971 | West et al. | 30/125 |
| 3,708,881 | A * | 1/1973 | Bennett | 30/335 |
| 3,872,591 | A * | 3/1975 | Quenot | 30/162 |
| 4,517,741 | A * | 5/1985 | Castelluzzo | 30/162 |
| 4,936,014 | A * | 6/1990 | Shaanan et al. | 30/162 |
| 5,386,632 | A * | 2/1995 | Schmidt | 30/162 |
| 5,404,645 | A * | 4/1995 | Janser | 30/125 |
| 5,435,062 | A * | 7/1995 | Huang | 30/125 |
| 5,495,670 | A * | 3/1996 | Quinn | 30/162 |
| 5,604,984 | A * | 2/1997 | Shepherd et al. | 30/125 |
| 5,613,300 | A * | 3/1997 | Schmidt | 30/2 |
| 5,644,843 | A * | 7/1997 | Young | 30/124 |
| 5,727,320 | A * | 3/1998 | Shepherd et al. | 30/125 |
| D394,597 | S * | 5/1998 | Shepherd et al. | D8/99 |
| 5,909,930 | A * | 6/1999 | Ragland et al. | 30/125 |
| 5,960,545 | A * | 10/1999 | Shepherd et al. | 30/162 |
| 6,192,589 | B1 * | 2/2001 | Martone et al. | 30/125 |
| 6,446,340 | B1 * | 9/2002 | Ping | 30/125 |
| 6,454,427 | B1 * | 9/2002 | Chen | 30/125 |

(Continued)

FOREIGN PATENT DOCUMENTS

WO WO 2007126776 A2 * 11/2007

*Primary Examiner* — Jason Daniel Prone
(74) *Attorney, Agent, or Firm* — Alix, Yale & Ristas, LLP

(57) ABSTRACT

A knife comprising a housing and a rotating blade carriage pivotably associated with the housing. The knife further includes a compartment in which a plurality of blades can be stored and later advanced from the housing for performing a cutting action, the first end of the blade being exposed. The rotating blade carriage can be rotated with respect to the housing and placed in a second position so that the opposite end of the same blade is exposed for performing a cutting action when advanced. The rotating blade carriage can be selectively locked in the first or second position. A carriage locking lever can be accessible for unlocking the rotating blade carriage for blade reversal. When removal of the used or worn blade is desired, the knife can have one or more blade release members that allow the disengagement of the blade from the knife so that the user can manually remove the blade without the requirement of disassembly or partial disassembly of the knife. Automatic reloading of subsequent blades is possible. If desired, the knife can be configured to automatically load subsequent blades after removal of previous used or worn blades.

20 Claims, 60 Drawing Sheets

(56) References Cited

U.S. PATENT DOCUMENTS

| | | | | |
|---|---|---|---|---|
| 6,513,246 | B2 * | 2/2003 | Ping | 30/125 |
| 6,678,958 | B1 * | 1/2004 | Budrow | 30/335 |
| 6,886,257 | B2 * | 5/2005 | Chih | 30/162 |
| 6,966,113 | B2 * | 11/2005 | Fossella | 30/162 |
| 7,107,688 | B1 * | 9/2006 | Critelli et al. | 30/162 |
| 7,305,770 | B2 * | 12/2007 | Critelli et al. | 30/162 |
| D558,555 | S * | 1/2008 | Huang et al. | D8/99 |
| D559,072 | S * | 1/2008 | Fraga | D8/99 |
| D564,327 | S * | 3/2008 | Wu | D8/99 |
| 7,395,600 | B2 * | 7/2008 | Fossella | 30/162 |
| 7,418,784 | B2 * | 9/2008 | Fossella | 30/162 |
| D587,553 | S * | 3/2009 | Constantine et al. | D8/99 |
| 7,533,467 | B2 * | 5/2009 | Fossella | 30/162 |
| 7,596,867 | B1 * | 10/2009 | Biolchini, Jr. | 30/125 |
| 7,774,943 | B2 * | 8/2010 | Ireland | 30/162 |
| 7,797,835 | B2 * | 9/2010 | Zeng | 30/162 |
| 7,886,445 | B2 * | 2/2011 | Constantine et al. | 30/162 |
| 8,220,161 | B2 * | 7/2012 | Chang | 30/162 |
| D681,418 | S * | 5/2013 | Birkholz | D8/99 |
| D686,481 | S * | 7/2013 | Robinson et al. | D8/99 |
| 8,572,852 | B1 * | 11/2013 | Jennings et al. | 30/162 |
| 2002/0029480 | A1 * | 3/2002 | Lin | 30/125 |
| 2004/0226175 | A1 * | 11/2004 | Ping | 30/125 |
| 2007/0227012 | A1 * | 10/2007 | Constantine et al. | 30/162 |
| 2007/0256310 | A1 * | 11/2007 | Pool et al. | 30/125 |
| 2010/0180449 | A1 * | 7/2010 | van Deursen | 30/162 |
| 2010/0281696 | A1 * | 11/2010 | Hao et al. | 30/162 |
| 2011/0119928 | A1 * | 5/2011 | Constantine et al. | 30/162 |
| 2012/0042523 | A1 * | 2/2012 | Strauss | 30/162 |
| 2012/0073142 | A1 * | 3/2012 | Zeng | 30/162 |

* cited by examiner

KNIFE HAVING A REVERSIBLE CARRIAGE

BACKGROUND OF THE INVENTION

1. Field of the Invention

The present disclosure is related to knives. More particularly, the present disclosure is related to knives for use with various styles of utility knife blades, and more specifically to knives having a blade carriage configured to reverse the blade from a first cutting end to the opposite cutting end without the requirement of handling the utility knife blade.

2. Description of Related Art

Utility knives are used in connection with a number of activities, including cutting of corrugated materials, box cutting, flooring cutting, wood working and others. One type of utility knife incorporates a two-piece housing having a cavity in which a blade is secured. The two housing sections are releasably secured to each other using a fastening screw, and the blade remains exposed in a fixed position during use. When the blade becomes dull, the user removes the fastening screw, separates the housing sections and manually reverses the blade to present the cutting edge at the opposite end of the blade for cutting. When the cutting edge at the second end becomes dull, the process is repeated to allow the user to insert new blade. The process of reversing and/or changing blades involves the repeated handling of sharp blades that can increase the chances of injury each time the blade is handled.

Retractable blade knives are also well known in the art. These types of knives typically have a housing separable by a fastener such as a screw. Contained inside the housing is a blade carriage that allows a blade to be loaded thereto. The blade carriage is usually accessible from the outside of the knife so that the user can expose the blade from an opening in the housing. When the blade becomes dull, the housing is typically separated so that the user can remove and reverse the blade for use. When the second cutting edge becomes dull, the housing can be separated yet again for blade replacement. As described above, reversing and/or changing of the blade requires frequent handling which can increase the chances for injury.

Some improvements have been made to eliminate the need for the separation of the housing during blade removal. This allows the user to reverse or change the blade without the requirement of separating the housing. However, there still exists the requirement for the user to handle such blades. Despite the improvements, the chance of injury during the handling of sharp blades is still present.

Therefore, there is a need for a knife that overcomes, alleviates, and/or mitigates one or more of the aforementioned and other deleterious effects of prior art knives.

BRIEF SUMMARY OF THE INVENTION

Knives are provided that are configured to accept a plurality of blades that can be stored and later advanced from a housing for performing a cutting action. Typically, such knives are configured for use with utility knife blades having two ends for performing a cutting action. When the cutting edge at the first end of the blade becomes dull or worn, the user can reverse the blade so that a second cutting edge at the other end of the blade can perform the cutting action.

Moreover, knives are provided that eliminate the requirement of manually reversing the blade to the second end.

In some embodiments, the knife has a rotating blade carriage that can be pivotally associated with the housing. The rotating blade carriage can be in a first position so that when the blade is advanced for performing a cutting action, the first end of the blade is exposed. Advantageously, the rotating blade carriage can be rotated with respect to the housing and placed in a second position so that the cutting edge at the opposite end of the same blade is exposed for performing a cutting action when advanced.

If desired, the rotating blade carriage can be selectively locked in the first or second position. A carriage locking lever can be accessible for unlocking the rotating blade carriage for blade reversal.

When removal of the used or worn blade is desired, the knife can have one or more blade release members that allow the disengagement of the blade from the knife so that the user can manually remove the blade without the requirement of disassembly or partial disassembly of the knife.

Automatic reloading of subsequent blades is possible. If desired, the knife can be configured to automatically load subsequent blades after removal of previous used or worn blades.

In other embodiments, the knife can have a supplemental storage compartment configured for automatic loading of used or worn blades. This can allow for the simultaneous disposal of a plurality of used or worn blades.

In still some embodiments, the plurality of blades can be preloaded in a cartridge which then can be loaded into the knife. The cartridge can be configured to be disposable. In this configuration, the user would purchase the cartridge containing the plurality of blades. When the cartridge becomes empty, it can be unloaded from the knife and discarded. The knife can then be reloaded with a new cartridge.

As an alternative, the cartridge can be configured so that the user can load a plurality of blades therein. In this configuration, the cartridge allows the user to load a plurality of blades through an access door or recess.

DETAILED DESCRIPTION OF THE INVENTION

Figure 1:
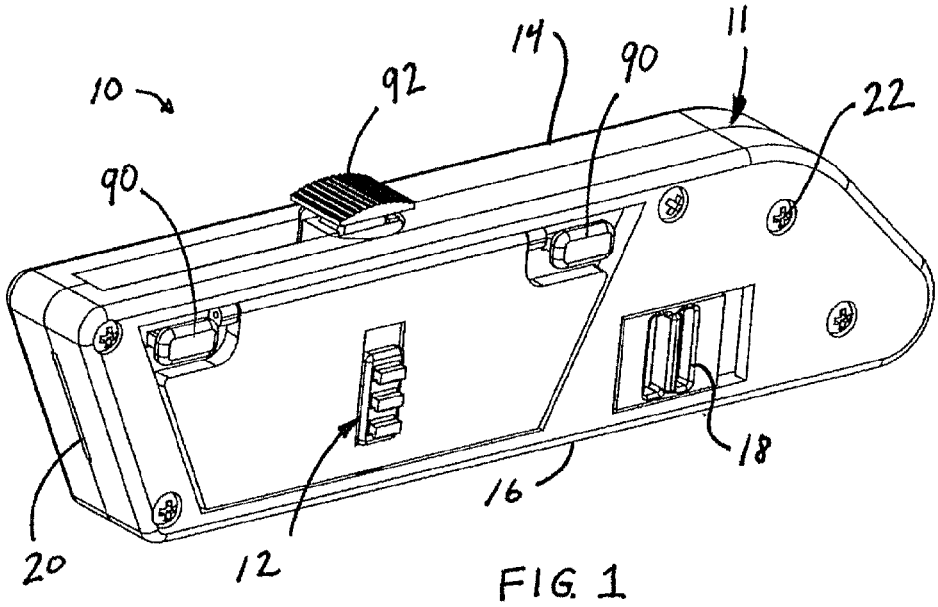
FIG. 1 is a perspective view of a first exemplary embodiment of a knife according to the present disclosure with the rotating blade carriage in the first position and blade in the retracted position.

Referring to the drawings and in particular to FIGS. 1 through 9, a knife according to an exemplary embodiment of the present disclosure is shown having reference numeral 10. Advantageously, knife 10 is configured to eliminate the requirement of handling cutting blades after a cutting action is performed by the cutting edge at the first end of the blade. Accordingly, knife 10 is configured for easy reversal of the blade to present the cutting edge at the other end of the blade for performing a cutting without the requirement of handling the blade during the reversal.

Knife 10 includes a first frame member 14 and a second frame member 16 forming housing 11. Housing 11 on a first end includes blade opening 20. Blade opening 20 permits passage of blade 26 (FIG. 2) when engaging member 92 is advanced in the direction of blade opening 20 substantially along line of action L. As illustrated in FIG. 1, engaging member 92 is in a first position when blade 26 is not advanced (retracted). When blade 26 is advanced (FIG. 2), engaging member 92 is in a second position. Knife 10 further includes a rotating blade carriage 12 configured to store and provide the advancement of blade(s) 26 through blade opening 20.

Figure 2:
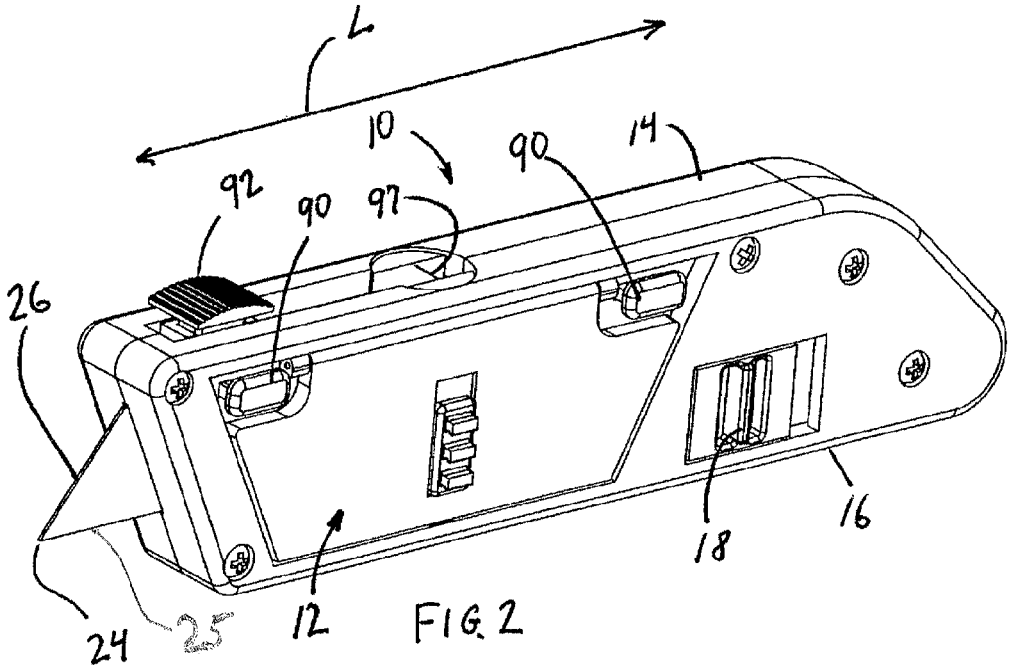
FIG. 2 is a knife of FIG. 1 with the blade in the advanced position.
Figure 3:
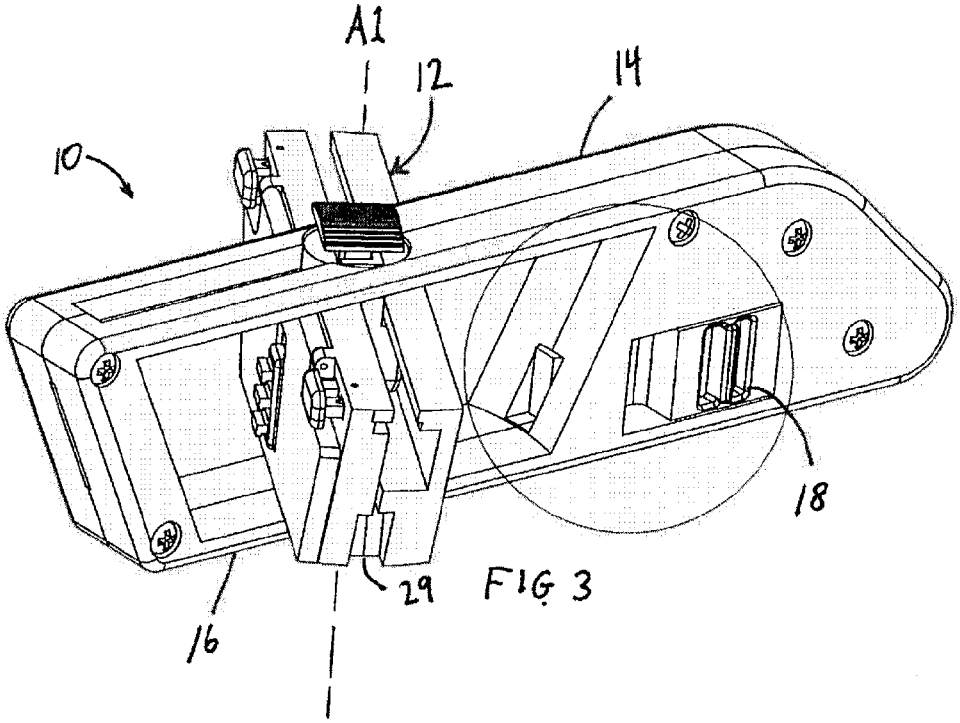
FIG. 3 is the knife of FIG. 1 with the rotating blade carriage in a partially rotated position illustrating the carriage locking lever in the actuated position.
Figure 4:
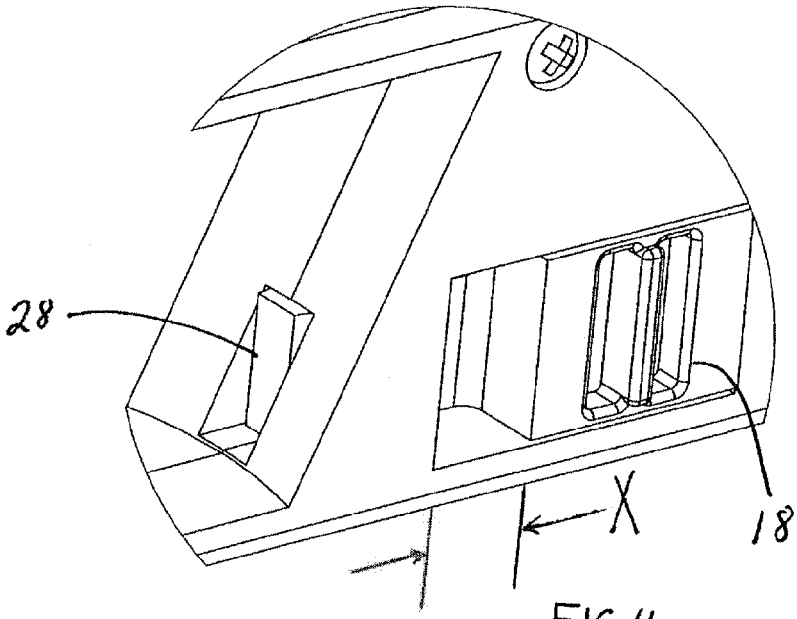
FIG. 4 is a detailed view taken from FIG. 3.
Figure 5:
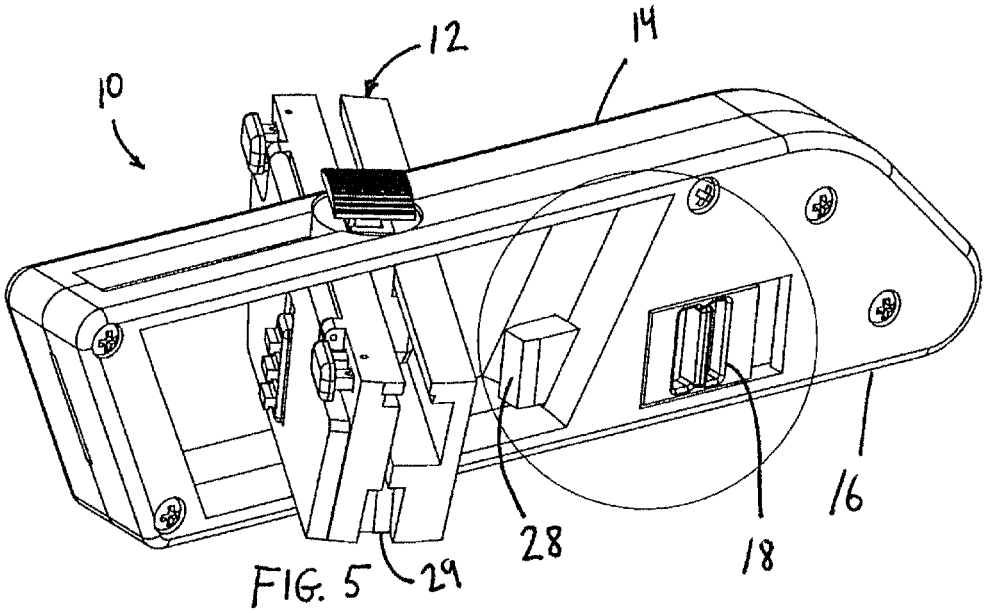
FIG. 5 illustrates carriage locking lever in the locked or natural position as compared to FIG. 3.
Figure 7:
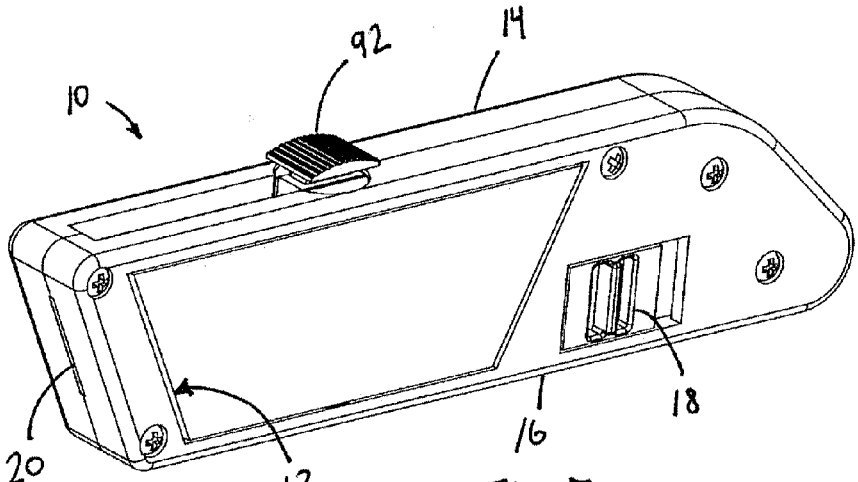
FIG. 7 is the knife of FIG. 1 illustrating the rotating blade carriage in the second position and the blade in the retracted position.
Figure 8:
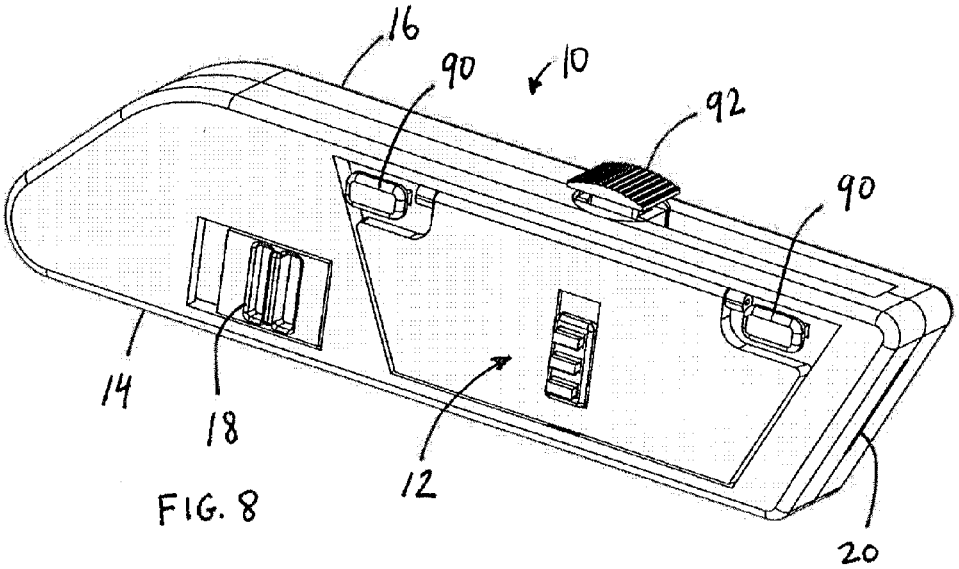
FIG. 8 illustrates the reverse side of the knife of FIG. 7.
Figure 9:
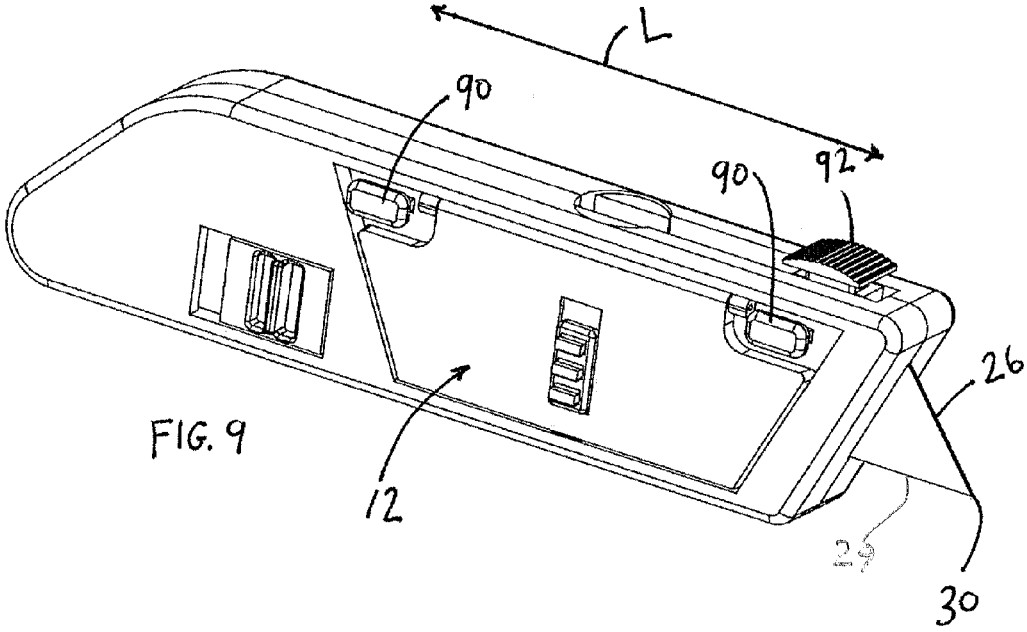
FIG. 9 illustrates the knife as shown in FIGS. 7 and 8 with the blade in the advanced position.

As illustrated in FIGS. 1 and 2, rotating blade carriage 12 is in a first position. When rotating blade carriage 12 is in the first position, blade 26 can be advanced so that a cutting action can be performed by the cutting edge at the first end 24 of blade 26 (FIG. 2). Advantageously, when a cutting action is desired to be performed by the cutting edge at the other end of the same blade 26, the rotating blade carriage 12 can be unlocked and reversed via rotation along axis A1 as illustrated in FIG. 3. In this example, axis A1 is substantially perpendicular to line of action L. Upon the completion of rotation about axis A1, rotating blade carriage 12 is locked into a second position as illustrated in FIGS. 7 through 9. In this configuration, engaging member 92 can again be advanced in the direction of blade opening 20 so that a cutting action can be performed by the cutting edge 29 at the other end 30 of blade 26 as illustrated in FIG. 9. FIG. 9 also illustrates that engaging member 92 is in the second position relative to the first position. This allows substantially the same function when advancing either end 24, 30 of blade 26 by a user.

Figure 6:
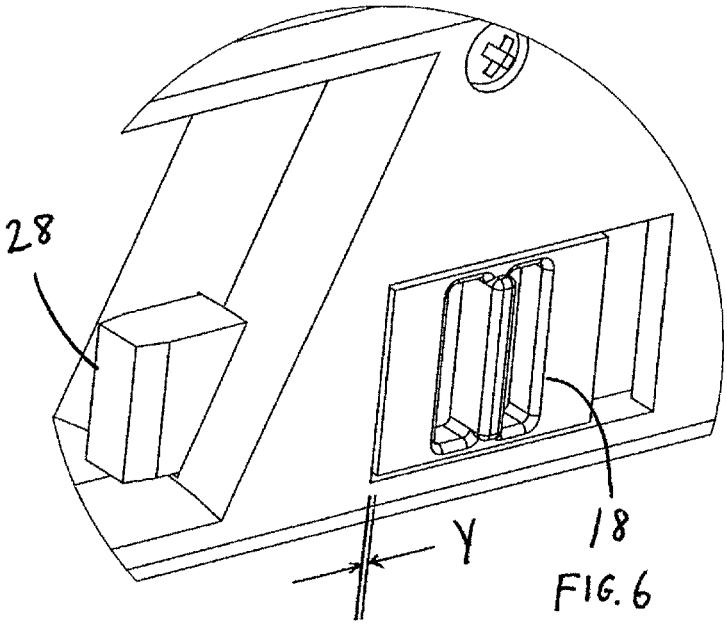
FIG. 6 is a detailed view taken from FIG. 5.
Figure 14:
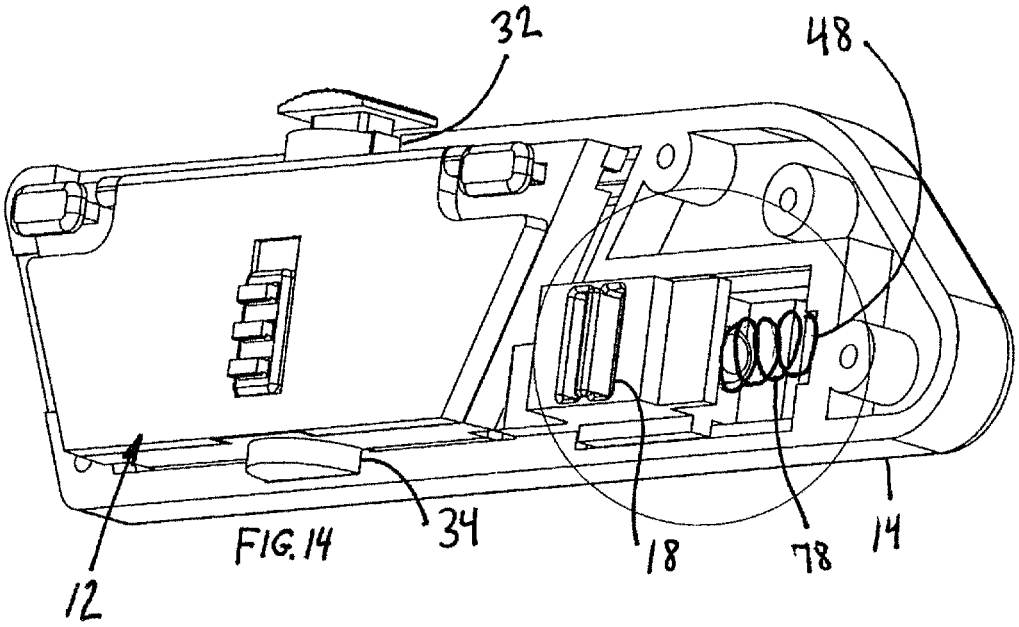
FIG. 14 is the knife of FIG. 1 with the second frame member removed.
Figure 15:
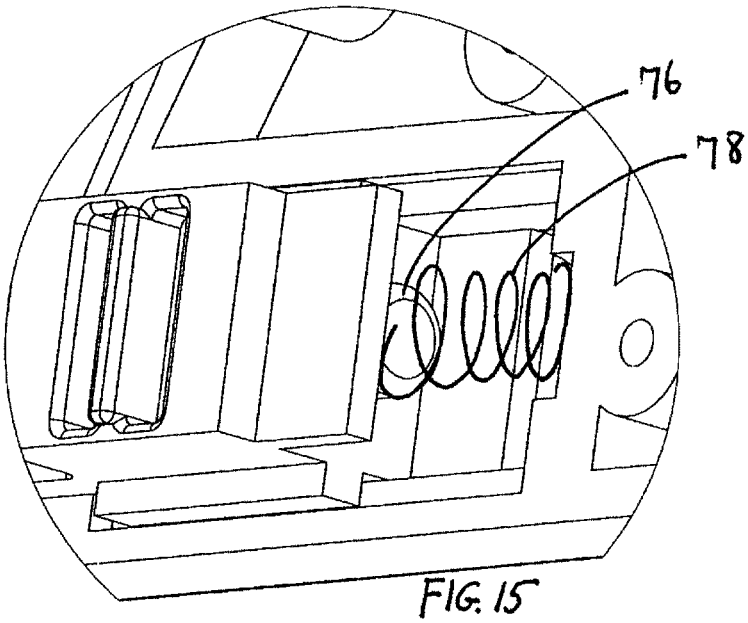
FIG. 15 is a detailed view taken from FIG. 14.
Figure 17:
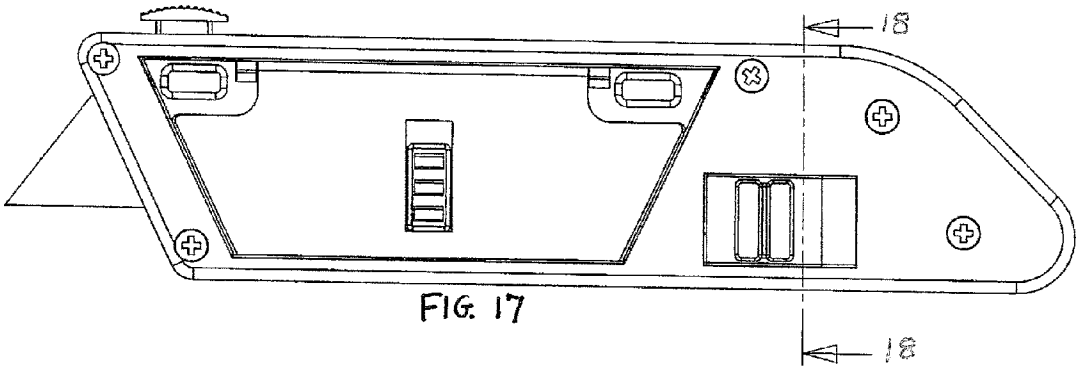
FIG. 17 is a side view of the knife of FIG. 1.
Figure 16:
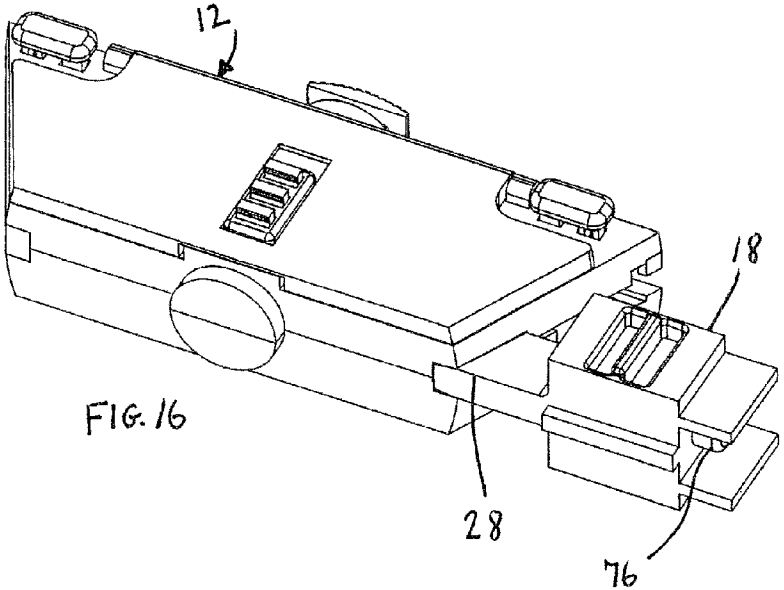
FIG. 16 is a partial assembly of the knife of FIG. 1.

Locking a rotating blade carriage 12 to housing 11 is achieved when carriage locking tab 28 is inserted into carriage locking slot 29. These features are illustrated in the unlocked state in FIGS. 3 to 6. FIG. 16 illustrates the insertion of locking tab 28 to carriage locking slot 29 with various components removed for clarity. Locking tab 28 is forced into carriage locking slot 29 by locking lever resilient member 78 (FIGS. 14 and 15). In this example locking lever resilient member is a coil spring, however, it is contemplated by this disclosure that there are other options available to force locking tab 28 into carriage locking slot 29 such as and not limited to leaf springs, elastomers, sliding snap fits, and others. To facilitate the unlocking of carriage locking tab 28 to carriage locking slot 29, the user actuates carriage locking lever 18 (FIGS. 1-9) which extends through locking lever windows 72/74 (FIGS. 12 and 13) on either side of housing 11. When carriage locking lever 18 is biased away from carriage locking slot 29 a predetermined distance X (FIG. 4), rotating blade carriage 12 becomes unlocked with respect to housing 11 and is allowed to pivot about axis A1. This allows the selective use of the opposite side of blade 26. FIG. 6 illustrates the position of carriage locking lever 18 (distance Y) and locking tab 28 in the natural position (locked) when carriage locking lever 18 is not actuated by a user.

Figure 12:
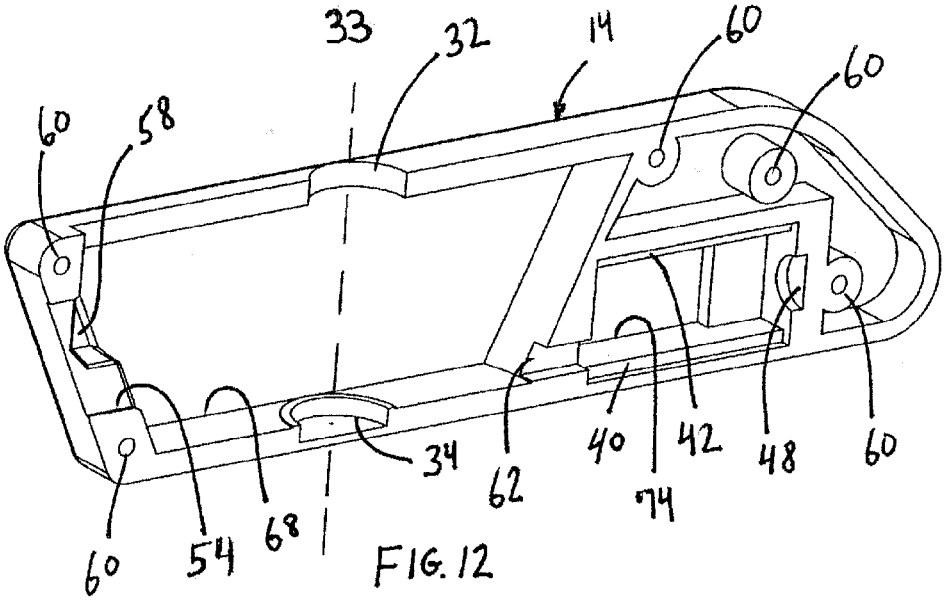
FIGS. 12 and 13 illustrate the first and second frame members of the knife of FIG. 1.
Figure 13:
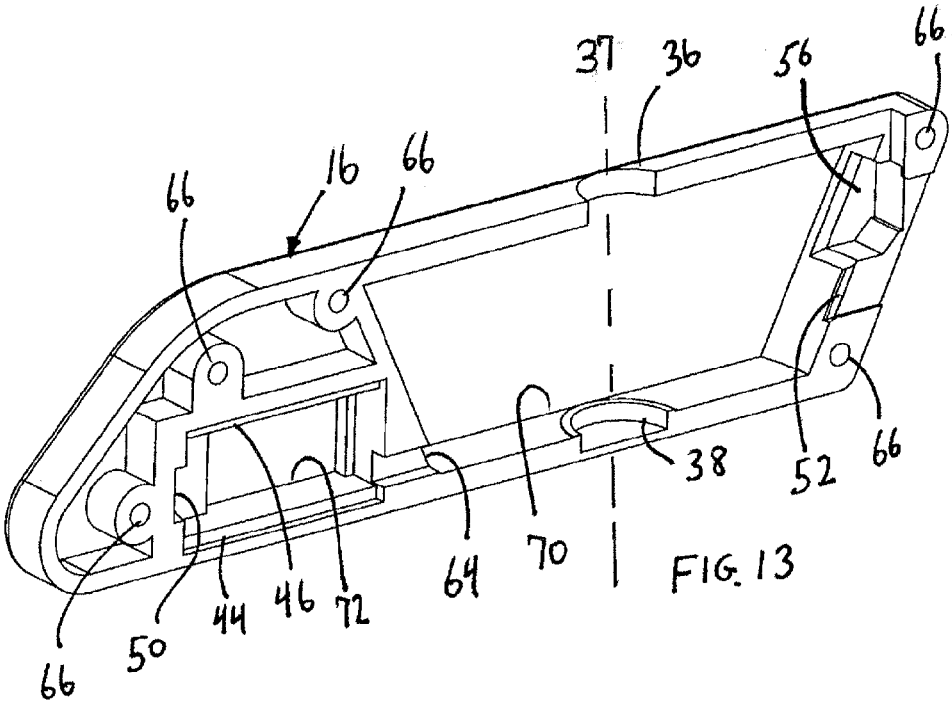
Figure 18:
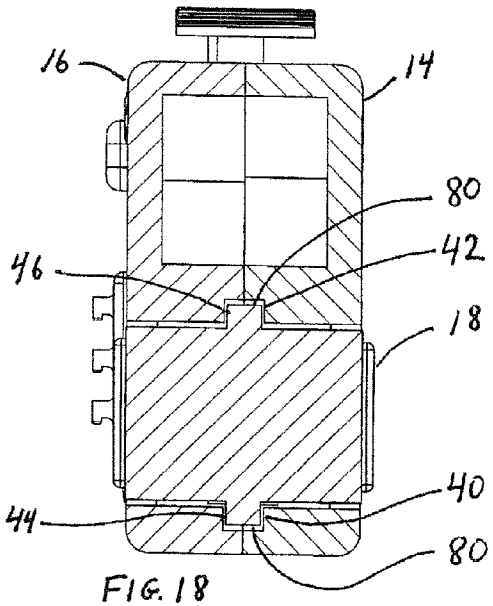
FIG. 18 is a cross-sectional view taken along the lines 18-18 of FIG. 17.

Biasing of carriage locking lever 18 is described simultaneous reference to FIGS. 12, 13, and 18. First frame member 14 and second frame member 16 each have a plurality of guides 42, 46, 44, and 40. As illustrated in FIG. 18, carriage locking lever 18 has two opposing guides 80 and is configured to fit within the first upper guide 42 and second upper guide 46 on one portion of carriage locking lever 18. On a second portion of carriage locking lever 18, opposite the first portion, carriage locking lever is configured to fit within first and second lower guides 40 and 44 respectively. Alternatively the biasing carriage locking lever 18 can be in the form of radial movement. Radial movement is achieved using arc shape guides or by the use of a pivot. Thus, carriage locking tab can be biased away from locking slot 29 via rotation.

The use of carriage locking tab 28 is one example of locking (retaining) rotating blade carriage 12 into the first or second positions. The knife 10 can be configured to function without a carriage locking tab 28. For example, when rotating blade carriage 12 is in the first or second position rotating blade carriage 12 will remain in position upon the advancement of blade 26, thus allowing the function without carriage locking tab 28.

Advantageously, blade 26 can be easily removed for disposal after use when blade 26 is in the advanced position. Referring to FIGS. 2 and 9, knife 10 is illustrated with blade 26 in the advanced position. In FIG. 1, the first end 24 of blade 26 is exposed for performing a cutting action due to rotating blade carriage 12 being in the first position. In FIG. 9, the other end 30 of the same blade 26 is exposed for performing a cutting action due to rotating blade carriage 12 being in the second position. Proximate to blade 26 is blade release member 90. In either position (first or second position of rotating blade carriage 12) the blade 26 can be removed from knife 10 by the selection of the proximate blade release member 90 to blade 26. More specifically, the depression of the blade release member closest to blade opening 20 will disengage blade 26 from knife 10 so that blade 26 can be withdrawn (pulled away from opening 20) from knife 10. It should be noted that knife 10 can have a single blade release member 90 such that blade 26 can be removed in only one position of the rotating blade carriage 12. For example, a single blade release member 90 can be proximate to blade 26 (blade opening 20) when rotating blade carriage 12 is in the second position. This would allow the removal of blade 26 only when rotating blade carriage 12 is in the second position. Alternately, knife 10 can be configured so that blade 26 can be removed when rotating blade carriage 12 is in the first position only.

In either position of rotating blade carriage 12, after removal of blade 26 from knife 10, knife 10 allows for automatic loading of subsequent blades 26. This is achieved by retracting engaging member 92 back into the first position. When engaging member 92 enters the first position (retracted), knife 10 automatically engages a subsequent blade 26. The subsequent blade 26 can then be advanced into the second position for use by engaging member 92. The entire process can be repeated until each blade is used and removed from knife 10. Knife 10 can then be reloaded with one of more unused blades 26.

Figure 10:
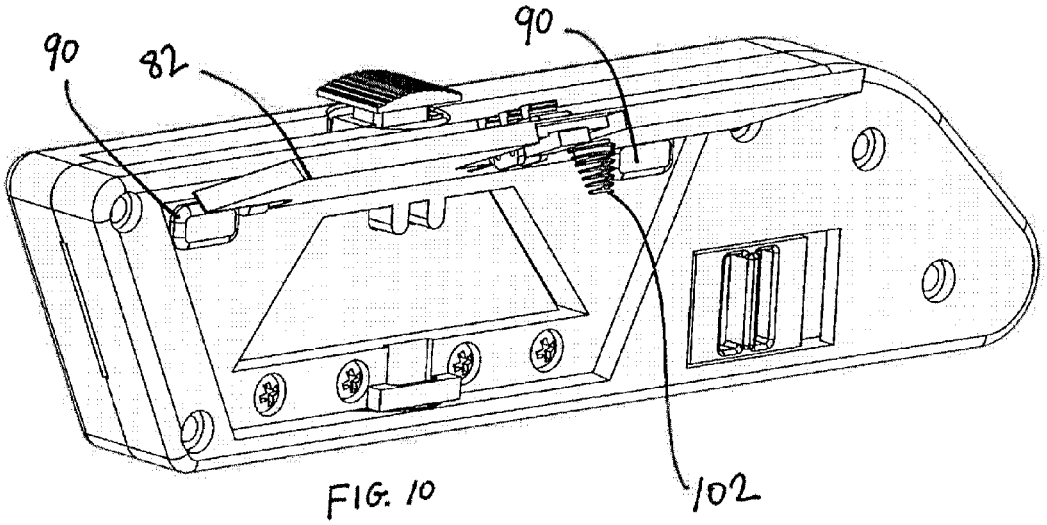
FIG. 10 is the knife of FIG. 1 with the door in a rotated position.
Figure 22:
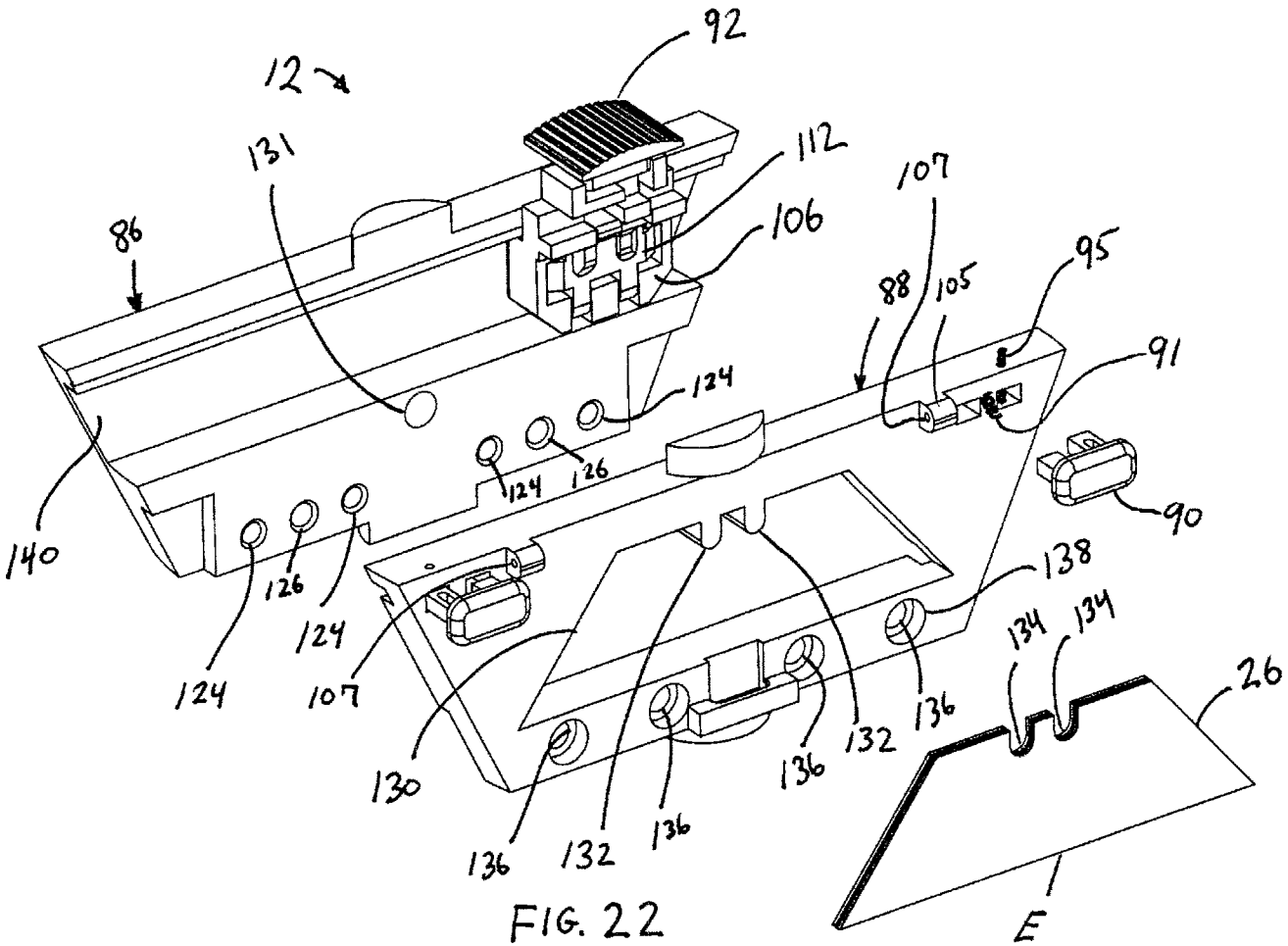
FIG. 22 is a partial exploded view of the rotating blade cartridge of FIG. 19.
Figure 28:
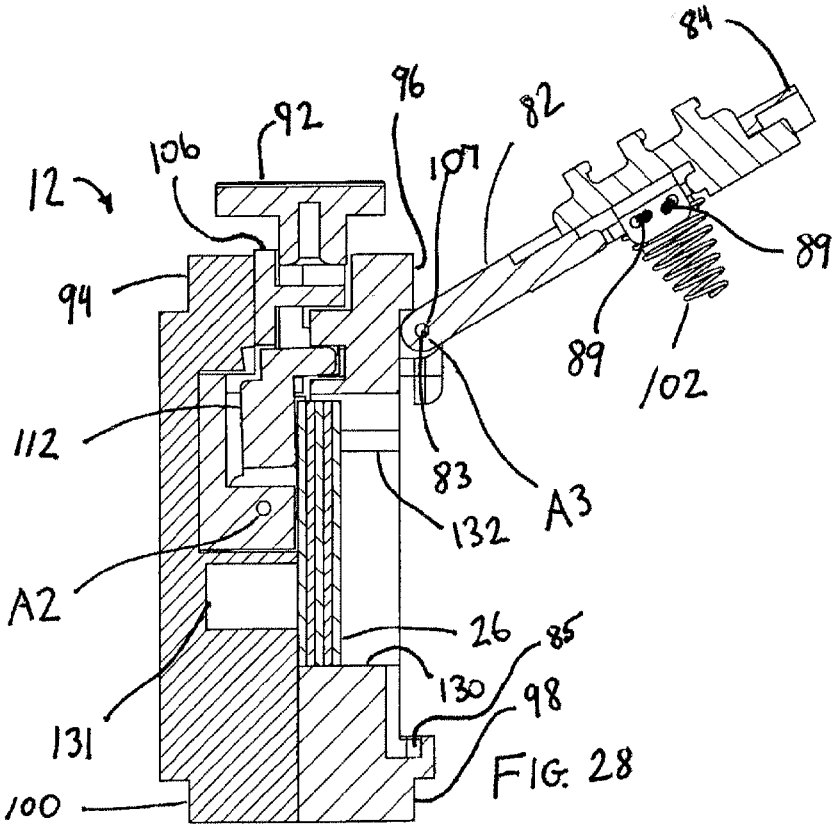
FIG. 28 is a cross-sectional view of the rotating blade cartridge from FIG. 27.
Figure 29:
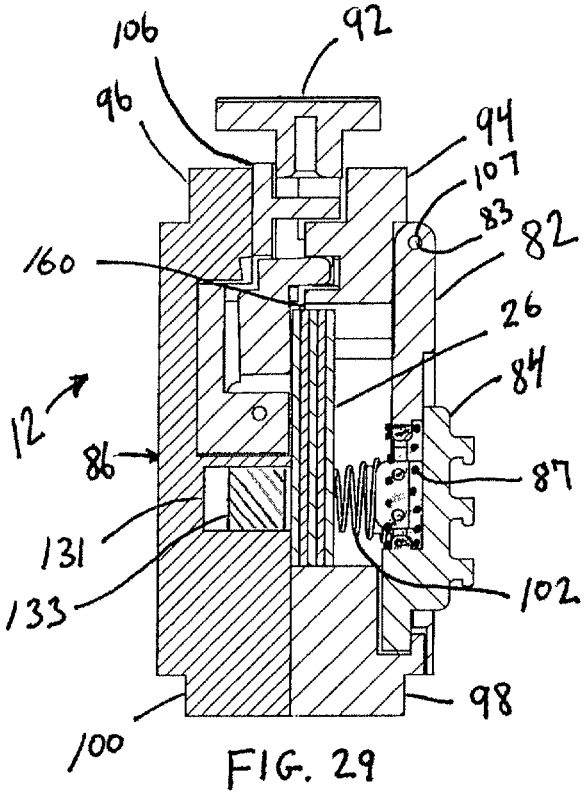
FIG. 29 is a view similar to FIG. 28, but showing the door in the closed position.
Figure 30:
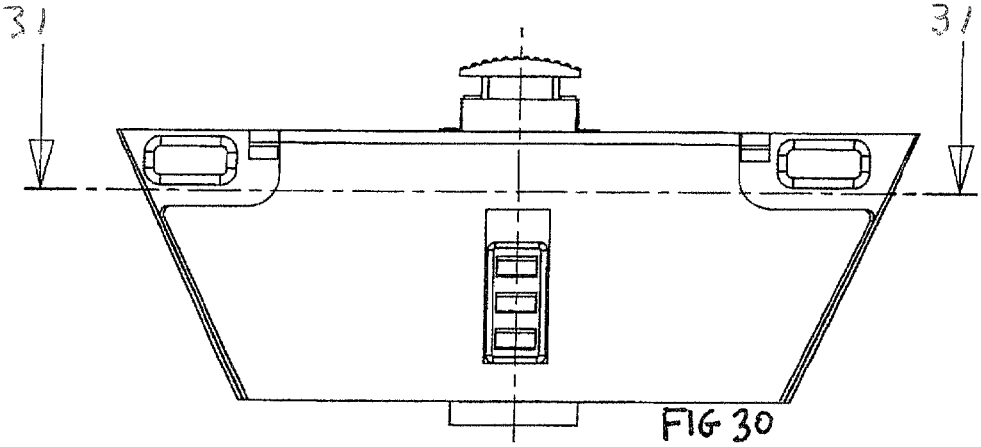
FIG. 30 is a front view of the rotating blade cartridge of FIG. 19.

Rotating blade carriage 12 allows for storage of a plurality of blades 26 (FIGS. 28, 29, 33, 39, 40, 41) and is configured to automatically allow for subsequent blades to be advanced when previous blades are removed from knife 10. Referring to FIG. 10, a plurality of blades 26 can be loaded into knife 10 with the simple opening of door 82. Door 82 is pivotally attached to a portion of rotating blade carriage 12. The door 82 can be attached to rotating blade carriage in any manner. As best seen in FIG. 28, a plurality of blades 26 are loaded into slot 130. Door 82 has a blade moving member 102 so that when door 82 is in the closed position (FIG. 29), the plurality of blades 26 is forced into the inner components of rotating blade carriage 12. In this example, blade moving member 102 is a coil compression spring; however, other substitutions for the blade biasing member are possible, including and not limited to leaf springs, elastomers, spring loaded arms, etc. Optionally, a magnet 133 (FIG. 29) can be affixed to pocket 131 on first carriage housing 86 to aid blade biasing member 102 in the retention of blade(s) 26. The details and function of the inner components of rotating blade carriage 12 will be discussed later in this disclosure. Referring to FIG. 22, blades 26 are guided in slot 130 by the use of alignment perches 132 located on second carriage housing 88. Blade 26 has a plurality of alignment slots 134 and the alignment perches 132 are sized and shaped to fit within alignment slots 134. One skilled in the art can appreciate that the blade 26 can have any desired quantity of alignment slots 134 and any shape configuration. Therefore, the alignment perches 132 can also be configured to guide any shape blade having any quantity of alignment slots 134. The blade 26 can be fabricated in alternate shapes and styles for multiple applications. To accommodate blades having alternate shapes, slot 130 can be configured so the alternate shapes of various blades can be inserted therein.

Figure 11:
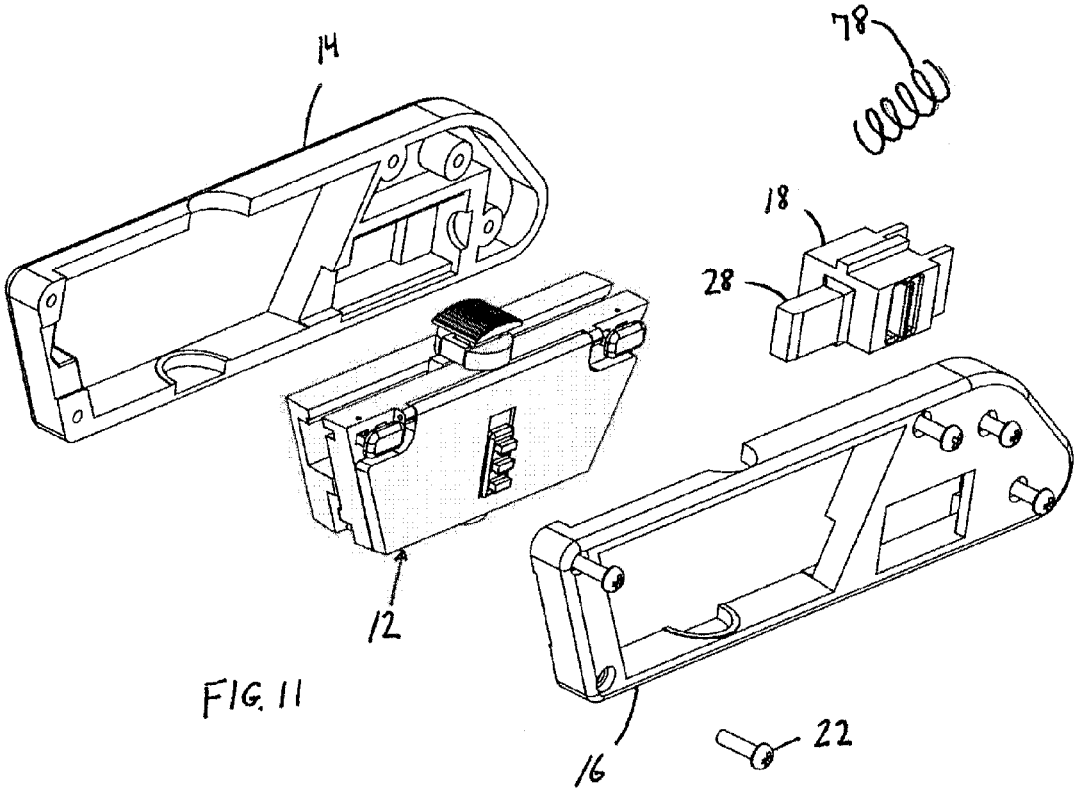
FIG. 11 is an exploded view of the knife of FIG. 1.

Components of knife 10 will now be explained in more detail. Referring to FIG. 11, knife 10, in this example, is comprised of a first frame member 14, a second frame member 16, a rotating blade carriage 12, a carriage locking lever 18 having a carriage locking tab 28, a locking lever resilient member 78, and one or more fasteners 22 used to assemble the first and second frame members (14 and 16) to form knife 10. There are other options for assembly of first and second frame members including and not limited to welding (such as ultrasonic), gluing, snap fit and others.

Figure 19:
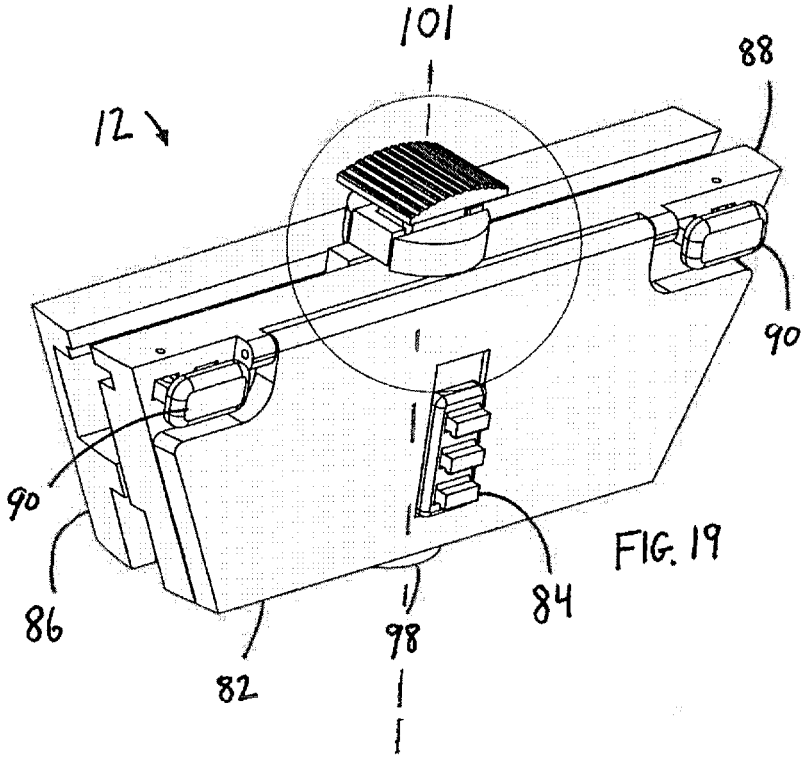
FIG. 19 is an isometric view of the rotating blade cartridge of the knife of FIG. 1.

Referring now to FIGS. 12 and 13, the first frame member 14 and the second frame member 16 are shown in detail. In this example, the first frame member 14 has a plurality of screw receiving bores 60. The second frame member 16 has complementary screw holes 66. Bores 60 and holes 66 are aligned such that the housing 11 (FIG. 1) is formed when assembled. As previously described, the first frame member 14 and the second frame member 16 can be joined in any fashion by way of ultrasonic welding, adhesive, and the like. The first frame member 14 contains a first upper pivot 32 and a first lower pivot 34. First upper pivot 32 and first lower pivot 34 are circular in shape and their alignment forms a common axis 33. The second frame member 16 contains a second upper pivot 36 and a second lower pivot 38. The second upper pivot 36 and the second lower pivot 38 are also circular in shape and their alignment also forms a common axis 37. When the first frame member 14 and the second frame member 16 are aligned and joined to form housing 11, each of the pivots 32, 34, 36, 38 form a colinear alignment. The alignment of axis 33, 37 to the axis 101 of rotating blade carriage 12 (FIG. 19) forms the axis A1 as illustrated in FIG. 3 and allows the rotating blade carriage 12 to pivot about the housing 11.

The first and second frame members 14, 16 can be fabricated from numerous materials such as and not limited to metal such as die cast aluminum or zinc, injection molded plastic, machined components, etc. The first and second frame members 14, 16 can be fabricated in any desired shape, size, or color and any combinations thereof to form the housing 11. The housing 11 can further include a rubber grip or a portion of rubber such as an elastomeric over-molded grip for added comfort during use.

Figure 20:
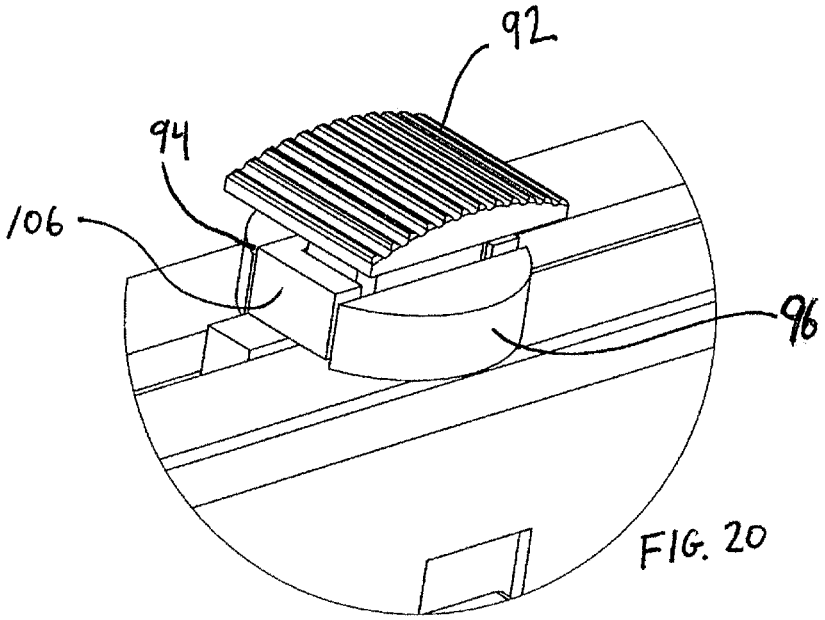
FIG. 20 is a detail view taken from FIG. 19.
Figure 21:
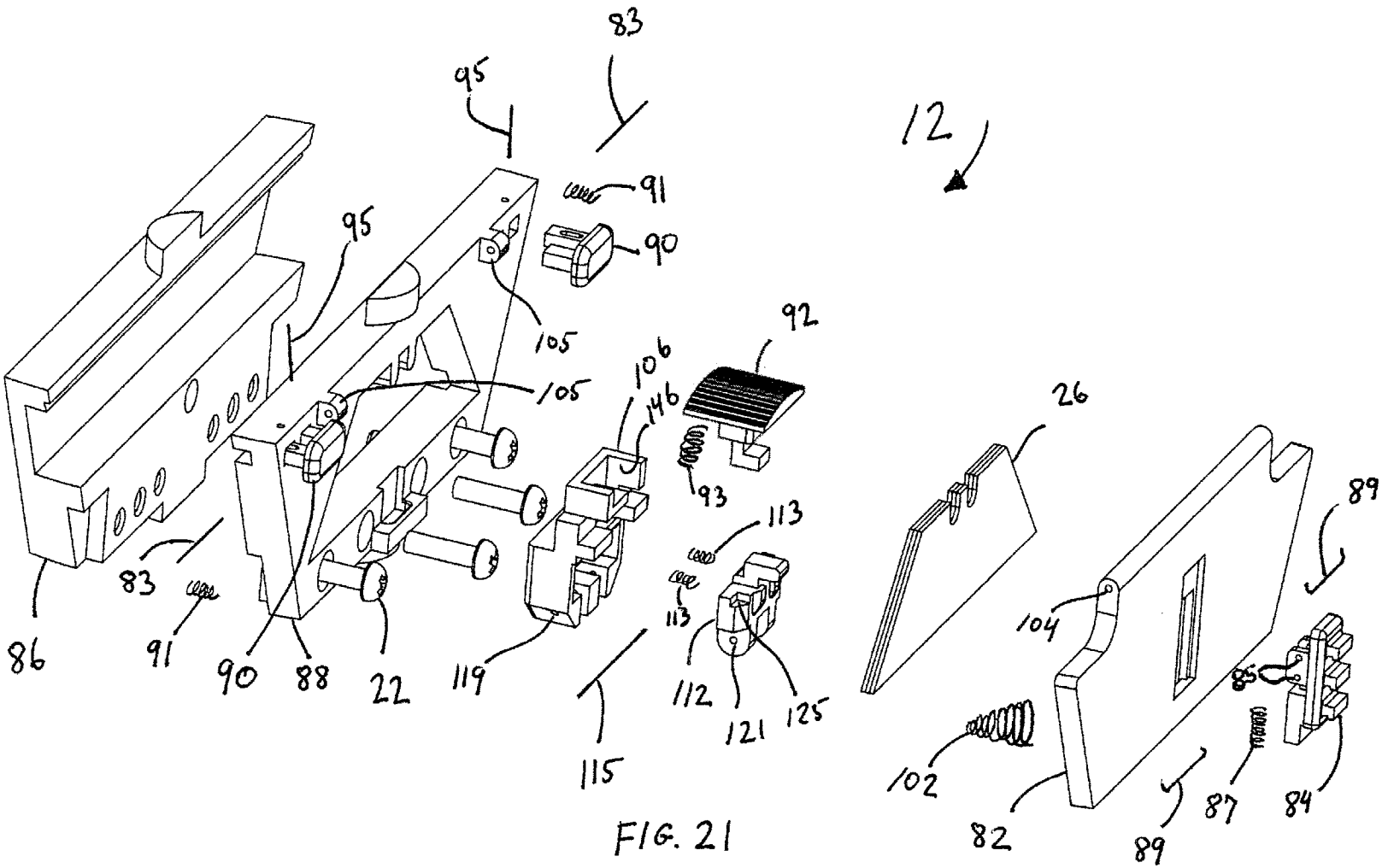
FIG. 21 is an exploded view of the rotating blade cartridge of the knife of FIG. 1.

FIGS. 19 to 38 illustrate the rotating blade carriage 12. With simultaneous reference to FIGS. 19, 20, and 28, the rotating blade carriage 12 will be described in detail. The rotating blade carriage 12 compromises a first carriage housing 86, a second carriage housing 88, a door 82, a door release 84, an engaging member 92, at least one blade release member 90, and other various internal components that will be described later in this disclosure. A first carriage housing 86 has a first upper pivot portion 94 and a first lower pivot portion 100. A second carriage housing 88 has a second upper pivot portion 96 and a second lower portion 98. The joining of the first carriage housing 86 and the second carriage housing 88 forms the common axis 101 and space 97 (FIG. 2). The rotation of the rotating carriage 12 relative to the housing 11 is achieved by the common alignment of axis 33, 37, and 101 forming axis A1 illustrated in FIG. 3. Axis A1 is formed when rotating carriage housing 12 is assembled with housing 11 (joining of first and second frame members 14/15 respectively). Referring to FIGS. 2 and 20, the space 97 allows for a moving member 106 to pass therethrough when the engaging member 92 is actuated by a user. The space 92 allows for the advancement of the blade 26 when the rotating blade carriage is either in the first or second position.

Figure 32:
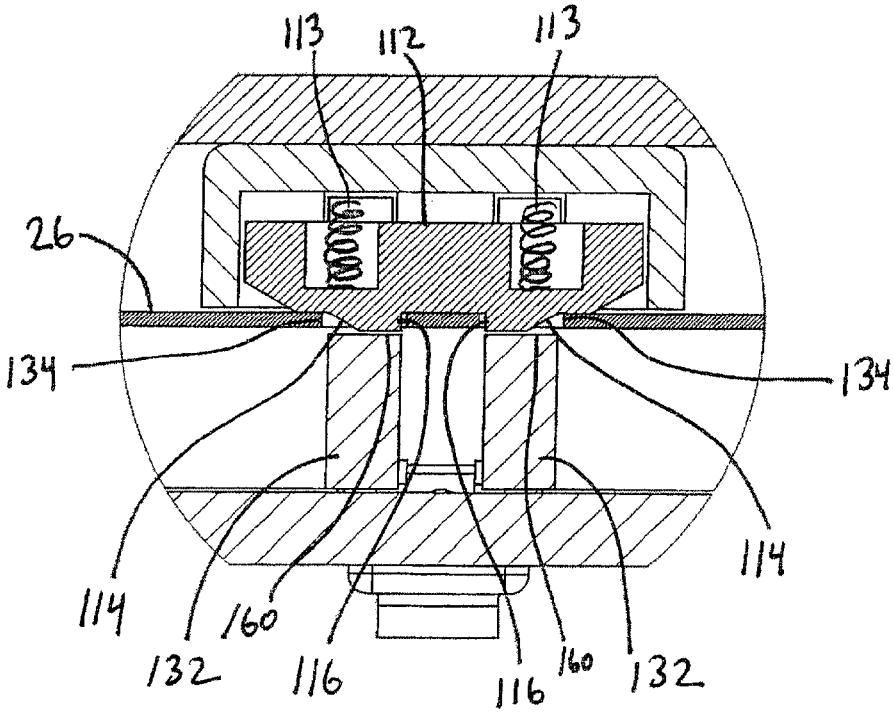
FIG. 32 is a detail view of FIG. 31.
Figure 33:
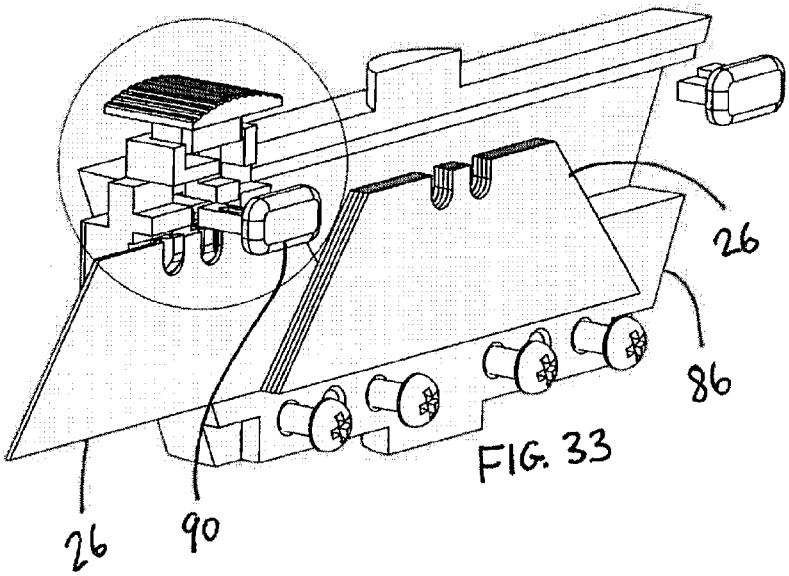
FIGS. 33 to 39 are partial assembly views of the knife of FIG. 1 illustrating various modes of operation.

Now referring to FIG. 22 for a partial exploded view of the rotating blade carriage 12, the first carriage housing 86 comprises a guide 140 which allows the moving member 106 to move. This is also illustrated in the section views of FIGS. 28 and 29. Now referring to FIGS. 21 and 26, the moving member 106 contains a stationary bore 119. Aligned to the stationary bore 119 is a pivot bore 121 contained on the blade engaging member 112. The alignment of the stationary bore 119 to the pivot bore 121 form the common axis A2 where shaft 115 is inserted via interference fit to allow the blade engaging member 112 to pivot therefrom. The side walls of moving member 106 prevent axial movement of the blade engaging member 112. There are numerous ways of retaining shaft 115 including, and not limited to, ultrasonic welding, adhesive, and others. The blade engaging member 112 comprises one or more bores allowing one or more resilient members 113 to bias blade engaging member 112 towards blade 26 into a blade engaging position as illustrated in FIG. 32. There are numerous options to bias blade engaging member into the blade engaging position including, and not limited to, elastomers, torsion springs, and others.

Referring back to FIGS. 21 and 26, the blade engaging member 112 further includes indent 125 which contacts stop 127 when blade engaging member 112 is in the blade engaging position. This ensures the blade engaging member 112 remains substantially parallel to blade 26 allowing for automatic reloading of blade 26 as will be described later in this disclosure.

Figure 23:
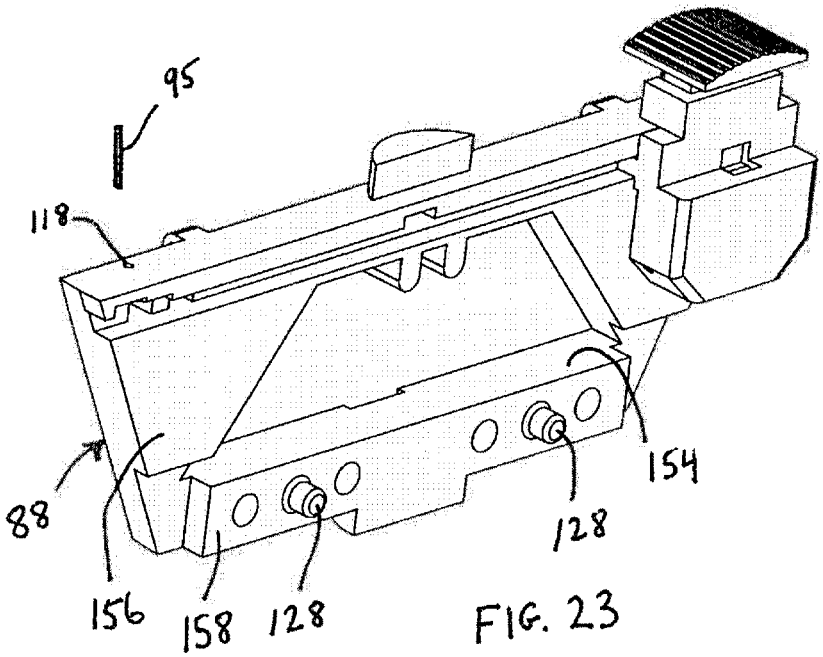
FIGS. 23 to 26 illustrate partial assembly views of the components of FIG. 19.
Figure 24:
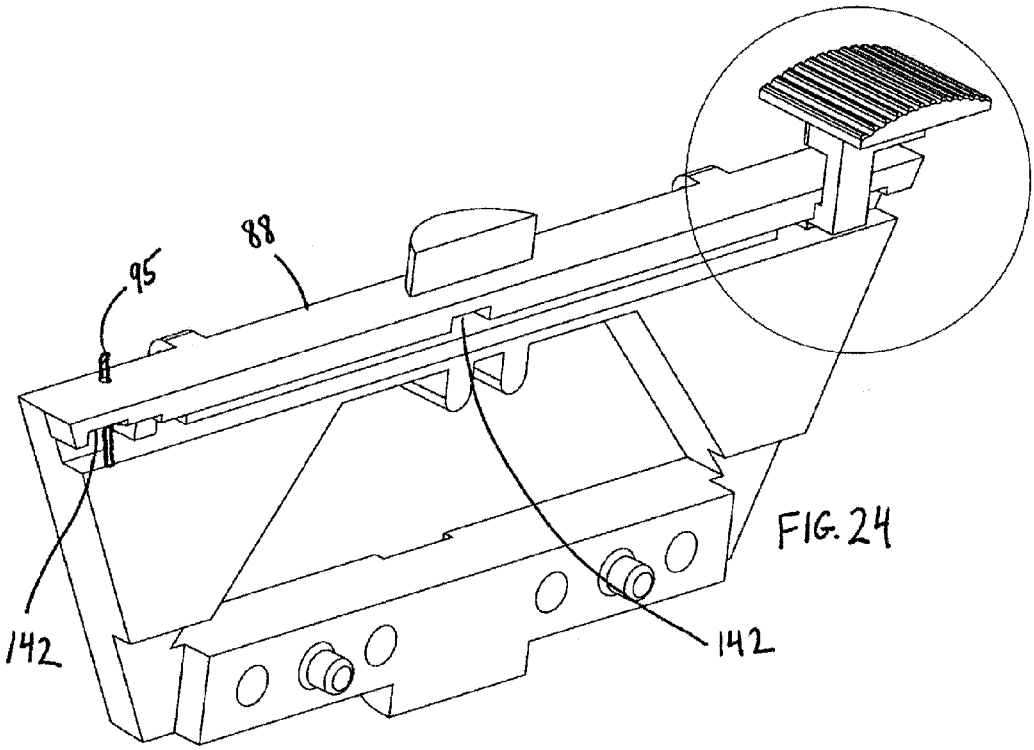
Figure 25:
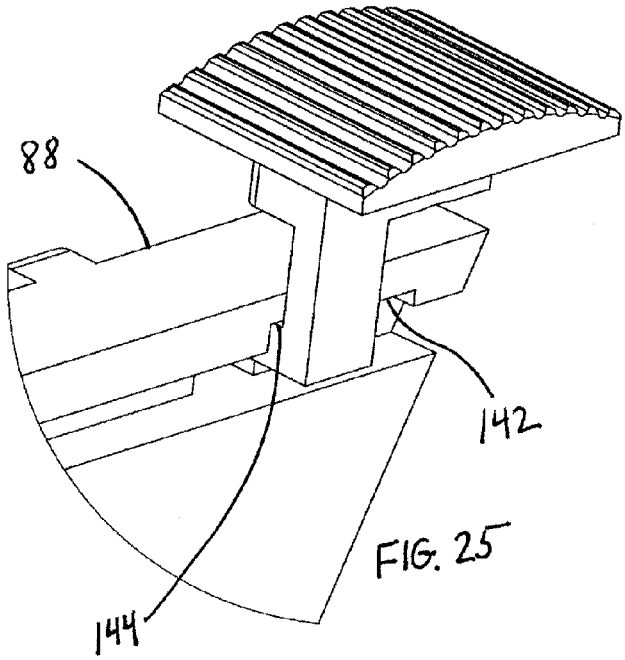
Figure 26:
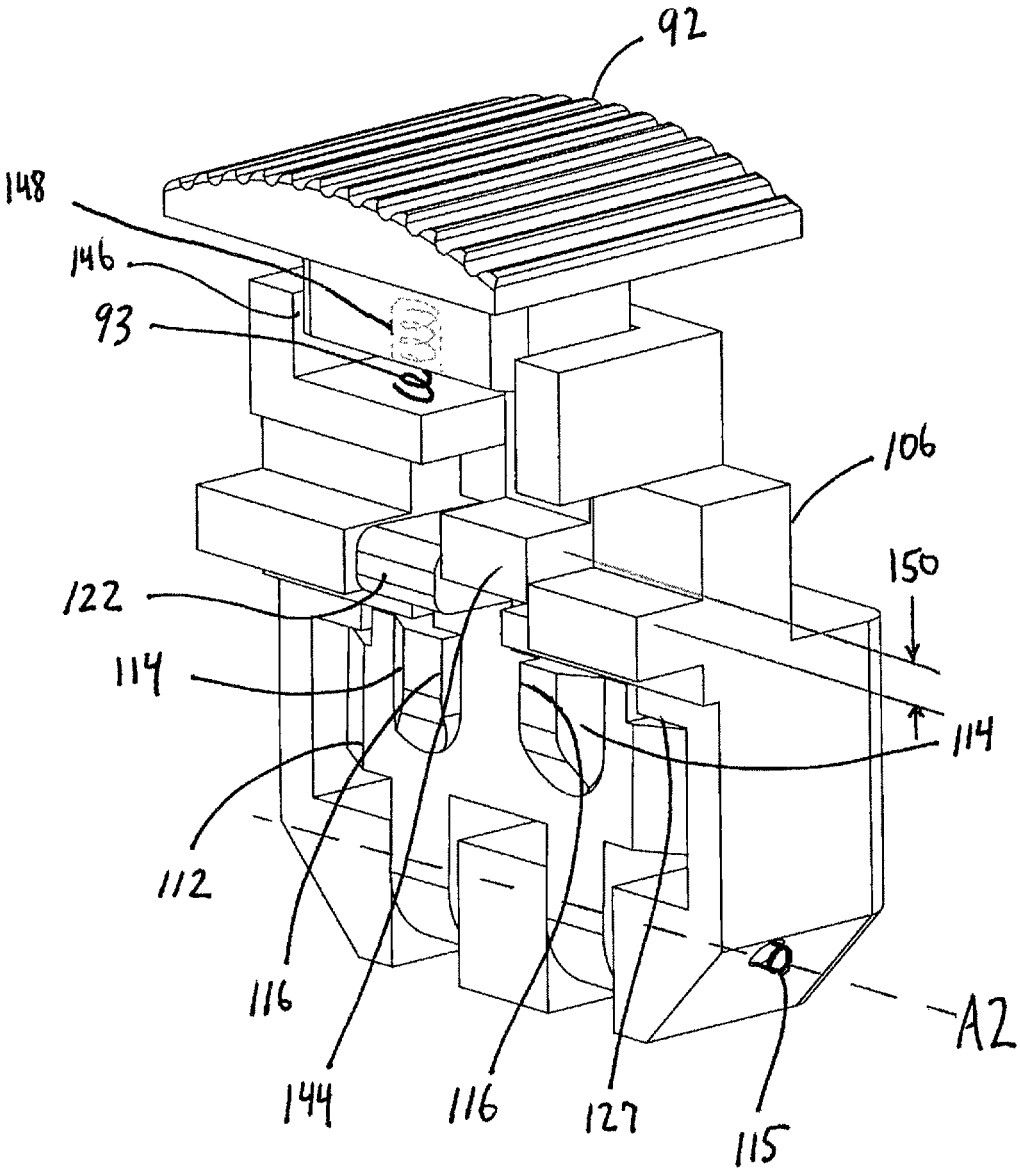
Figure 27:
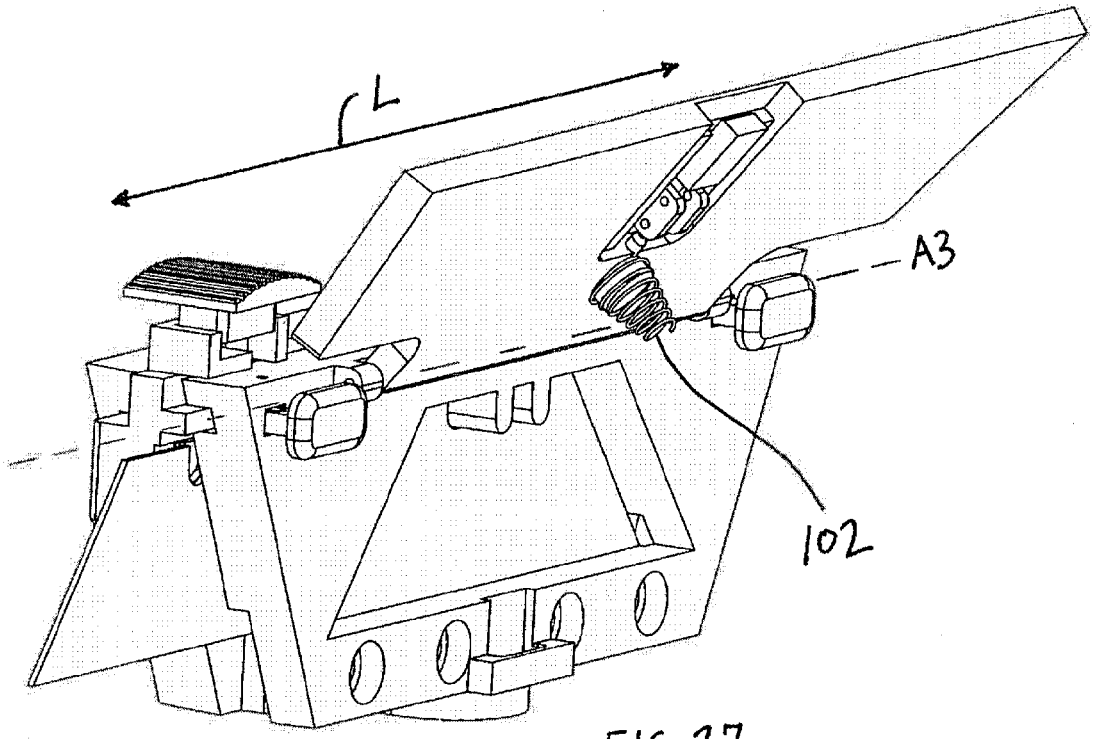
FIG. 27 is an isometric view of the rotating blade cartridge of FIG. 19 illustrating the door in the open position.

The moving member 106 includes a pocket 146 so that the engaging member 92 can be inserted therethrough. The engaging member 92 has a bore 148 allowing for the insertion of a return member 93. In this example, return member 93 is a coil compression spring. However, there exist various options to bias engaging member 92 such as, and not limited to, elastomers, torsion springs, extension springs, and others. The engaging member 92 further includes an index member 144. (See FIG. 26) When the engaging member 92 is in the natural position, index member forms a step 150. This allows the assembly of FIG. 26 to be selectively locked in various positions. As illustrated in FIG. 24 with various components removed for clarity, index member 144 is positioned within a recess 142 in the second carriage housing 88. This ensures the components of FIG. 26 remain fixed in position. FIG. 23 illustrates the components of FIG. 26 locked into the selective position of FIGS. 24 and 25. FIG. 27 illustrates the entire assembly of the rotating blade carriage 12 with the blade 26 in the advanced position (knife 10 of FIG. 2 with components removed) and is in the same selected position as FIGS. 23 through 25. Upon the selective depression of the engaging member 92, the index member moves away from recess 142 and allows engaging member to be moved to an alternate position such as the position illustrated in FIG. 19 (comparable to FIG. 1). The return member 93 allows the return of index member 144 into an alternate recess 142. There can exist multiple locations for recess 142 allowing alternate cut positions of blade 26.

Figure 31:
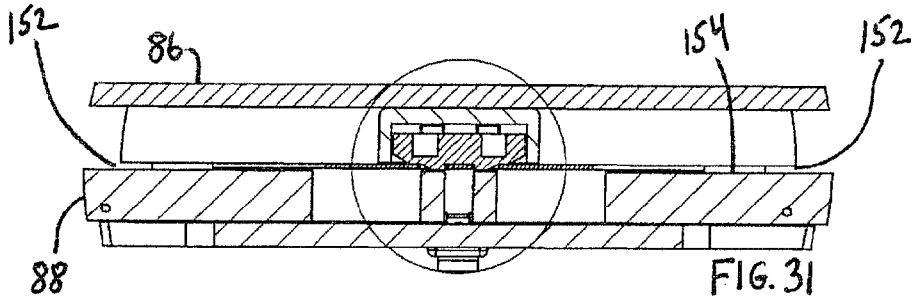
FIG. 31 is a cross-sectional view along lines 31-31 of FIG. 30.

Referring back to FIGS. 22, 26, 31, and 32, advancement of the blade 26 is made possible when the holding members 116 of the blade engaging member 112 are engaged into the alignment slots 134 of the blade 26, FIGS. 31 and 32 illustrates a cross sectional view of the engagement of blade 26 to blade engaging member 112. The resilient members 113 ensure this engagement remains so that the blade 26 can bias into and out of an opening 152 (FIG. 31). The opening 152 is formed by the assembly of the first carriage housing 86 to the second carriage housing 88. The second carriage housing 88 has a surface 154 to which the edge E of blade 26 aligns. Adjacent to the surface 154 are walls 156 and 158 (see also FIG. 23). The walls 156 and 158 are offset so that when the first carriage housing 86 is affixed to second carriage housing 88, opening 152 is formed. The opening 152 is aligned to the blade opening 20 (FIGS. 1, 7, and 8) so that the blade 26 can advance through knife 10 (FIGS. 2 and 9) when the rotating blade carriage is in either the first position (FIGS. 1 and 2) or the second position (FIGS. 7 to 9). It would be worth noting that the edges 160 of alignment perches 132 allows for the blade engaged with blade engagement member 112 to freely move. However, this offset engages the remaining plurality of blades and prevents additional blades from moving.

Figure 34:
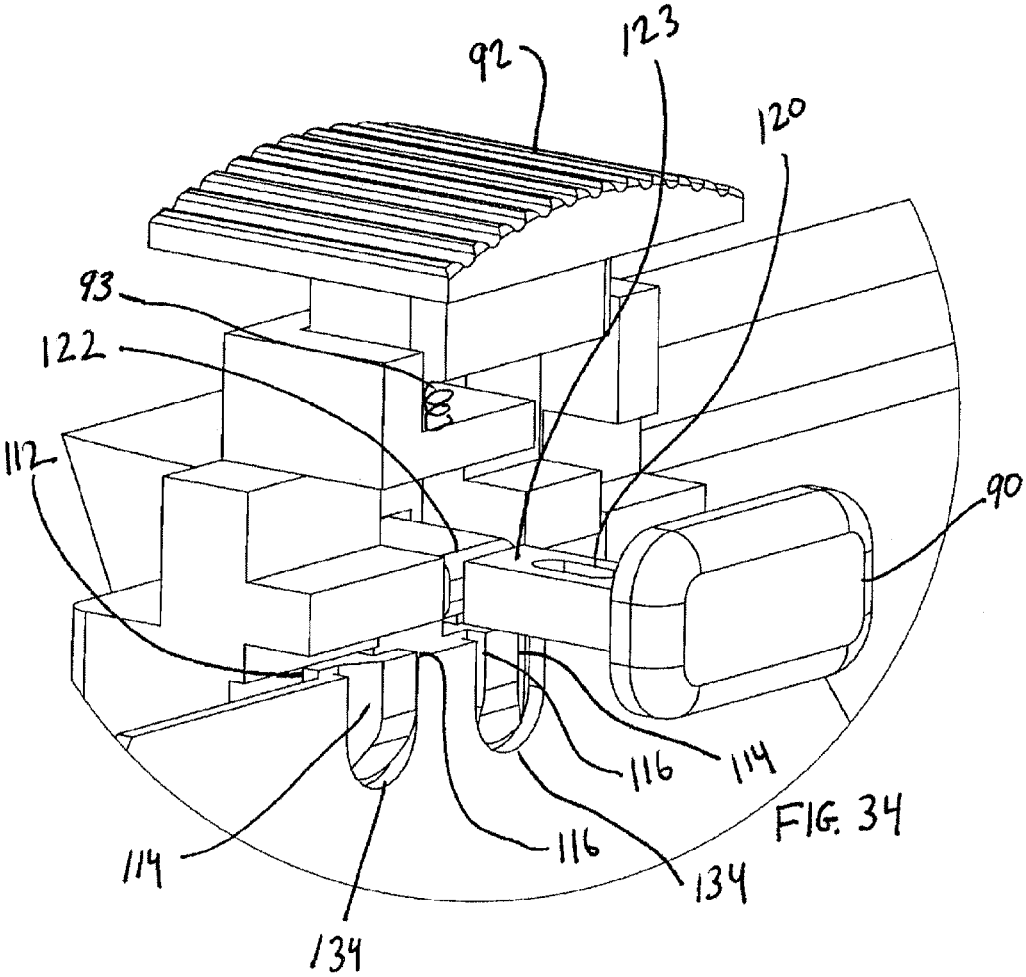
Figure 35:
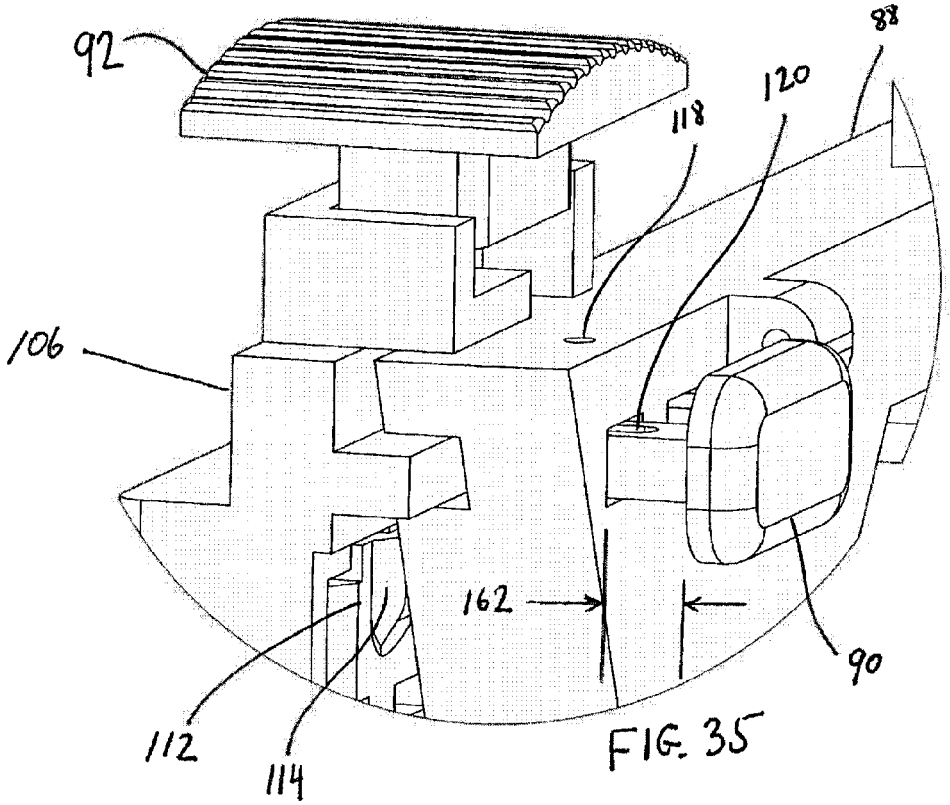
Figure 36:
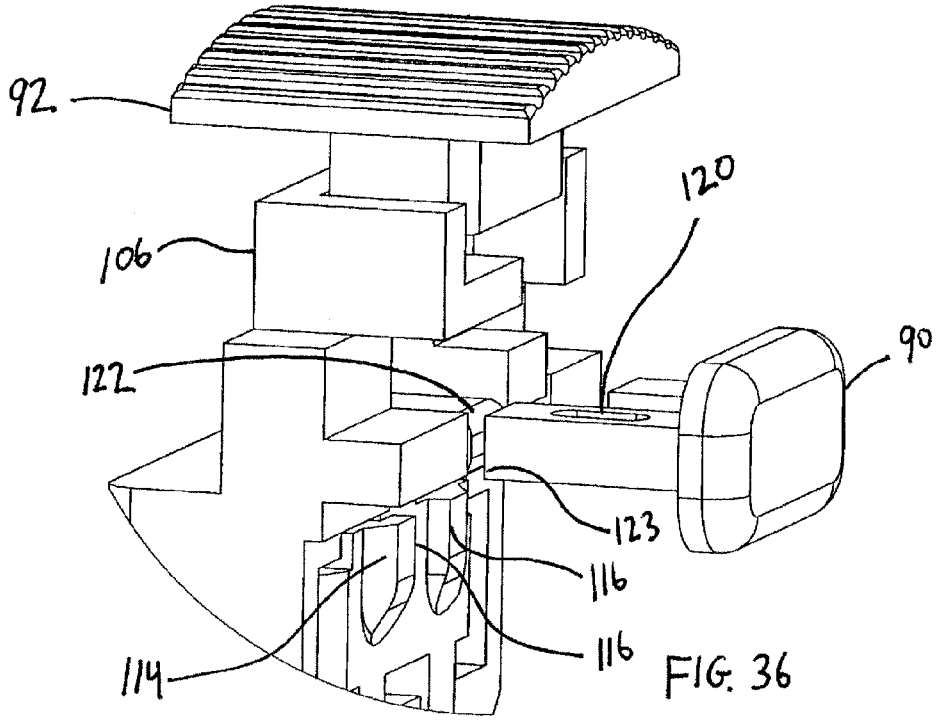
Figure 37:
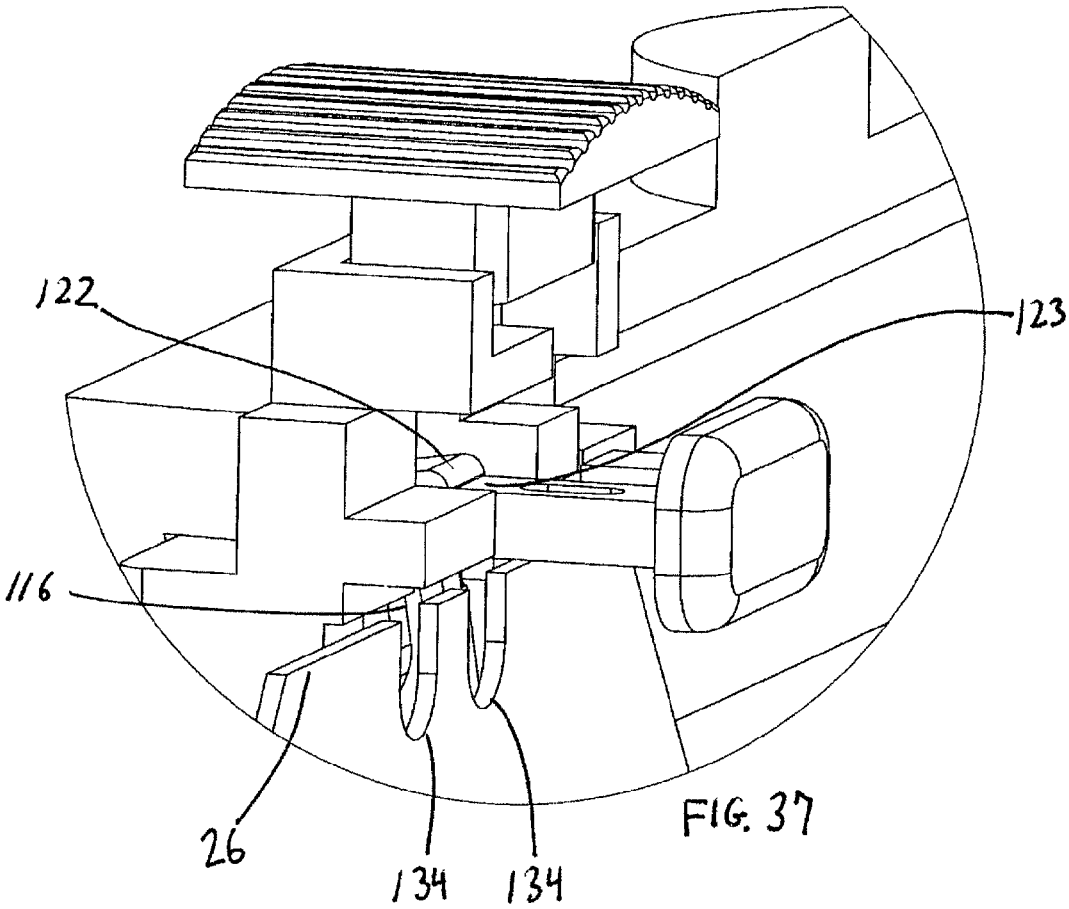
Figure 38:
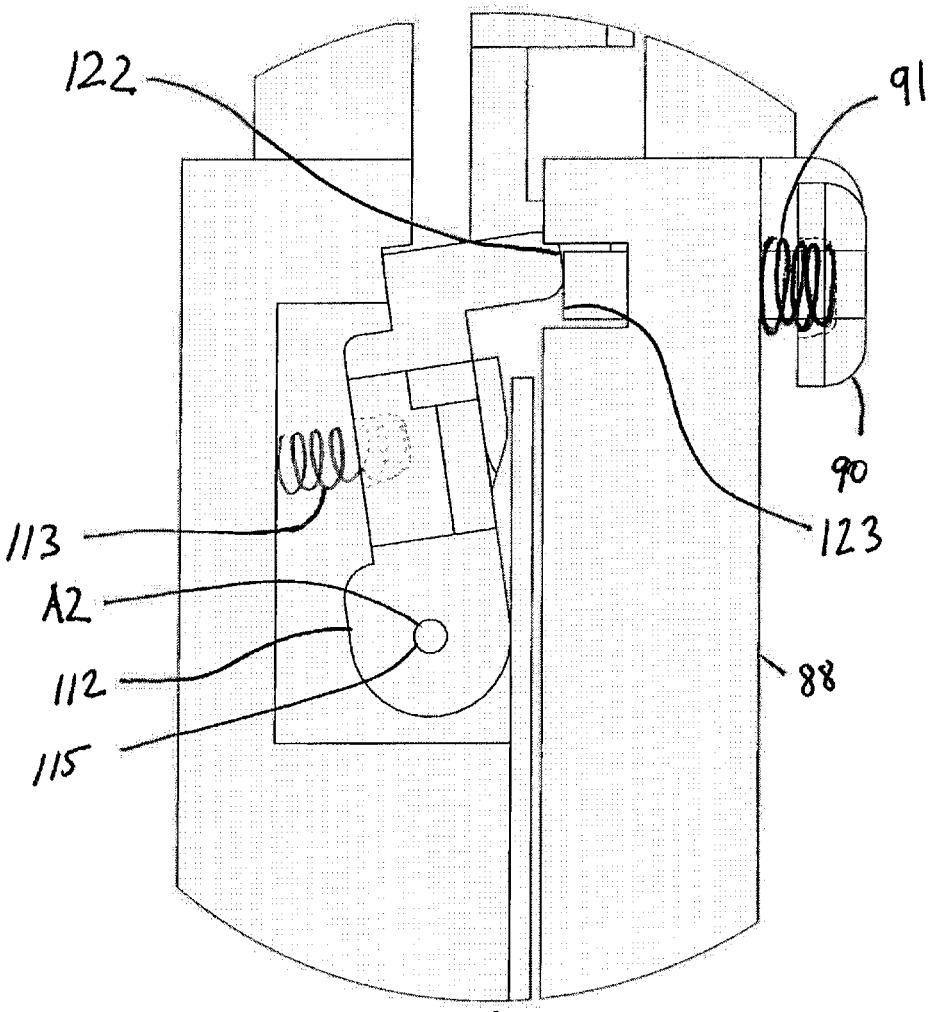
Figure 39:
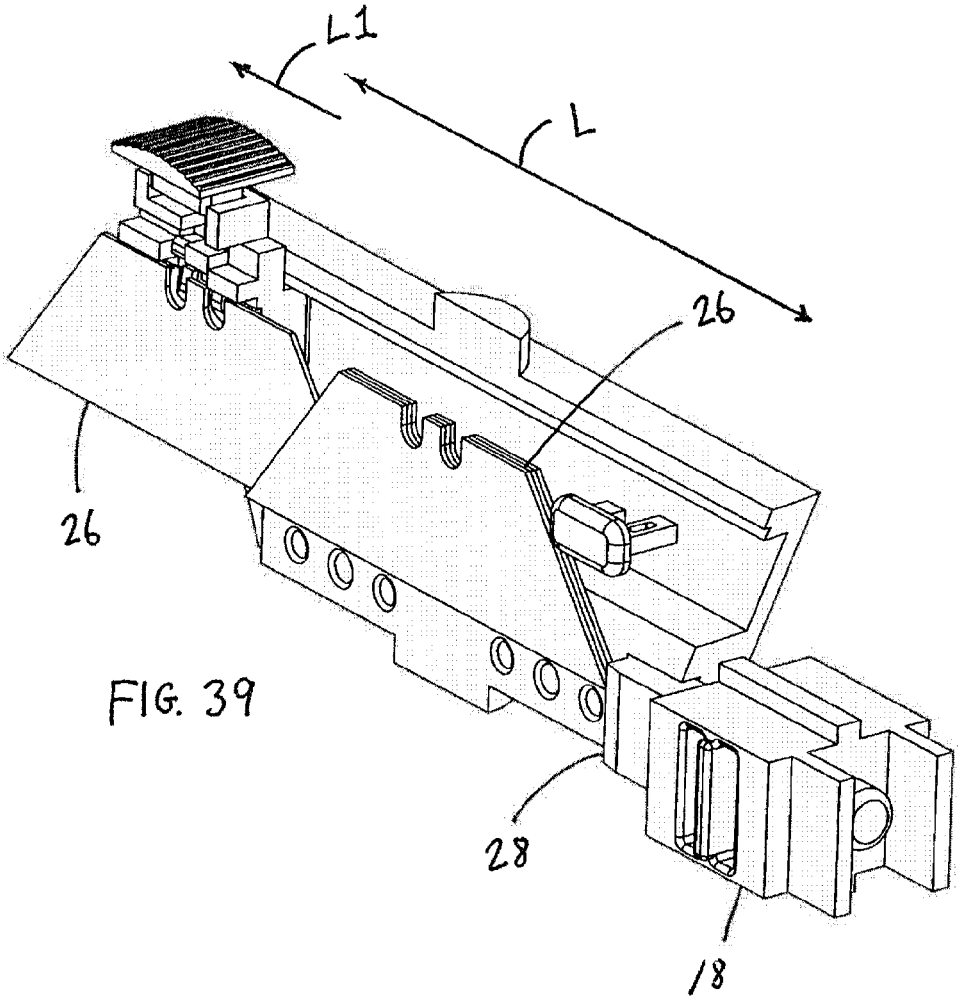

The blade engagement member 112 will continue to move the engaged blade 26 until selectively removed. The removal of the engaged blade 26 is explained by simultaneous reference to FIGS. 33 to 39. When blade 26 is advanced (with engaging member 92 in the second position), the actuating member 123 of the blade release member 90 is substantially proximate to the release member 122 of the blade engaging member 112. This is best seen in FIGS. 34 and 36. When the blade release member 90 is depressed, the actuating member 123 contacts the release member 122 and rotates the blade engaging member 112 into moving member 106 compressing the resilient member 113 (FIGS. 37, 38, and 39). This causes holding members 116 to disengage with alignment slots 134. The blade can then be removed by pulling in the direction L1 substantially along the line of action L as illustrated in FIG. 39. When blade release member 90 is released, the blade engaging member 112 returns back into the engaging position and the blade release member 90 returns back to the natural position distance 162 as illustrated in FIG. 35. In the example provided, the blade engaging member 112 rotates relative to the moving member 106; however, it is contemplated by this disclosure that blade engaging member can translate instead of rotate (piston within bore). The distance 162 is made possible by the blade release return member 91 as shown in FIG. 38. The blade release return member 91 contacts a portion of blade release member 90 and the second carriage housing 88. The blade release member 90 is retained when the blade release retaining shaft 95 (FIG. 24) is inserted into the retaining bore 118 and allowed to pass through the retention slot 120 (FIG. 35). One or more openings in the second carriage housing 88 allow the actuating member 123 and the retention slot to pass therethrough. There are many options to rotate the blade engagement member 112 for the release of blade 26 via many alterations of blade release member 90 including other various motions and attachments to second carriage housing 88 such as, and not limited to, switches, buttons, levers, etc. The components of the rotating blade carriage 12, more particularly the first and second carriage housing 86, 88 the blade release member 90, the moving member 106, the blade engaging member 112, engaging member 92, the door release 84, and the door 82 can be fabricated in any material and in any desired shape. These components can be configured to function as described in alternate sizes. These components can be constructed out of die cast aluminum, injection molded plastic, machined components, etc.

Figure 40:
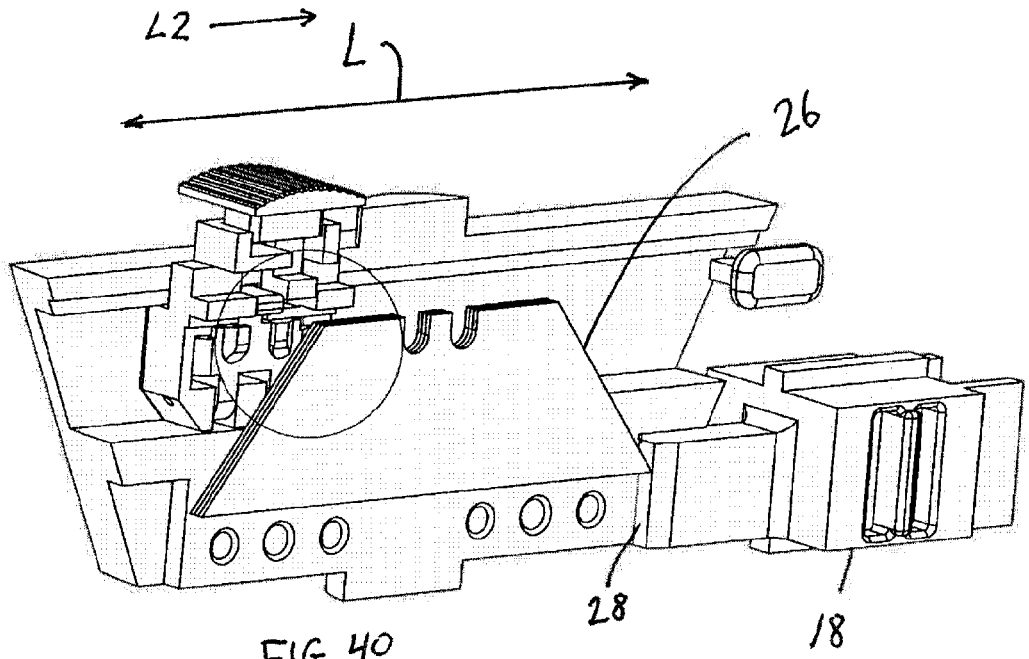
FIGS. 40 to 43 are partial assembly views of the knife of FIG. 1 illustrating the automatic loading of the blade after removal.
Figure 41:
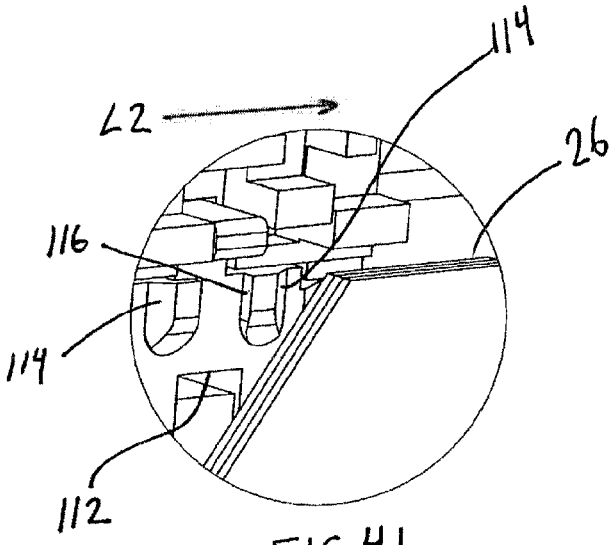

The automatic reload of subsequent blades will now be explained by referencing FIGS. 40 and 41. After the aforementioned removal of the blade 26 (FIG. 39), subsequent blades can automatically be reloaded by the blade engaging member 112. This will occur automatically by biasing the engaging member 92 from the second position (after blade removal) into the first position along the line of action L and in the direction L2. The first position of the engaging member 92 is depicted in FIGS. 1, 7, and 8. As illustrated in FIGS. 40 and 41, the engaging member 112 will automatically pivot back into the moving member 106 when the leading surface 114 contacts the subsequent blade during transition into the first position. The leading surface 114 of the holding members 116 are shaped and configured as an inclined plane, cam surface, or the like so that holding members 116 will bias under blade 26. Upon entry into the first position along direction L2, holding members 116 will align with alignment slots 134 on blade 26 (FIG. 32). This allows the resilient members 113 to automatically lock the blade engaging member into the engaged position. FIG. 32 also illustrates the leading inclined surface 114 of the holding member 116. It would be worth noting that in this example, automatic loading of subsequent blades can be loaded when the rotating carriage member 112 is either in the first position or the second position. One having ordinary skill in the art can appreciate that knife 10 can be configured to only allow removal and automatic reload of blades in a single position.

Figure 42:
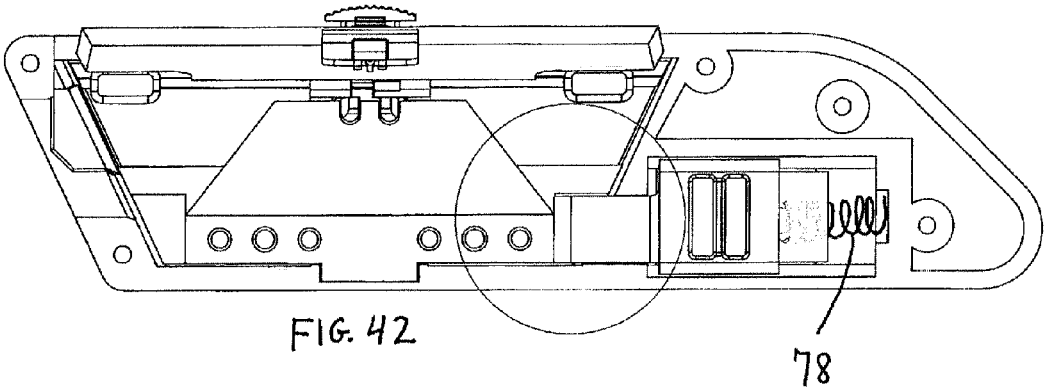
Figure 43:
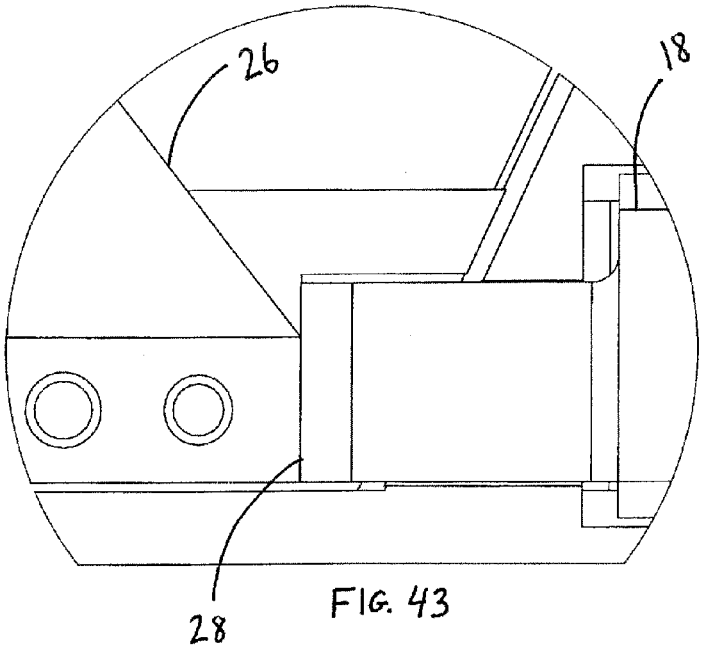

During normal production of a blade 26, burrs and other imperfections can be formed on one or more edges along the perimeter. These burrs or imperfections can cause unwanted movement of the subsequent blade and/or the plurality of blades 26 during the automatic loading. For example, when transitioning into the first position of blade engaging member 112, leading member 114 can grip a burr or imperfection of subsequent blade 26 and cause unwanted movement of a blade 26 in the direction of L12 (FIGS. 40 and 41). Advantageously, carriage locking tab 28 of carriage locking lever 18 can be configured to mitigate and/or alleviate this effect. By simultaneous reference to FIGS. 40, 42, and 43, the carriage locking tab 28 is configured to support at least one portion of subsequent blade(s) 26 opposite the direction L2. As best seen in FIG. 43, the carriage locking tab 28 can form a contact for subsequent blade(s) 26 during reload. The locking lever resilient member 78 can be configured to overcome any forces due to friction, burrs, imperfections, etc. during the engagement of blade engaging member 112. The carriage locking tab 28 can provide this function when the rotating blade carriage 12 is either in the first position or the second position. This is possible since carriage locking tab 28 is integral to housing 11. One having ordinary skill in the art can appreciate that there are many possible structures and configuration for supporting the blade(s) 26 during automatic reload of the blade engaging member 112 that will fall within the scope of this disclosure.

It should be noted that knife 10 is described herein by way of example only in use with utility knife blades. However, it is contemplated by the present disclosure for knife 10 (as well as all of the embodiments of the knife described herein below) to find use with any other type of removable blades such as, but not limited to sports knives, hand saws, and others.

Figure 44:
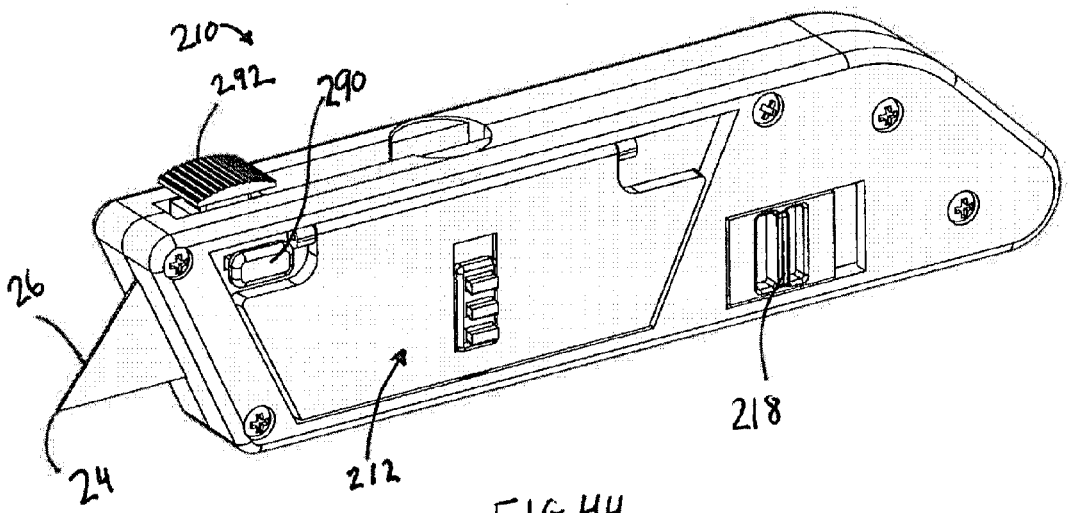
FIG. 44 is an isometric view of a second exemplary embodiment of a knife according to the present disclosure.

Referring now to FIG. 44, a knife according to a secondary exemplary embodiment of the present disclosure is shown having reference numeral 210. The knife 210 includes only a single blade release member 290 and is configure for removal of blade 26 in a single position of rotating blade carriage 212. The knife 210 is substantially similar to knife 10 with the exception of having only one blade release member 290. Accordingly, the knife 210 can be configured to remove blade 26 when rotating blade carriage 212 is in the first position only. Alternatively, knife 210 can be configured to remove blade 26 when the rotating blade carriage 212 is in the second position only. In this example, automatic reloading of blade 26 will follow the chosen configuration of blade removal. For example, if knife 210 is configured for removal of blade 26 when rotating blade carriage 212 is in the first position, then automatic reload of subsequent blades will also occur when rotating blade carriage is in the first position. This will occur in the same manner as previously described. FIG. 44 illustrates the configuration for blade removal when rotating blade carriage 212 is in the first position. In the event that the rotating blade carriage 212 is in the second position, the rotating blade carriage 212 can be unlocked by selectively actuating carriage locking lever 218. The rotating blade carriage 212 can then be rotated into the first position as illustrated in FIG. 44 for depression of the blade release member 290. This will allow the blade 26 to be withdrawn from the knife 210 as previously described.

Figure 45:
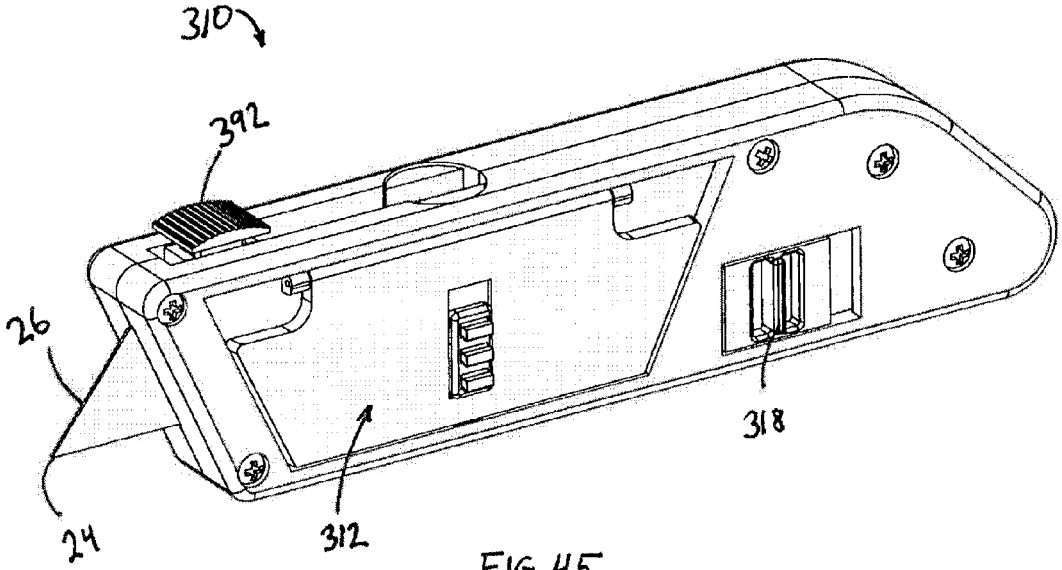
FIG. 45 is an isometric view of a third exemplary embodiment of a knife according to the present disclosure.
Figure 46:
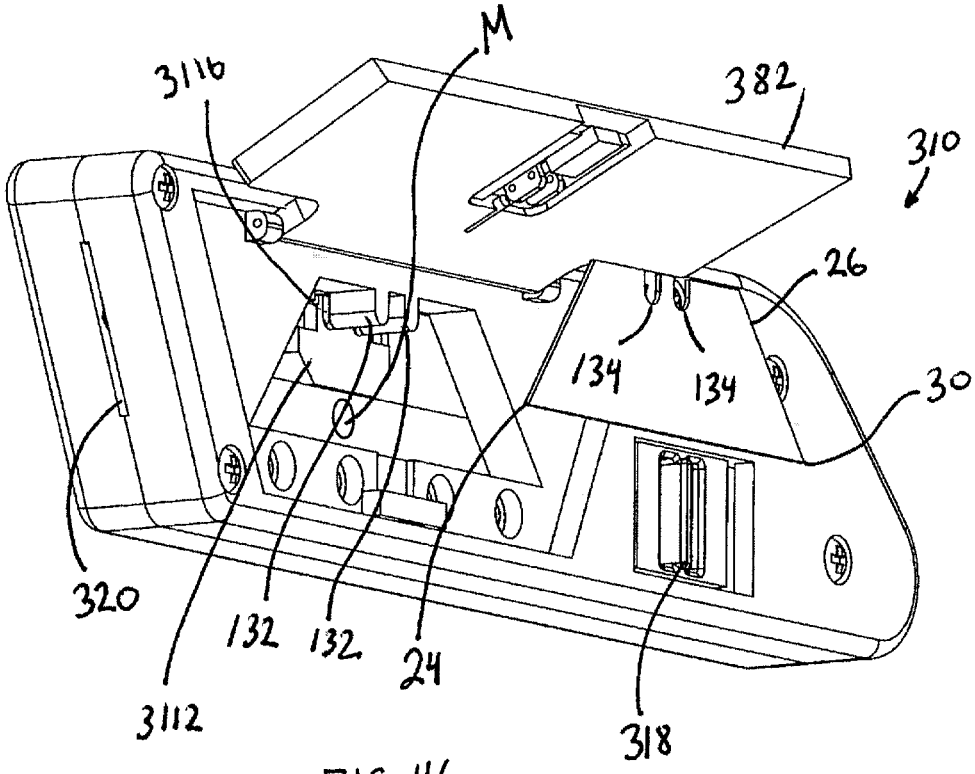
FIG. 46 is the blade of FIG. 45 with the door in the open position and the blade removed.

Referring now to FIGS. 45 and 46, a knife according to a third exemplary embodiment of the present disclosure is shown having reference numeral 310. The knife 310 does not include a blade release member and is configured for a single use of a blade 26. In this example, the user loads a single blade 26 into a rotating blade carriage 312 by opening door 382. This operation is substantially similar as previously described examples. To keep the blade 26 into position, magnet M (FIG. 46) can be positioned to retain the blade 26 when engaging member 392 is in the first position (blade retracted). The user can then advance blade 26 into the advanced position for a cutting action. FIG. 46 illustrates first end 24 will be used for the first cutting action. When desired, rotating carriage 312 can be reversed so that the opposite end (second side 30) of blade 26 can be utilized. When blade 26 is to be replaced, the user can unload the used blade 26 by opening door 382. A subsequent blade can be inserted for use. There are many options of loading and unloading the blade 26 for single use including, and not limited to, separation of two halves, sliding into a channel, sliding into a positive engagement (snap), and others. Since the knife 310 does not automatically load subsequent blades after removal, the blade engaging member can be rigidly affixed to the moving member. In the example provided, knife 310 has the blade engaging member integral to moving member. Referring to FIG. 46, a blade engaging member 3112 is configured to move with engaging member 392 for the advancement of blade 26. The blade engaging member 3112 is not required to rotate relative to the blade 26 as in the previous embodiments (recall from FIG. 38). In this example, when the blade 26 is loaded into the knife 310, magnet M will retain the blade 26 so that the holding members 3116 can engage alignment slots 134 for the advancement and retraction of blade 26.

Figure 50:
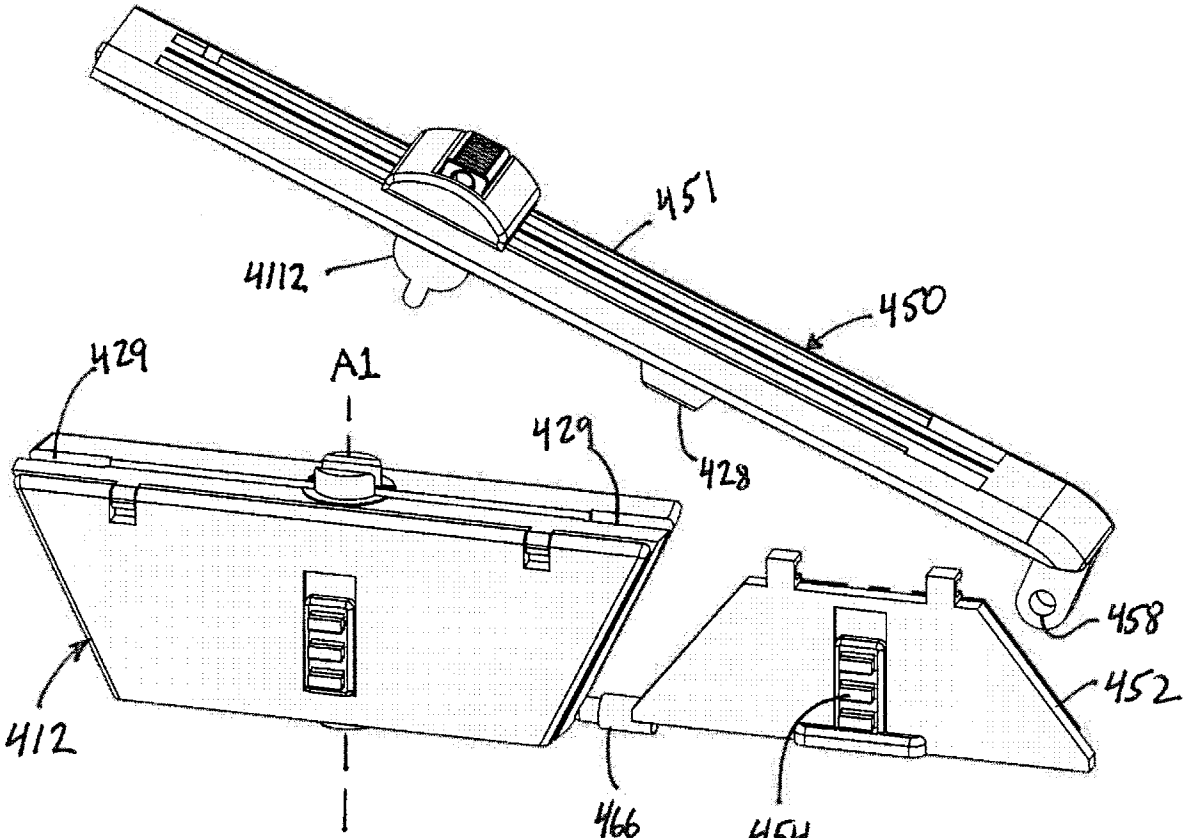

Referring now to FIGS. 47 to 55, a knife according to a fourth exemplary embodiment of the present disclosure is shown having reference numeral 400. The knife 400 includes a rotating blade carriage 412 and is configured to engage a blade 26 substantially along the direction of axis A1 (FIG. 50). Advantageously, the knife 400 further includes a storage compartment 470 for discarded blades that can be automatically loaded after use. The function of knife 400 is similar to the previous embodiments in terms of the rotating blade carriage 412. However, in this example, the blade 26 is engaged from a top portion thereof. This is possible by including a track assembly 450. The track assembly 450 includes a track 451, an engaging member 492, and a release member 4144. By simultaneous reference to FIGS. 48, 48A, 48B and 49, the release member 4144 includes a tab 480 and biases within an engaging member 492. The release member 4144 also includes a return member 482. In this example, the return member 482 is a coil spring; however, various other structures or components can provide a biasing force to release the member 4144. The return member 482 is contained in a hole 486 and a post 484. To provide the selectable locations of the blade 26 and the engaging member 492, the track 451 further includes a plurality of recesses 4142 so that a tab 480 can insert into. This allows the user to select the desired positions of the blade 26.

Figure 47:
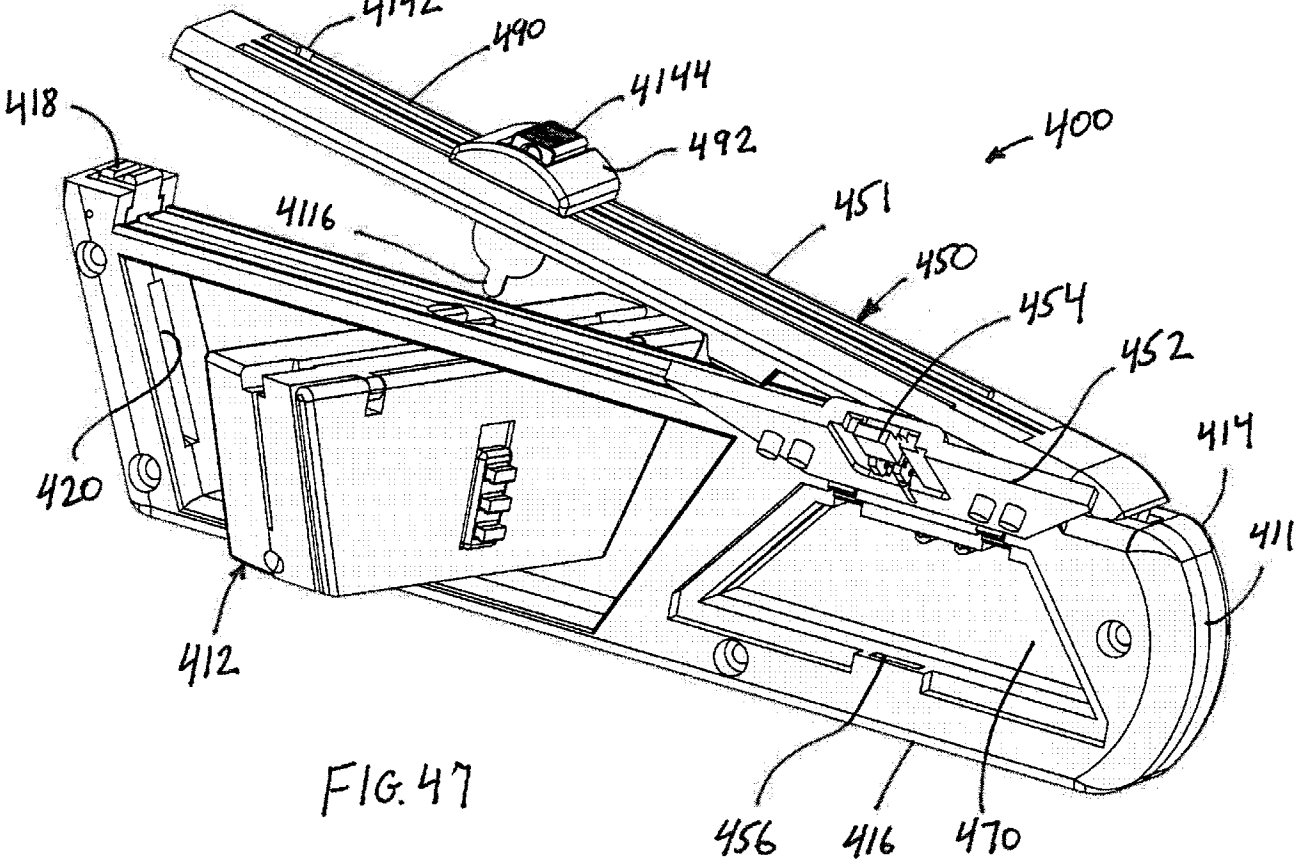
FIG. 47 is an isometric view of a fourth exemplary embodiment of a knife according to the present disclosure.
Figure 48A:
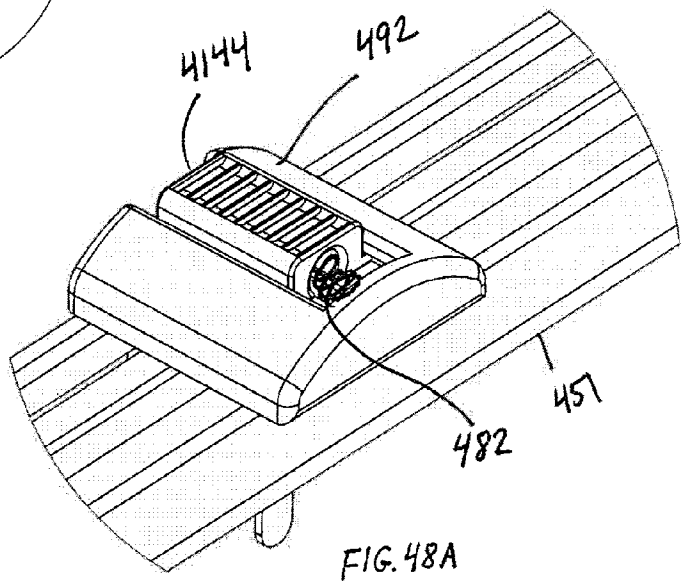
FIGS. 48 to 51 illustrate various components of the knife of FIG. 47.
Figure 48:
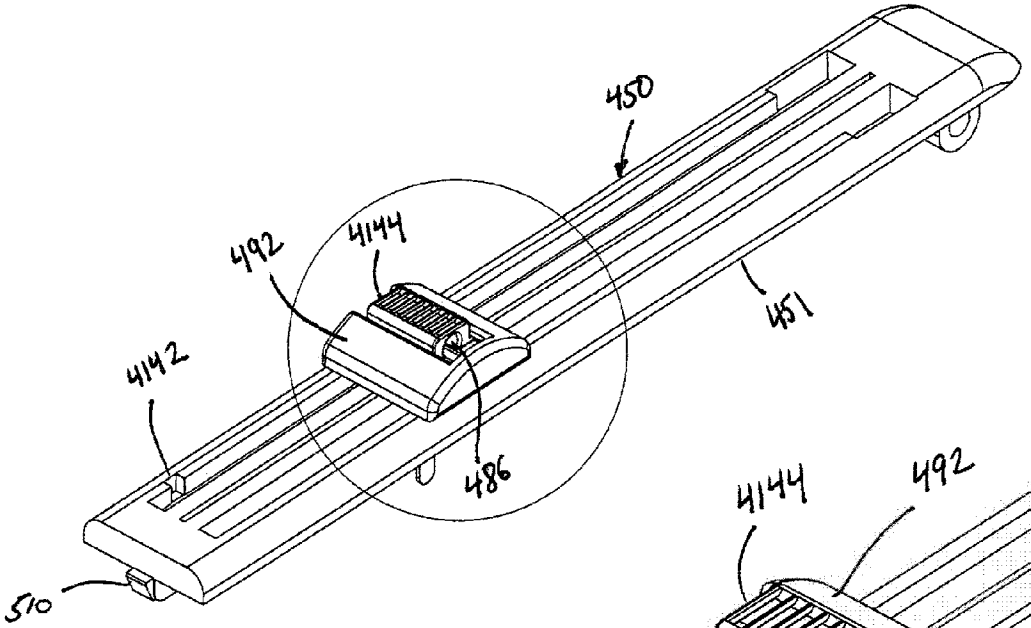
Figure 48B:
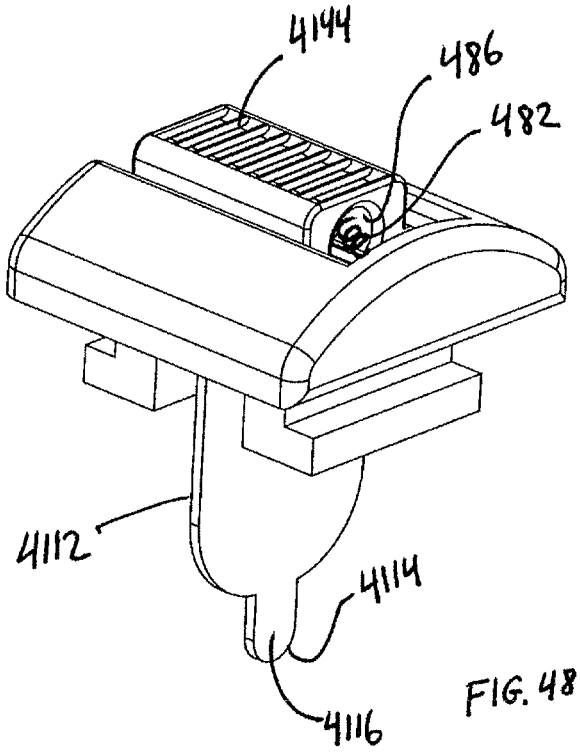
Figure 49:
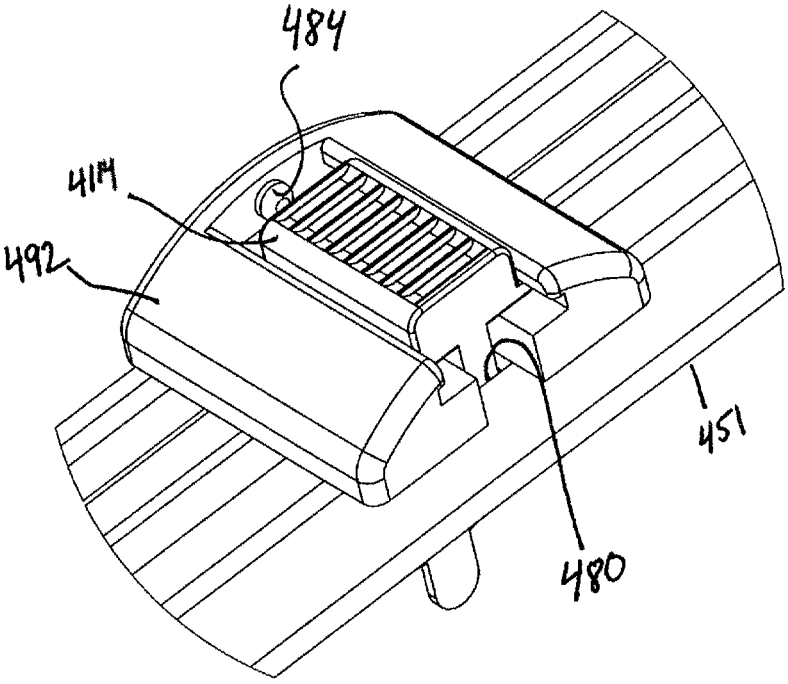
Figure 49A:
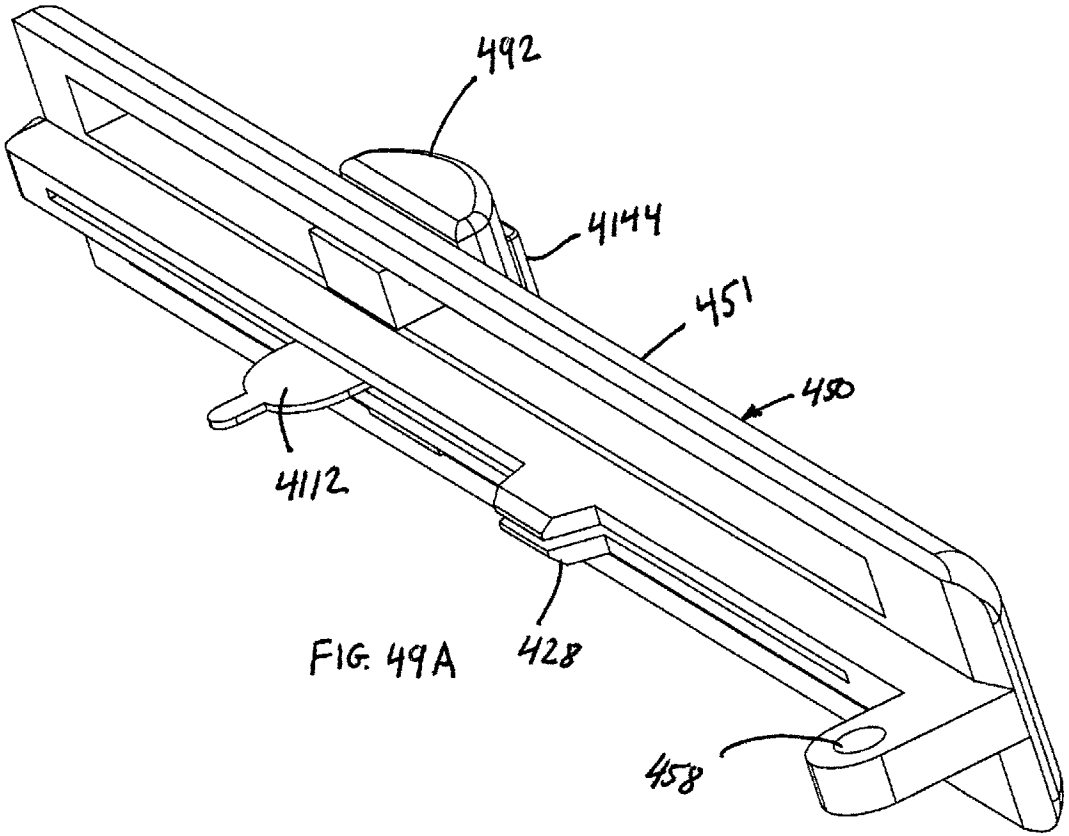
Figure 51:
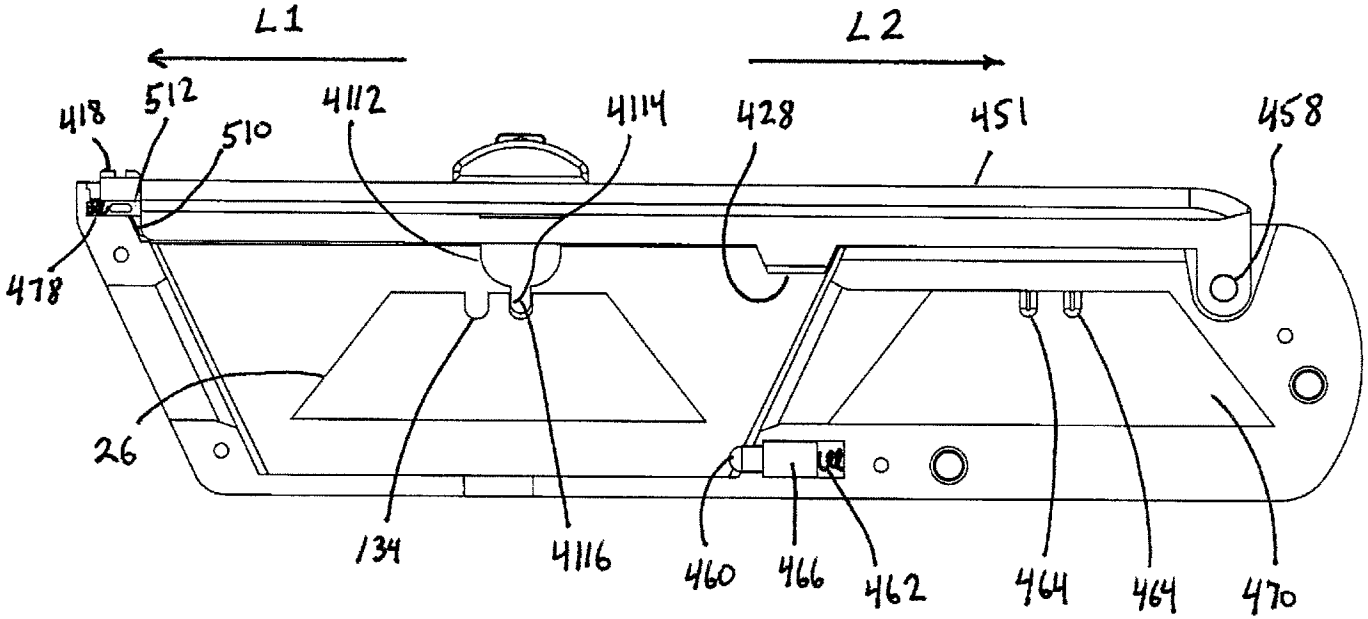

The rotating blade carriage 412 pivots about a housing 411 in the same manner as the previous examples. The rotating blade carriage 412 is optionally locked into position by locking tab 428 as best illustrated in FIG. 50. If the locking of rotating blade carriage 412 is desired, the locking tab 428 can insert into a recess 429 and prevent the rotating blade carriage 412 from rotating during use when the track assembly 450 is in the closed position (FIG. 51). To ensure the track assembly 450 remains in the closed position, a release member 418 locks the track assembly 450 in the closed position. The release member 418 is biased by a spring 478 (FIG. 51) thus retaining the track assembly 450. When the rotating blade carriage 412 requires rotation, the user biases release member 418 against compressing spring 478. This disengages a step 512 from tab 510 allowing the track assembly 450 to pivot in the open positions (FIG. 47). This releases the locking tab 428 and on recess 429 allowing rotation of rotating blade carriage 412. During rotation of rotating blade carriage 412, knife 400 further includes an optional detent 466. The optional detent 466 includes a ball end 460 and a spring 462. This signals the user that the rotating blade carriage 412 is properly engaged in either the first or second position. The track assembly 450 can then be lowered and locked into the closed position for use of knife 400. The track assembly pivots about a hole 458 contained by collinear pins in housing 411 (not shown). The track assembly 450 can translate instead of rotate for the unlocking of rotating blade carriage 412. The track 451 also can be integrating on housing 411 or rotating blade carriage 412 and the unlocking of rotating blade carriage can occur independently of the track 451 and can move in any direction or in any combinations of directions.

When the track assembly 450 is in the closed position, a blade engaging member 4112 engages a blade 26. The blade engaging member 4112 has a tab 4116 with its free end provided with a radius providing a lead in radii 4114 (FIG. 48B) configured to fit within recess 134 of blade 26. This allows the blade 26 to be moved within and out of knife 400 through opening 420 (FIG. 47). The blade 26 can enter multiple advanced positions for performing a cutting action. The blade 26 can then be reversed by rotating blade carriage about housing 411 into the reversed position. Advantageously, blade 26 can be moved toward the rear of the knife 400 along the direction L2 (FIG. 51) to allow used blades to be removed from the rear portion of the knife 400. In this example, used blades are automatically released into a storage compartment 470 so that a plurality of blades can be discarded at the same time.

Figure 52:
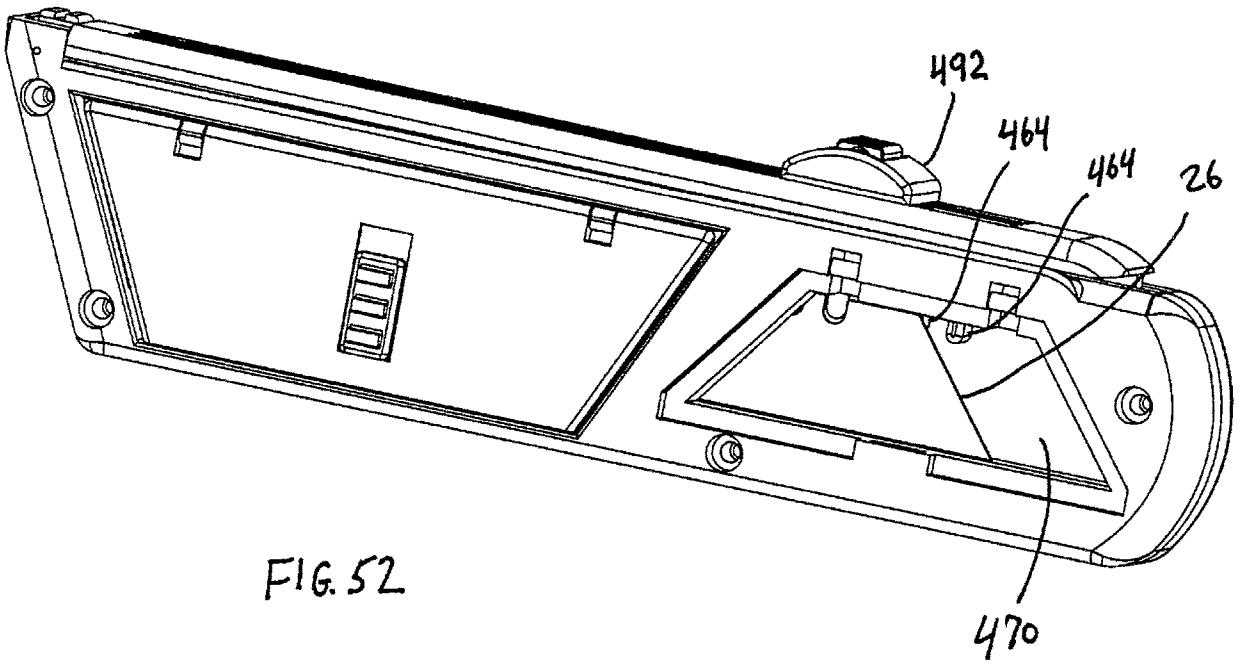
FIGS. 52 to 55 is the knife of FIG. 47 illustrating the transition of the blade being automatically loaded in the storage compartment.
Figure 53:
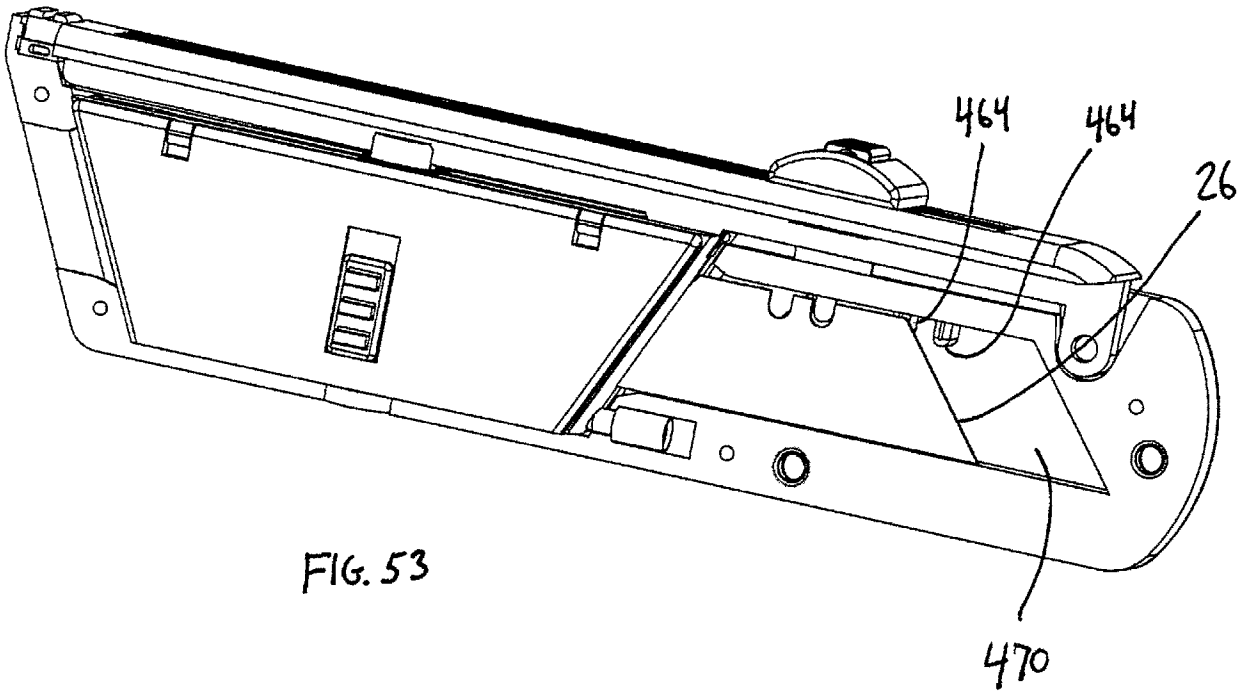
Figure 54:
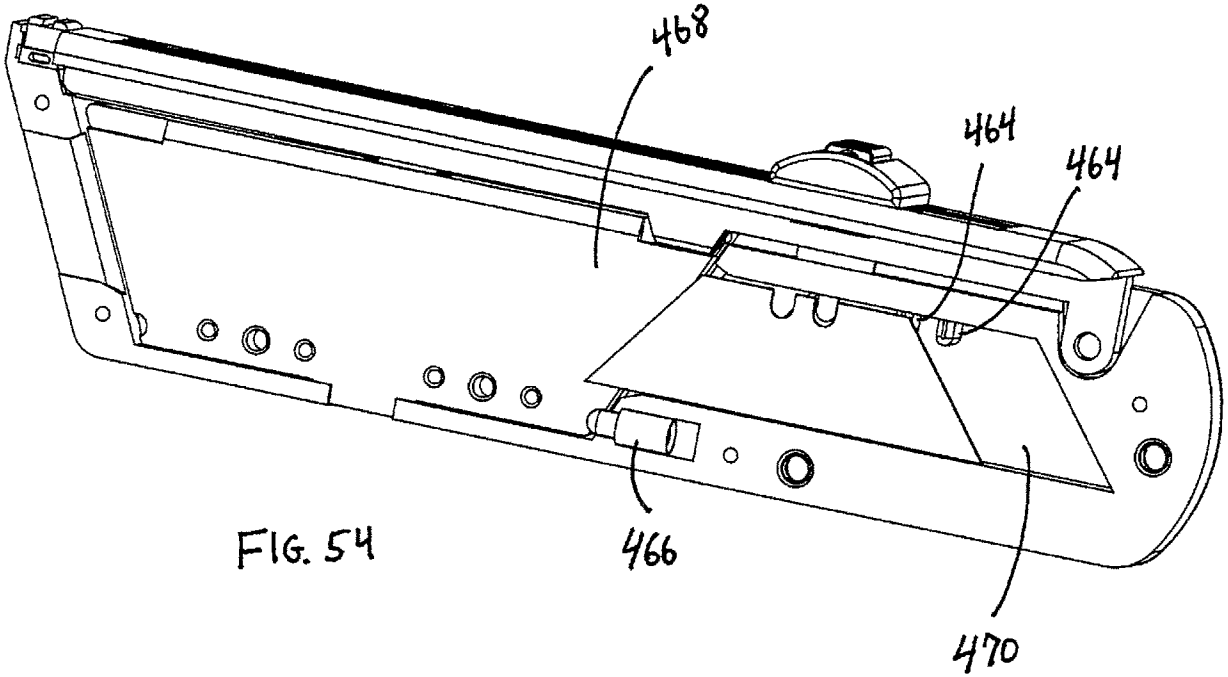

Automatic loading of the blades will now be described by simultaneous reference to FIGS. 52 to 55. FIG. 52 illustrates the transition of blade 26 into storage compartment 470. Engaging member 492 can be moved toward the rear of the knife 400 within track 451. This is made possible by an internal path P (FIG. 55) inside knife 400. This path P guides the blade 26 toward storage compartment 470. Contained in the storage compartment 470 is at least one support pillar 464. As blade 26 enters storage compartment 470, support pillar 464 retains blade 26 along internal path P. Prior to entry into the storage compartment 470, the blade 26 engages a leaf spring 472 and is forced against support pillar 464 and a side portion of internal path P. As best illustrated in FIG. 54, a surface 468 forms a side portion of the internal path P. Blade 26 continues to move toward the storage compartment 470 until the support pillar(s) 464 clears the blade recess 134. At that instant, the leaf spring 472 forces the blade 26 into the storage compartment 470.

The storage compartment 470 is shaped to allow the blade 26 to pass therethrough with a desired clearance. The support pillar 464 can be configured so that the blade 26 falls into the storage compartment 470 at a precise location of blade 26. Depending on the shape and style of the blade 26, there can be one or more support pillars 464 arranged for automatic entry of the blade 26 into the storage compartment 470. After automatic storage of the blade 26, the engaging member 492 can engage a subsequent blade for use. This cycle can then be repeated for subsequent blades. The storage compartment 470 can be modified in shape and size to store (manual or automatic) any style blade.

In this example, the loading of new blades are stored in the rotating blade carriage 412 substantially similar to the previous examples. When these blades are discarded into the storage compartment 470, the door 452 can be opened and the stored blades discarded. The door 452 is retained as explained in the previous examples. As shown in FIG. 47, the door 452 has a door release 454 which engages a door release retention slot 456 similar to the previous examples.

Figure 55:
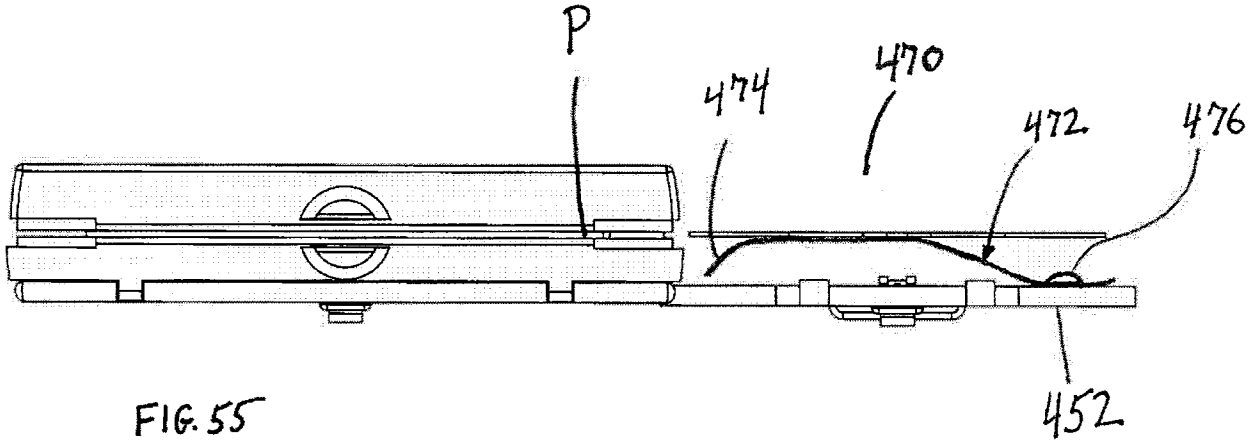
Figure 56:
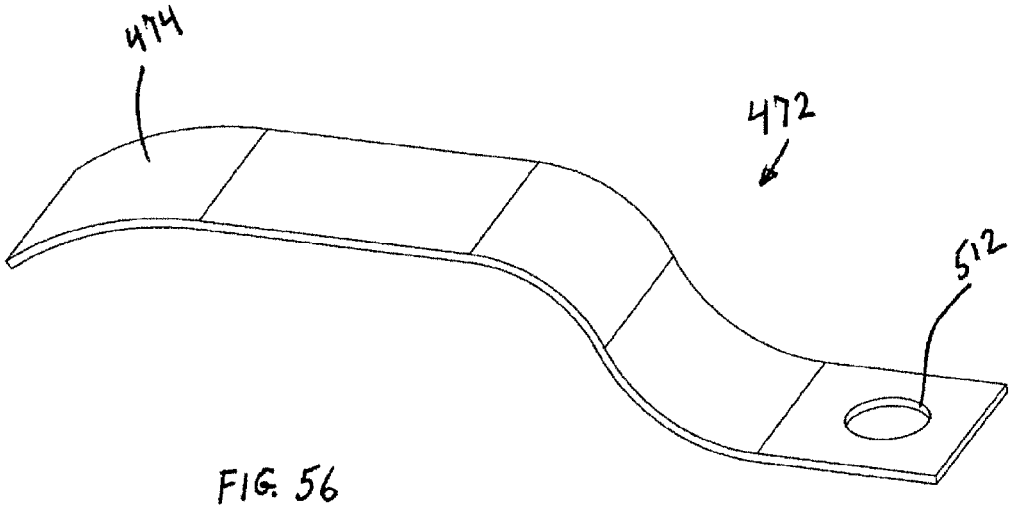
FIG. 56 is an isometric view of an alternate style of the spring component included in FIG. 55.

Referring to FIGS. 55 and 56, the leaf spring 472 will be described in further detail. In this example, the leaf spring 472 is affixed to the door 452 via post 476. When door 452 is in the closed position as illustrated in FIG. 55, leading edge 474 is positioned along the internal path P. This allows automatic deflection of the leaf spring 472. There are many alternate options or substitutions for the leaf spring 472 including, and not limited to, spring loaded arms, cam surfaces, spring loaded guide assemblies, coil springs, magnets, and others. Additionally, these are the alternate attachment styles for affixing the leaf spring 472 to door 452 including, and not limited to, adhesives, welding, heat staking, screwing, and others. The leaf spring 472 can also be affixed to alternate portions of the knife 400 such that the leading edge 474 is substantially aligned to path P. The leaf spring 472 includes an attachment feature 512 for connection to post 476.

Figure 57:
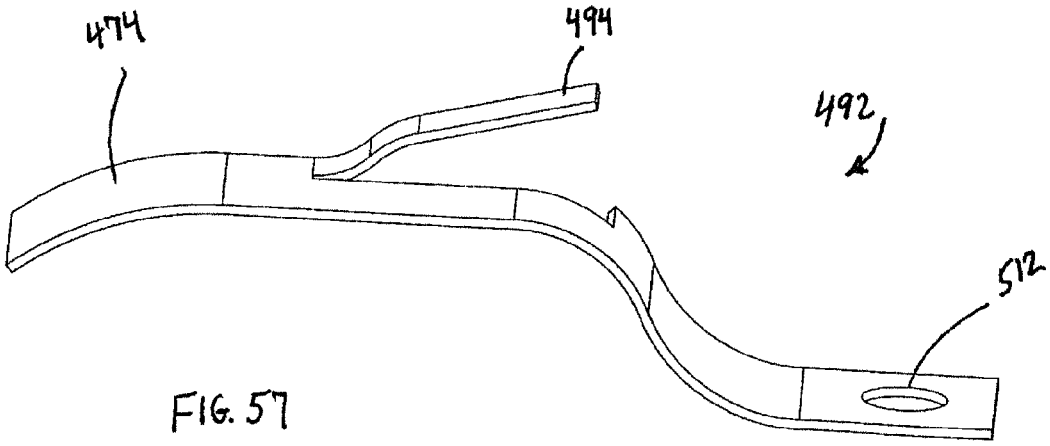
FIG. 57 is an isometric view of an alternate style of the spring component of FIG. 56.

Referring to FIG. 57, an alternate form of a leaf spring 492 is shown. In this example, the leaf spring 492 further includes a tab 494. This tab 494 is sized and configured to provide less stiffness than the general stiffness of the leaf spring 492. This allows the tab 494 to provide a force to the plurality of blades 26 when there exists at least one blade 26 in the storage compartment 470. The tab 494 will provide stability and prevent unwanted movement of blades contained in storage compartment 470 during the flexing or biasing of the leaf spring 492. The tab 494 is one of many possible examples that can be employed to prevent unwanted movement of stored blade(s) during transition of subsequent blades into the storage compartment 470.

Figure 58:
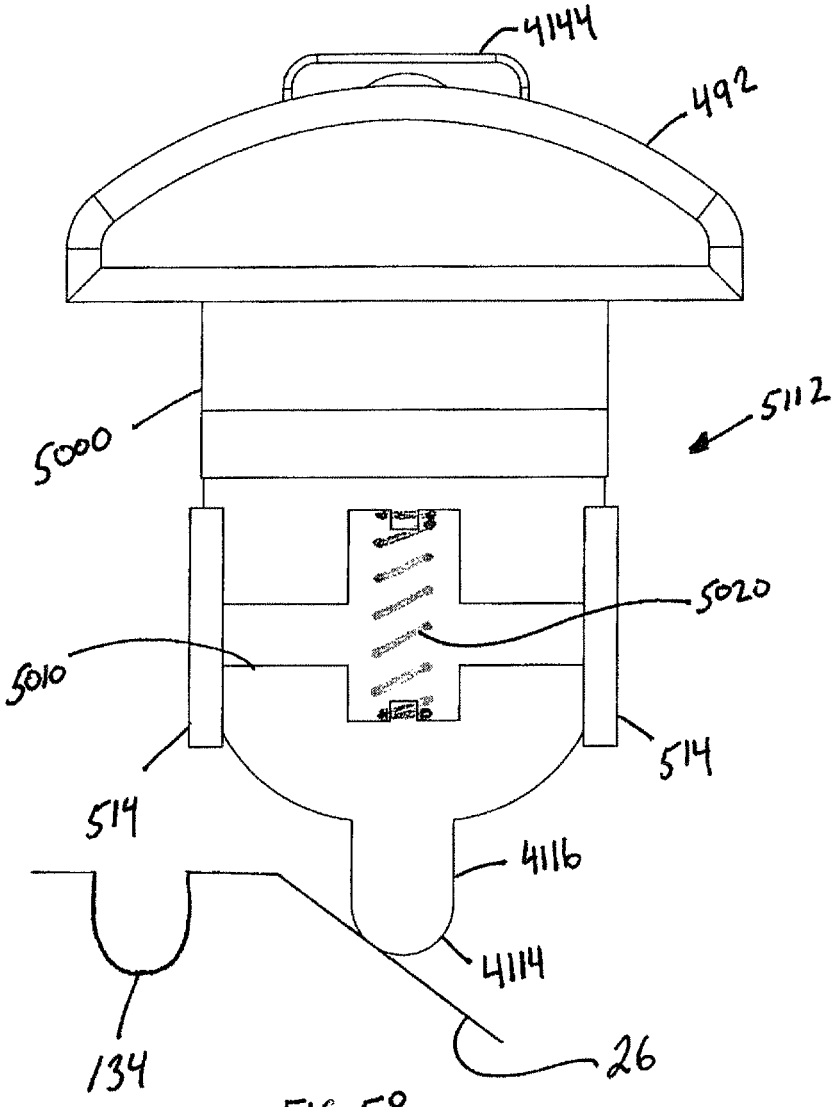
FIGS. 58 and 59 illustrate alternate embodiments for automatic engagement of the blade for the knife of FIG. 47.
Figure 59:
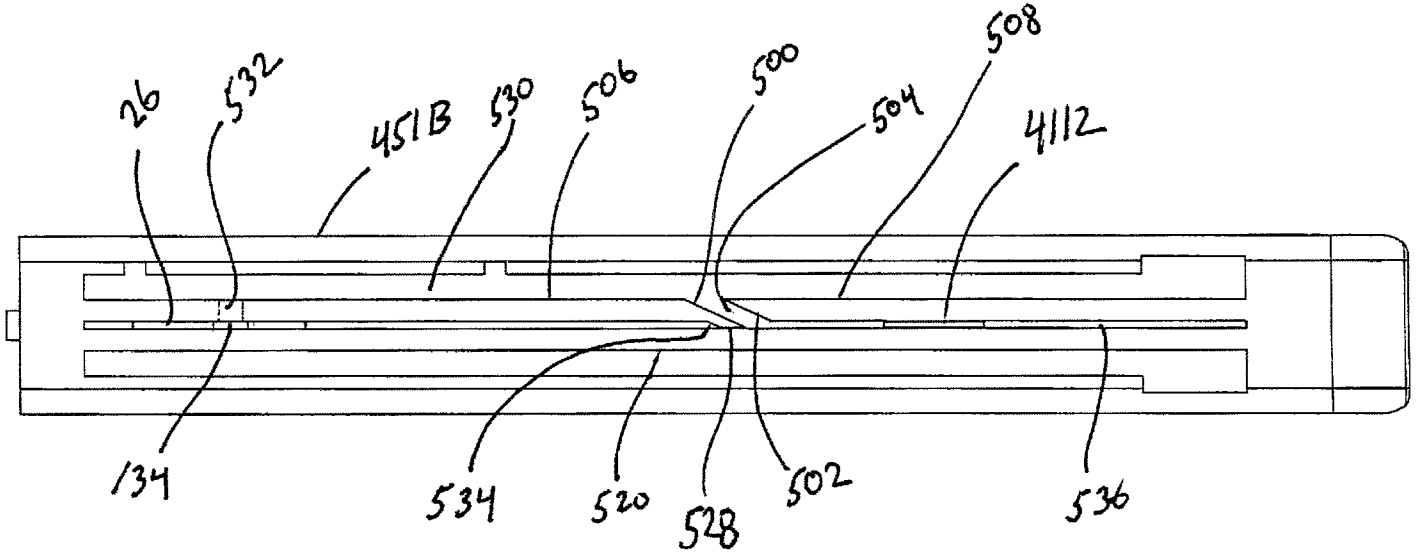
Figure 60:
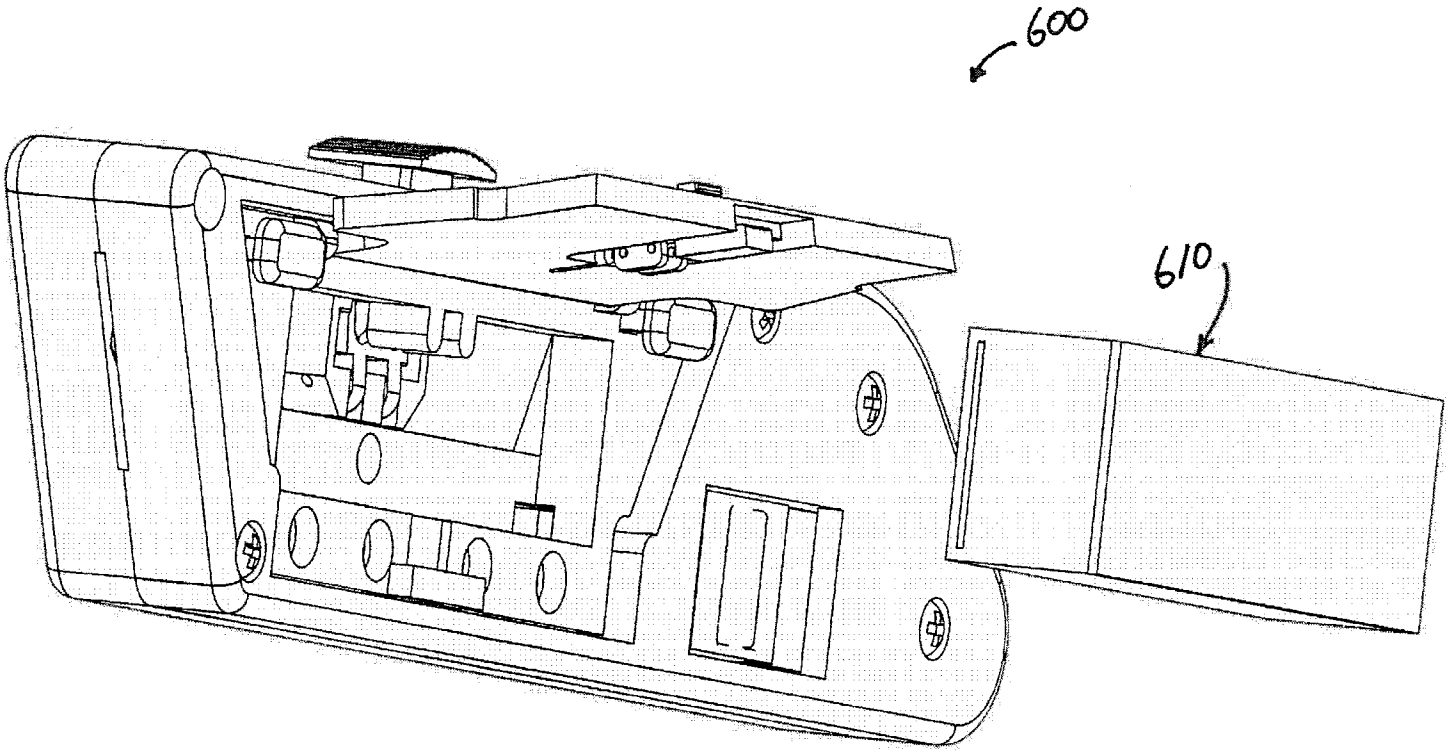
FIGS. 60 and 61 illustrate a fifth exemplary embodiment of a knife according to the present disclosure.

When blades are loaded into storage compartment 470, new blades are then engaged for use. In the previous example, the knife 400 requires the unlocking and rotation of the track assembly 450 for the engagement of subsequent blades. FIGS. 58 to 60 provide two examples of automatic engagement of subsequent blades.

FIG. 58 shows an alternate style for an engaging member. Blade engaging member 5112 is configured to bias when engaging member 492 is moved along track 451 toward a subsequent blade 26 contained in the rotating blade carriage 412. The lead in radii 4114 contacts the top angled portion of the blade 26 as illustrated and allows lower portion 5010 of the blade engaging member 5112 to bias compression spring 5020. As the engaging member 5112 continues to move, the tab 4116 will automatically engage the recess 134 on blade 26. This is made possible by the return force of the spring 5020. One or more support rails 514 supports lower portion 5010 during movement. The blade 26 can then be used and the cycle can be repeated for use and removal after use. Other embodiments can be applied to automatically engage the tab 4116 into the recess 134 of the blade 26 from the top side of blade 26.

FIG. 59 shows another example of automatic engagement of the blade engaging member 4112 with recess 134 of the blade 26. In this example, track 451B has a first rail 406, a second rail 508, and a third rail 520. The first and second rails 506/508 form opening 504 and are supported on opposite ends thereof. The first rail 506 has a cam surface 500 formed on one side of opening 504. The cam surface 500 terminates at end 528 which is proximate to the third rail 520. The end 528 is not affixed to the third rail 520 but lies very close or can maintain contact with the third rail 520. Therefore, first and second rails 506/508 can move away from third rail 520. This is made possible by selecting a material for track 451 B that can flex such as plastic, among others. If a rigid material is preferred, the first and second rails 506/508 can be hingedly supported opposite the opening 504 and configured to spring away from third rail 520 from the positions as illustrated. When a portion of the blade engaging member 4112 engages opening 504 during movement towards blade 26, cam surface 500 forces blade engaging member 4112 into opening 530 causing the blade engaging member to flex away and move along the side of blade 26 within opening 530. Blade engaging member 4112 can then continue to move until blade engaging member reaches gap 532. Gap 532 is substantially aligned with the recess 134 so that the blade engaging member 4112 will automatically engage the blade 26 from the side. When blade removal is desired, the blade engaging member 4112 can be moved toward the rear of knife 400 and during this movement, the portion of blade engaging member 4112 will contact a cam surface 534. This will flex first rail 506 thus keeping the blade engaging member 4112 in opening 536 where blade 26 can be removed from knife 400 or can be automatically loaded into a storage compartment as described earlier. This process can be repeated for using subsequent blades as previously described. Other structures or components can move blade engaging member 4112 to the side of blade 26 for automatic engagement into recess 134.

Figure 61:
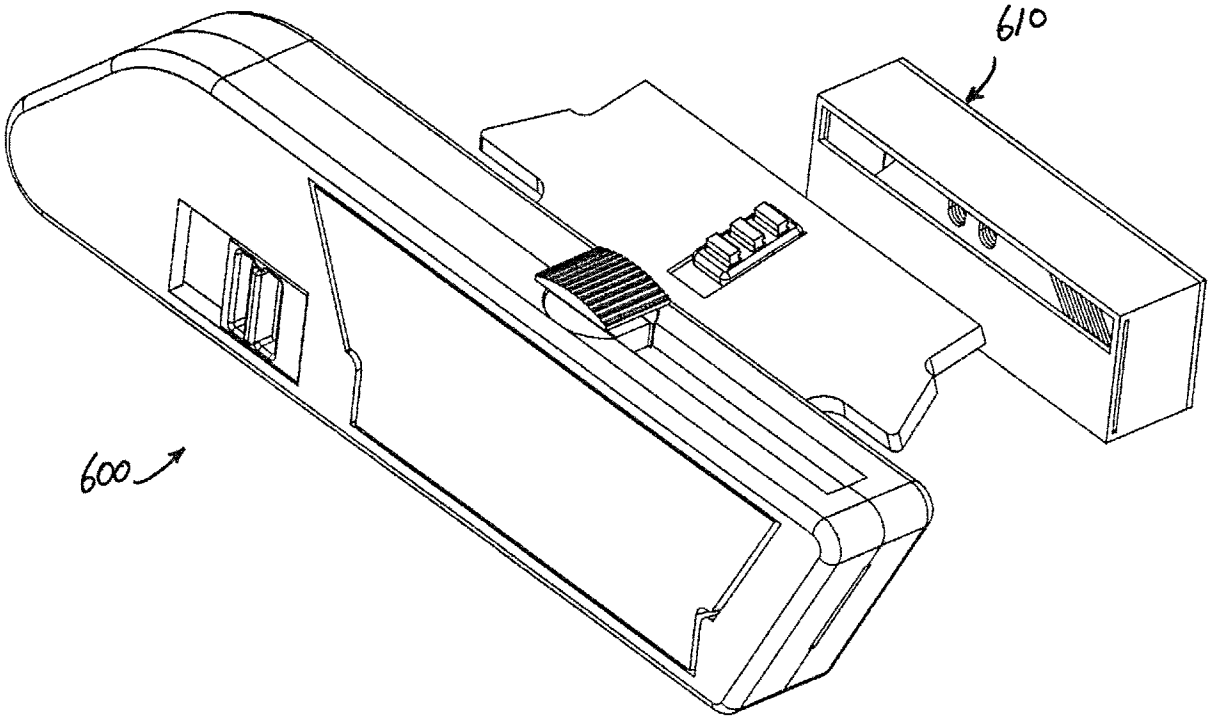

Referring now to FIGS. 60 and 61, a knife according to a fifth exemplary embodiment of the present disclosure is shown having reference numeral 600. Knife 600 is substantially similar to the previous embodiments and is configured to allow removable a blade cartridge 610 to be loaded therein. The blade cartridge 610 is configured to store a plurality of blades so that when the cartridge 610 is loaded into knife 600, the user can advance, retract, reverse, remove, and reload the blade similar to the aforementioned embodiments.

Figure 62:
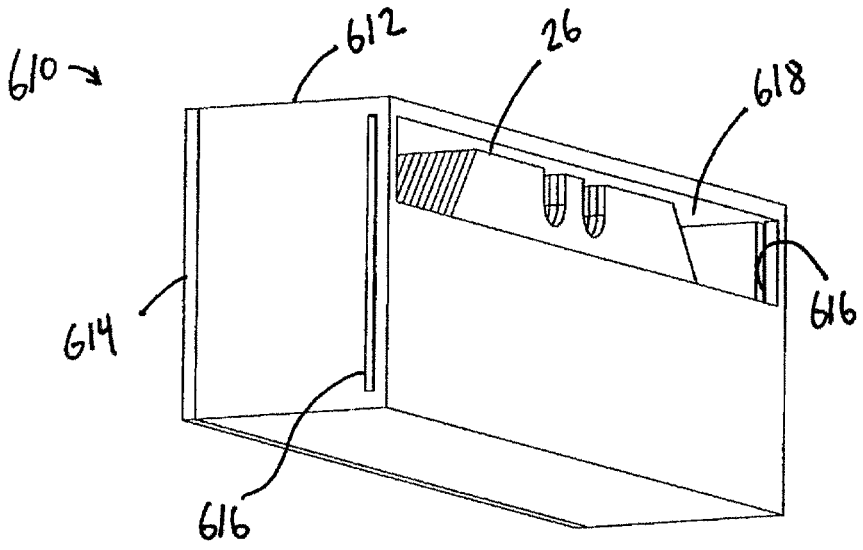
FIGS. 62 and 63 illustrate a removable blade cartridge as shown in FIGS. 60 and 61.
Figure 63:
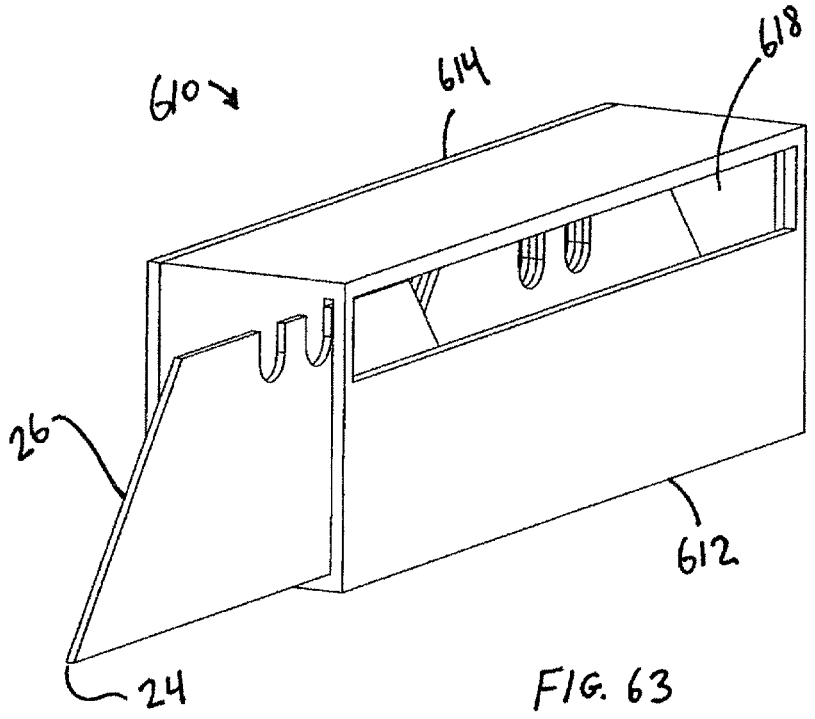
Figure 64:
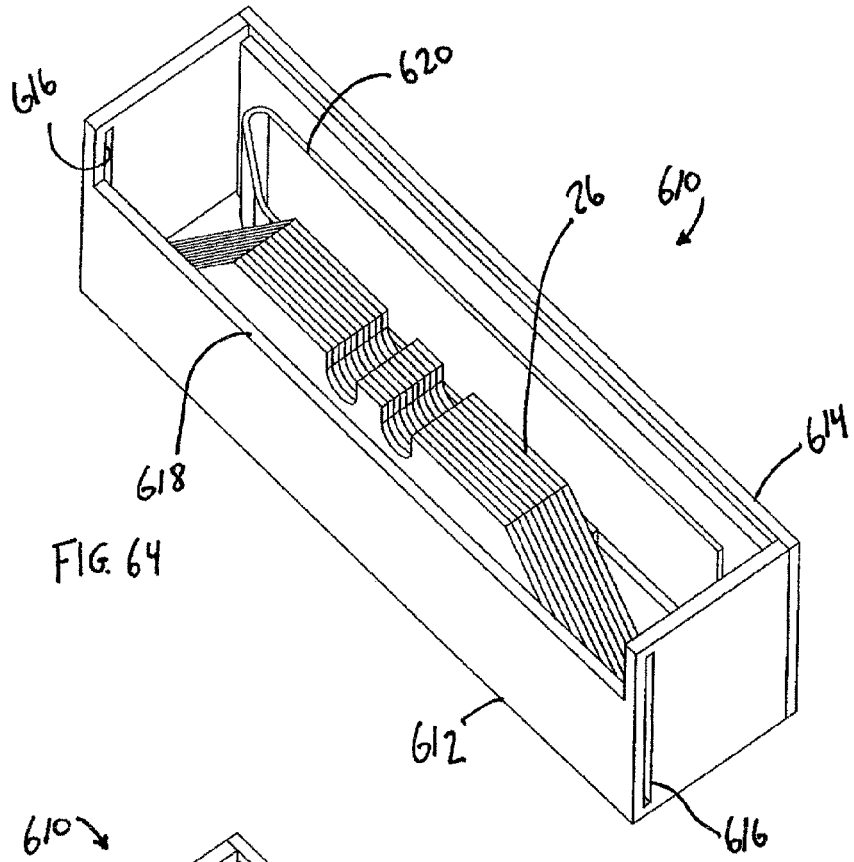
FIGS. 64 and 65 illustrate the blade cartridge of FIGS. 62 and 63 with a portion removed for the purposes of clarity.
Figure 65:
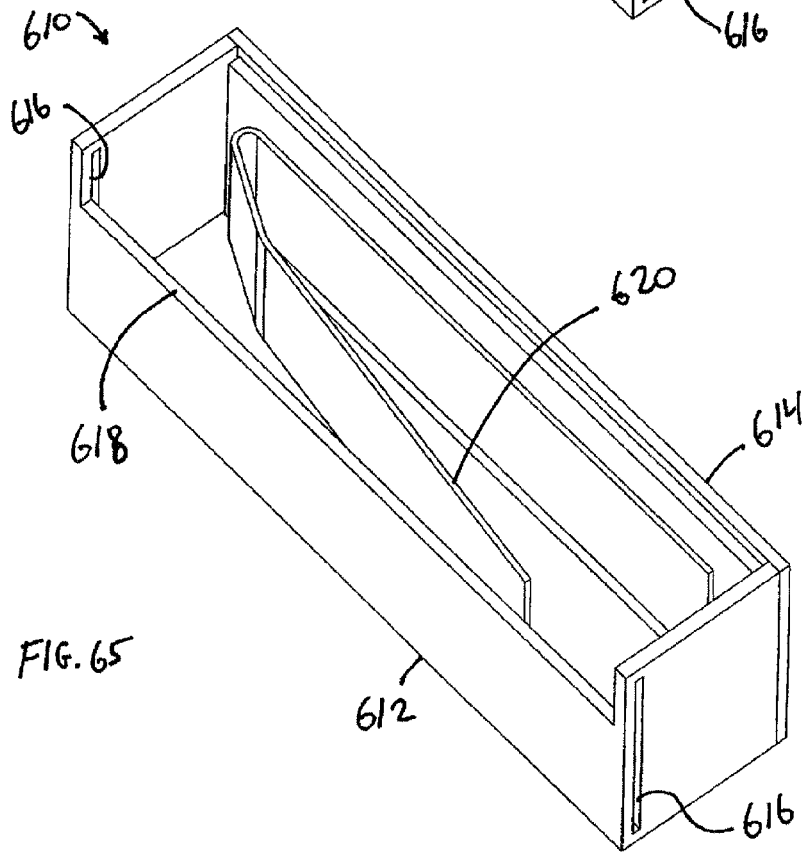

By simultaneous reference to FIGS. 62 and 63, the blade carriage 610 includes a housing 612 and an end cap 614. The housing 612 includes a window 618 so that blade 26 can be engaged along the side thereof by an engaging member as previously described in exemplary embodiments 10, 210, 310, and variations thereof. For the advancement of the blade 26, the housing 612 further includes opposing cutouts 616 to allow blade 26 to extend therethrough (FIG. 63). For automatic loading of subsequent blades, the blade cartridge 610 can include the resilient member 620 FIGS. 64 and 65). In this example the resilient member 620 is a leaf spring. Various substitutions can be made for the resilient member 620 including, and not limit to, coil springs, elastomers, and others. Also, the resilient member 620 can be integrated in knife 600 (as illustrated in the previous embodiments) through an opening in blade cartridge 610 (not shown). This would allow the resilient member to pass through the end cap 614 and contact the plurality of blades for automatic loading of subsequent blades.

In the example provided, the end cap 614 is fabricated out of plastic and permanently affixed to the housing 612. This can be accomplished by ultrasonic welding or by the use of an adhesive. Therefore, blade cartridge 610 would be disposable in this example. When the blade cartridge 610 is purchased, the plurality of blades 26 are preloaded by the manufacturer. The user can then discard blade cartridge 610 when empty. The components of blade cartridge 610 can be fabricated out of numerous suitable materials.

In another example, the blade cartridge 610 can be reusable. In this example, the end cap 614 can be selectively removable from housing 612. There are many possible configurations to selectively remove the end cap 614 from housing 612 including, and not limited to, snap fits, mechanical fasteners such as a screw, quarter turn fasteners, and others. In this example, end cap 614 is removed so that the user can load a plurality of blade therein. End cap 614 can then be reattached for use.

Figure 66:
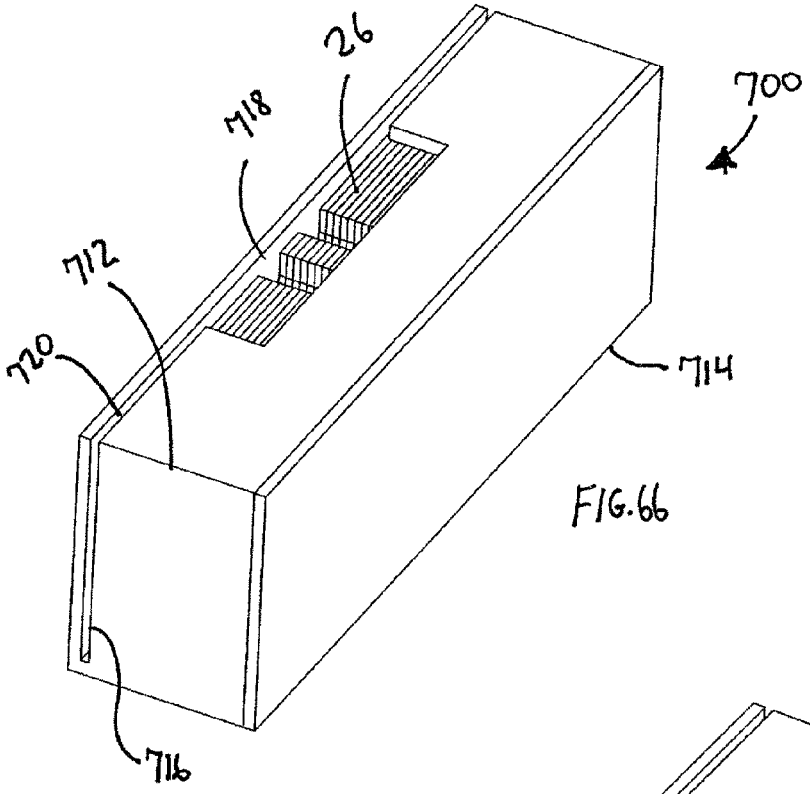
FIGS. 66 and 67 illustrate another example of a removable blade cartridge.
Figure 67:
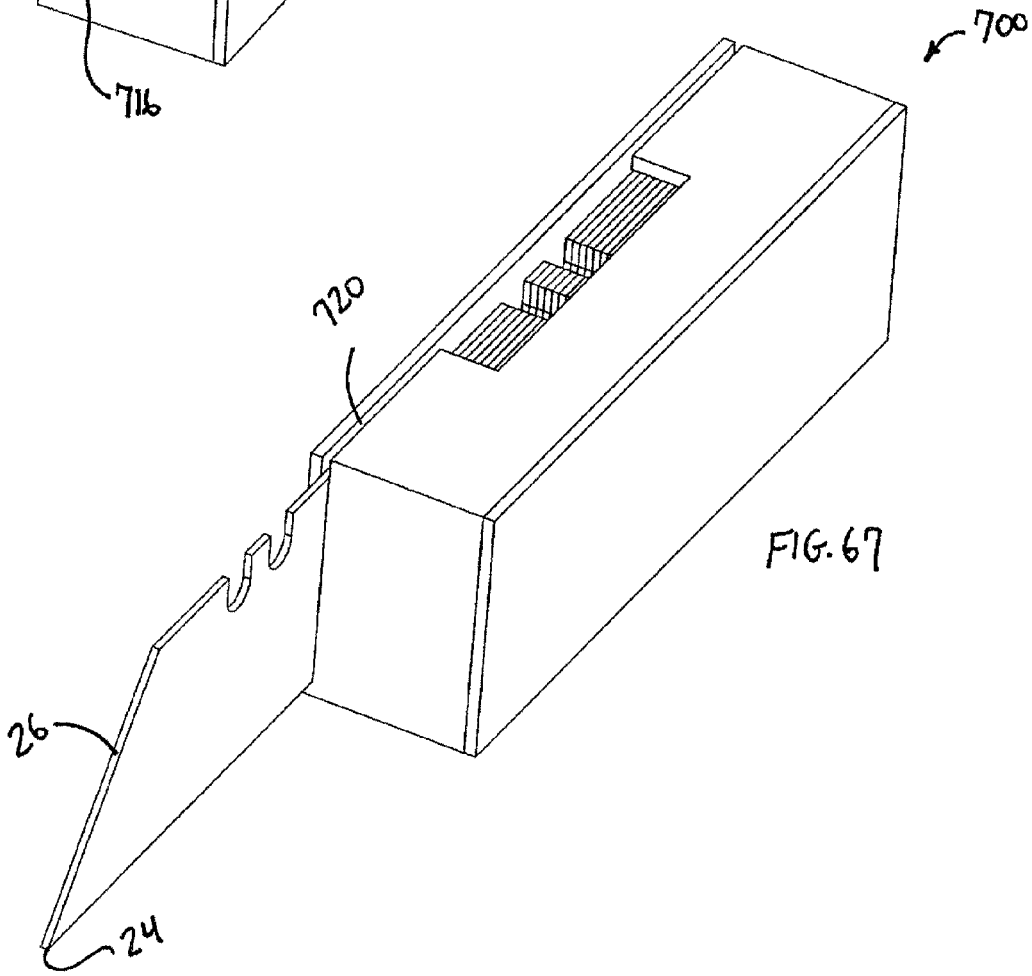
Figure 68:
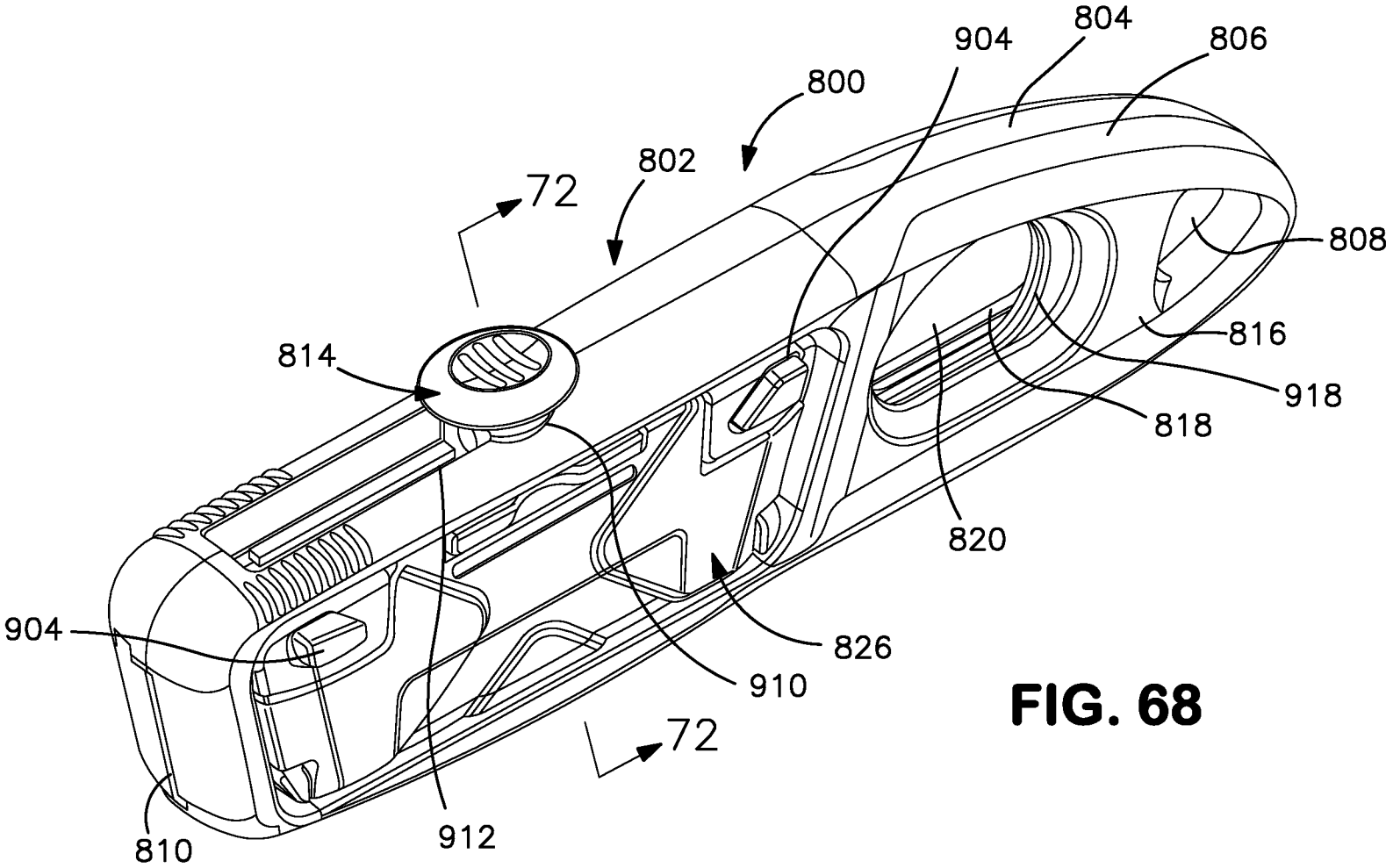
FIG. 68 is a perspective view of another embodiment of a knife according to the present disclosure with the rotating blade carrier in the first position and the cutting blade in the retracted position.

FIGS. 66 and 67 show an alternate example of a blade cartridge 700. The blade cartridge 700 is substantially similar to the blade cartridge 610 except that blade cartridge is configured so that engagement of blade 26 occurs from the top through a top opening 718. This configuration allows the use of blade cartridge 700 in the embodiment 400 of FIG. 47 as well as variations thereof.

FIGS. 68-80 show another embodiment of a knife according to the present disclosure. According to these Figures, a knife 800 includes a housing 802 comprising a first frame member 804 and a second frame member 806. The frame members 804 and 806 may be separate members molded from a suitable plastic and secured together by a suitable adhesive or other means, or the housing 802 may be molded as a single unit whereby the two frame members 804 and 806 are integral. The housing has an opening 808 extending there through as shown.

Figure 69:
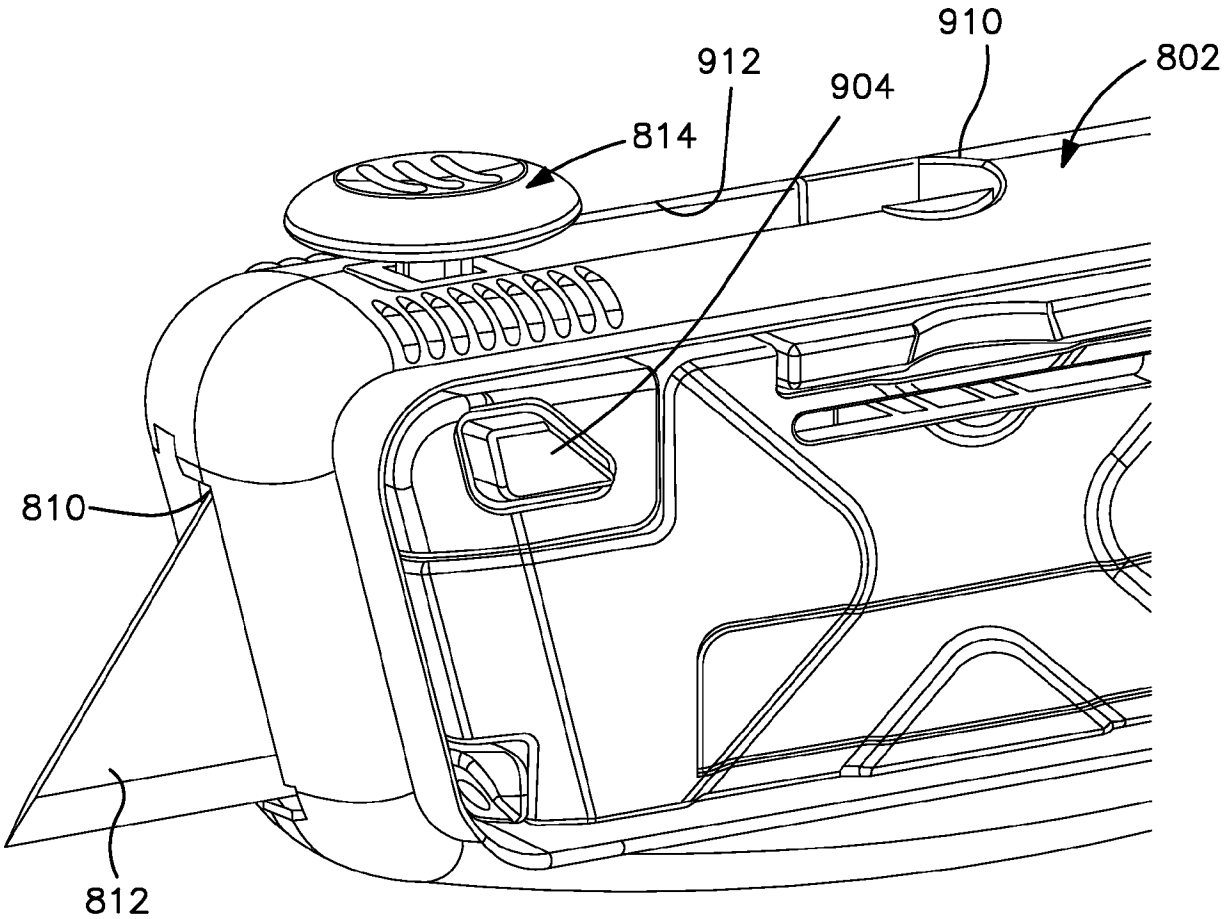
FIG. 69 is a partial perspective view of the forward end of the knife of FIG. 68 showing the blade in the exposed position.

The forward end of the housing 802 is provided with a blade opening 810. The blade opening 810 permits movement of a blade 812 into the forward cutting position with the blade 812 exposed for cutting when a thumb button 814 is moved to its forward position as shown in FIG. 69.

Figure 70:
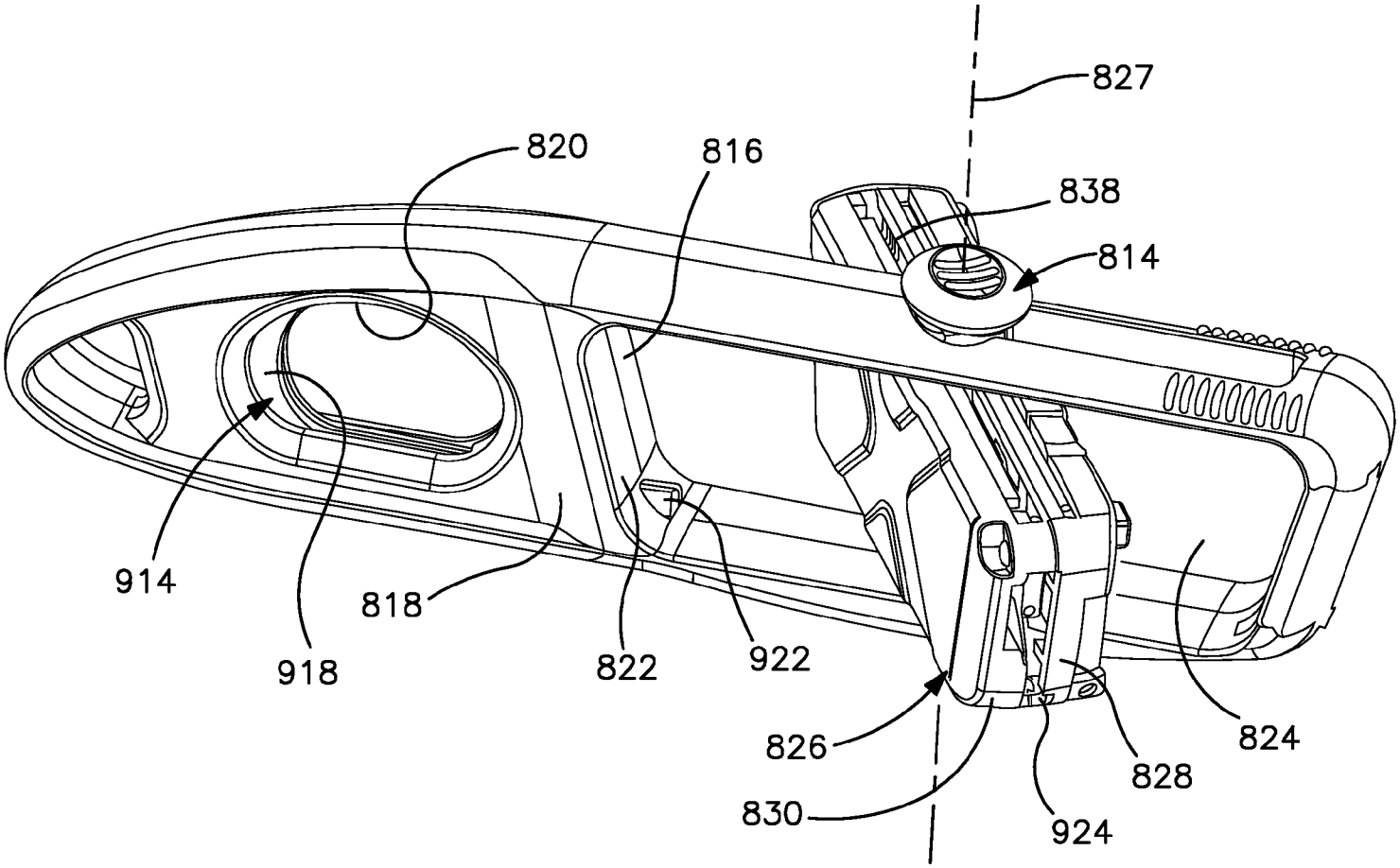
FIG. 70 is a perspective view of the knife of FIG. 68 showing the carriage in a partial retracted position.

Two opposed spaced panel members 816 and 818 are mounted in the opening 808 at the rearward end of the housing 802. These may be separate elements from the housing itself. The panel members 816 and 818 have a through opening 820 forming a finger opening and have a forward end portion forming a partition 822 in the housing 802 which separates the opening 808 into a forward portion positioned in the forward portion of the housing 802 and separated from the rear of the housing 802 as shown. The opening 824 in the forward portion of the housing receives a rotatable blade carriage 826 for rotation about an axis 827 as shown in FIG. 70.

Figure 79:
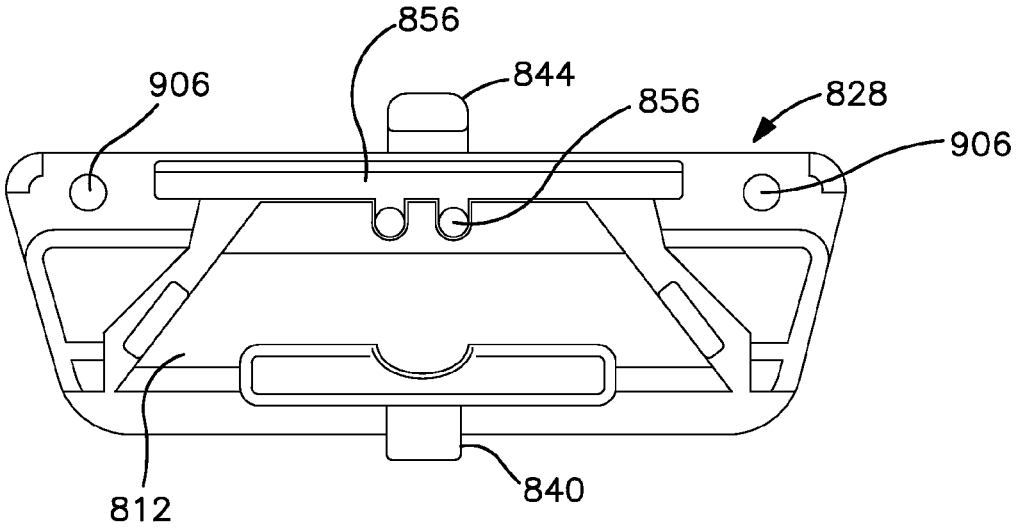
FIG. 79 is a sectional view of the interior of one of the housing members of the blade carriage.
Figure 80:
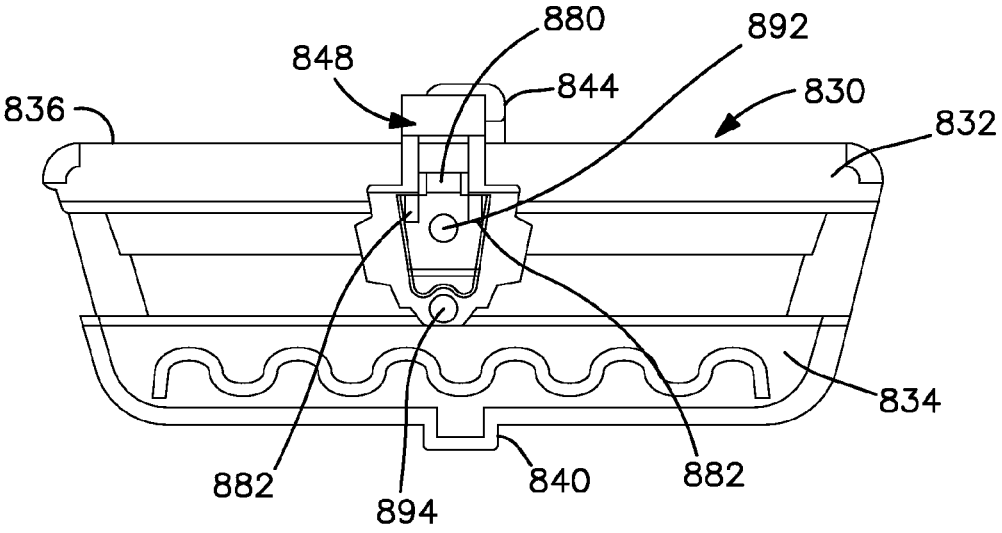
FIG. 80 is a sectional view of the interior of the other housing member of the blade carriage.
Figure 72:
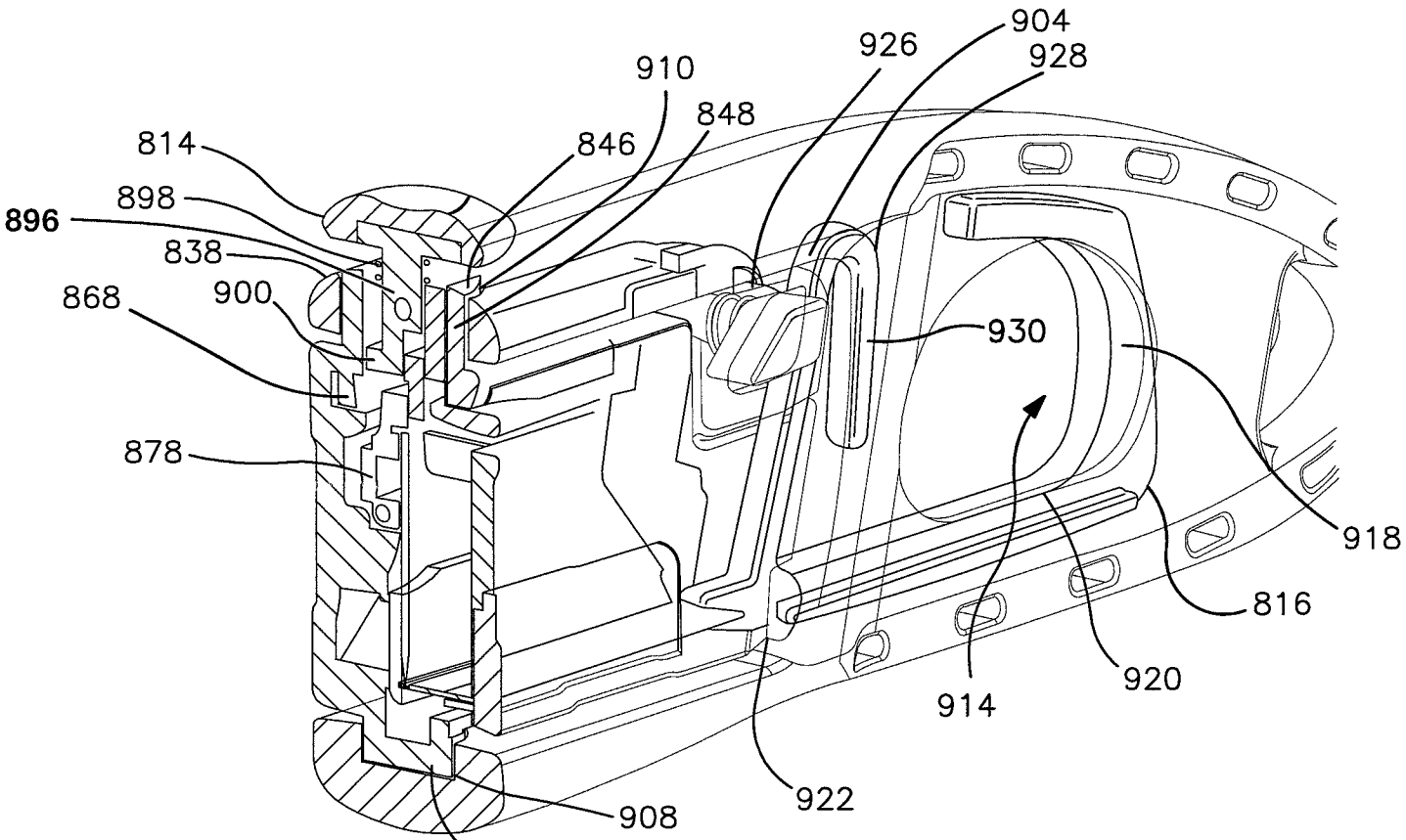
Figure 73:
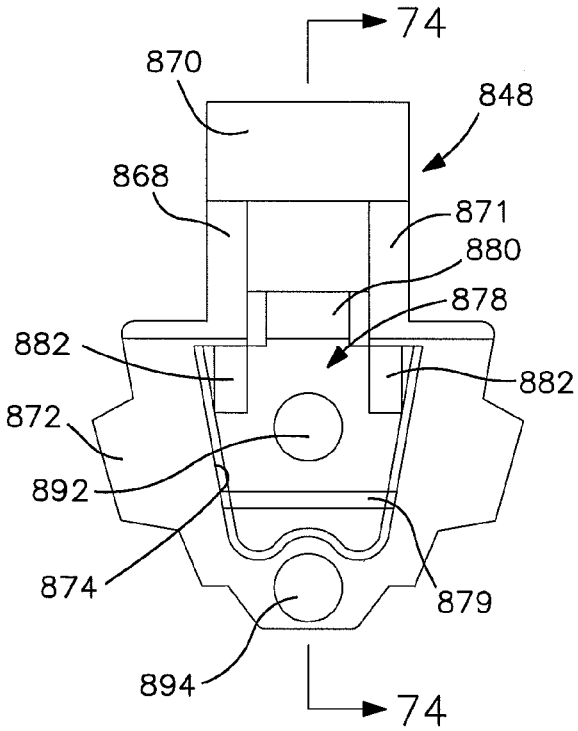
Figure 74:
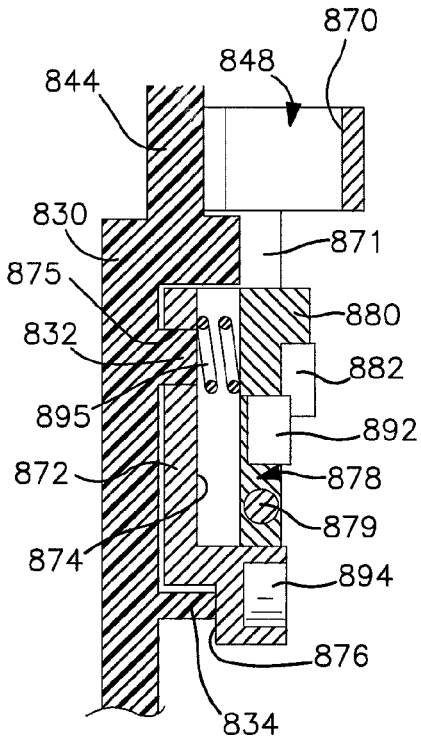
Figure 77:
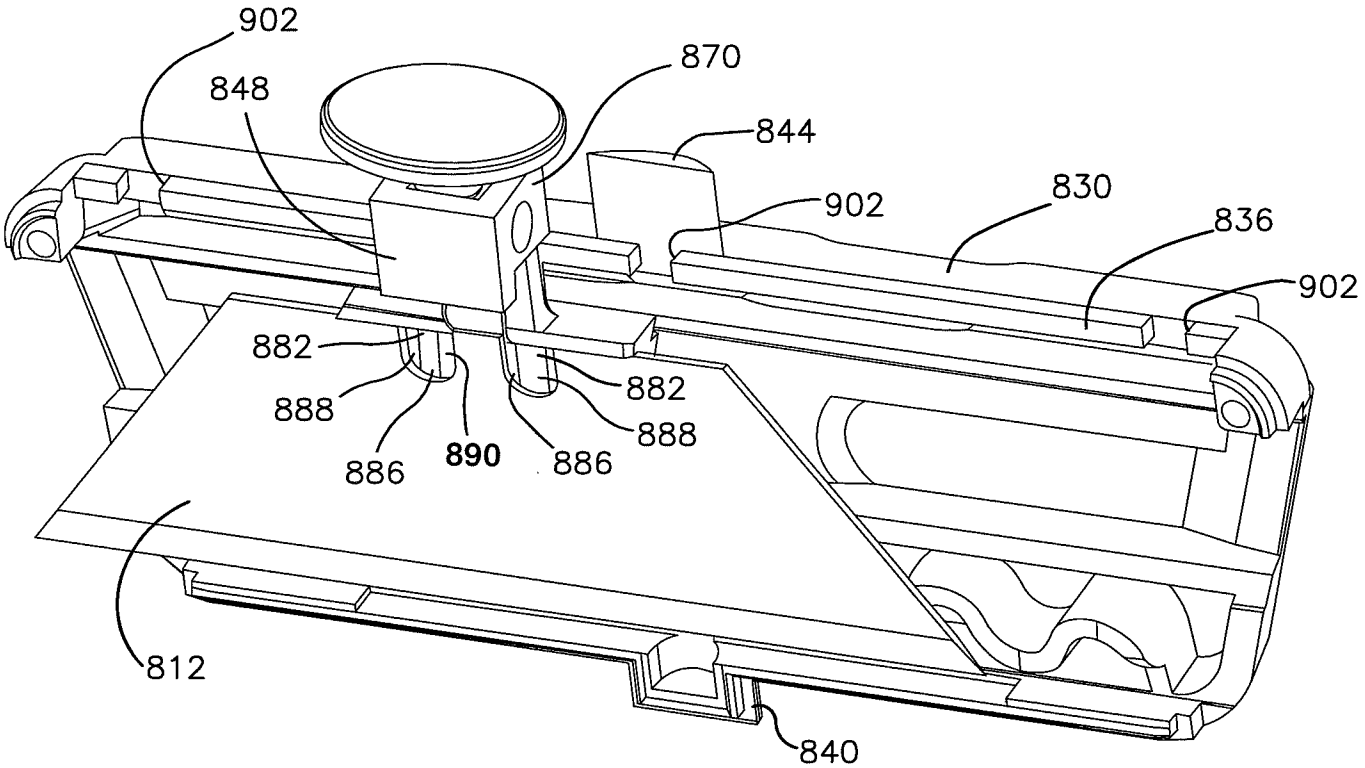
Figure 78:
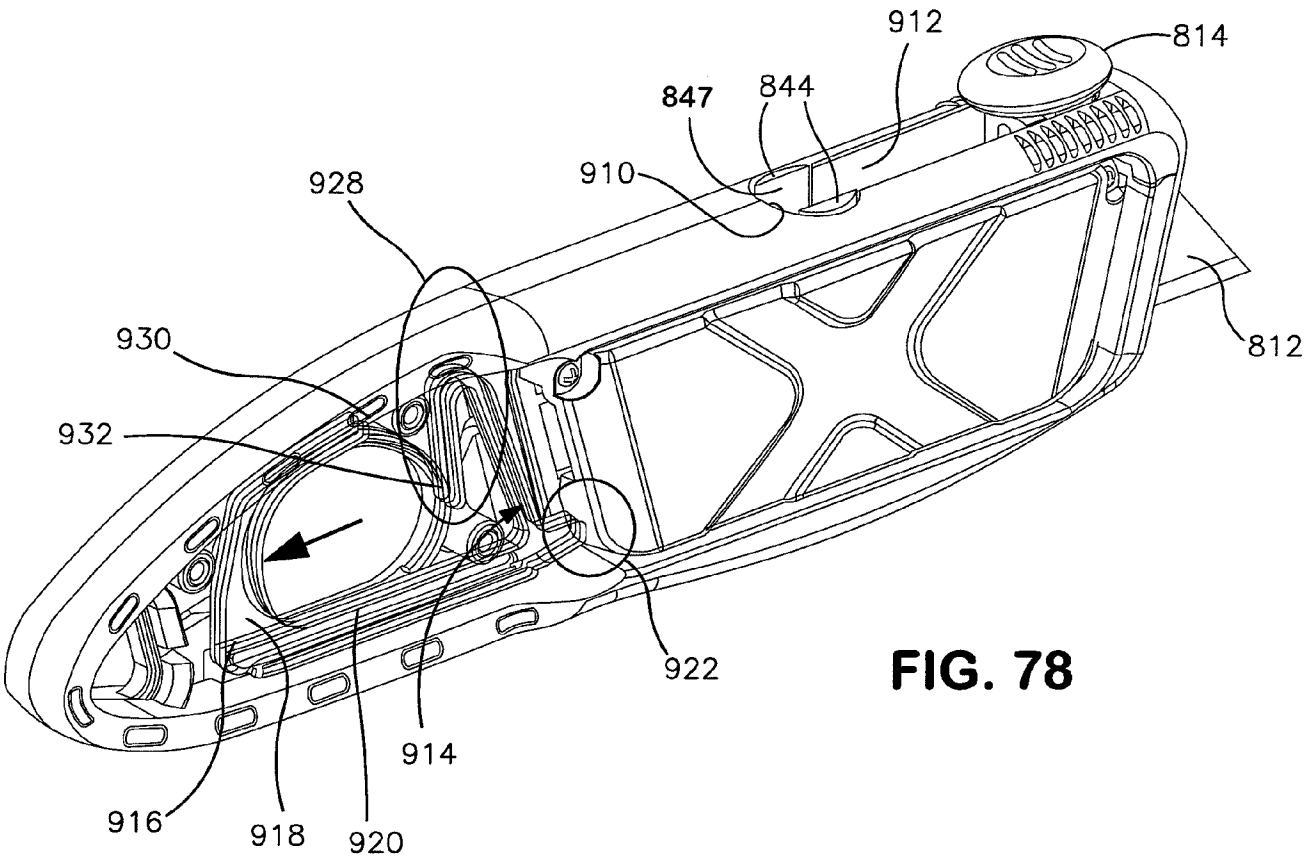
Figure 79:
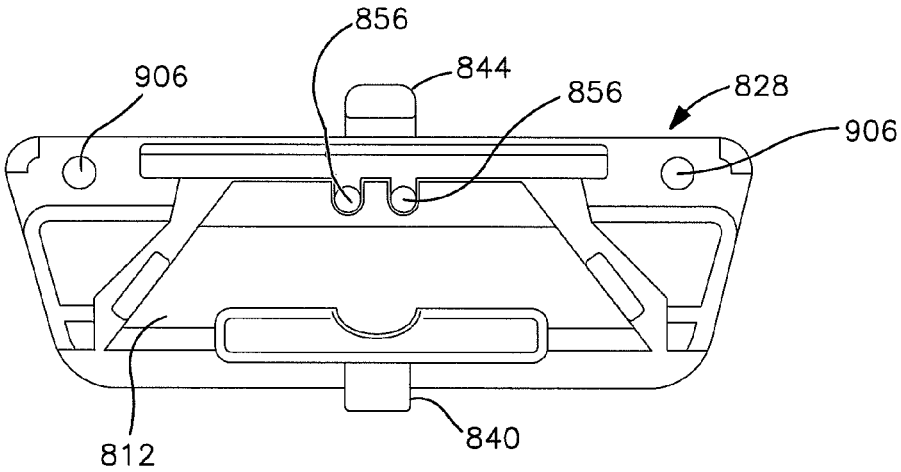
Figure 80:
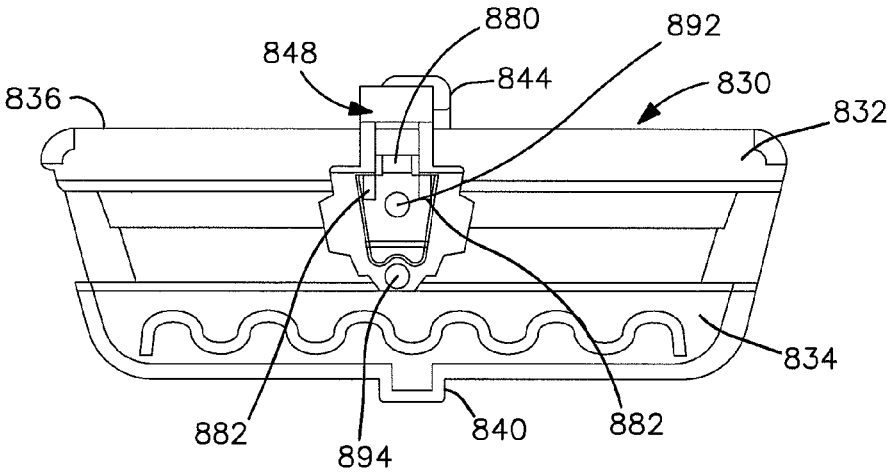

As shown in FIGS. 79 and 80, the blade carriage 826 includes a first housing member 828 and a second housing member 830. The two housing members 828 and 830 are joined together at their periphery by an adhesive, welding, or the like to form a single unit with a hollow interior. The interior wall of the second housing member 830 includes an upper rail 832 extending the length thereof and a lower rail 834 also extending the length of the cartridge. The inner edge of the portion of the second housing member 830 has a cutout 836 that extends along the top inner edge to a point short of either end of the member 830 that forms a slot 838 in the top of the blade carriage 826 when the two members 828 and 830 are joined together.

A projection 840 having a semi-circular outer surface extends downwardly from the bottom surface of each of the housing members 828 and 830. These projections form a circular post 842 when the two members 828 and 830 are joined together. A projection 844 extends upwardly from the outer surface of each of the housing members 828 and 830 and has an outer arcuate surface. The two projections 844 are spaced apart from each other when the two members 828 and 830 are joined together to form a post 846 having a slot 847 there through to allow for the passage of the upper portion of a blade carrier 848.

Figure 71:
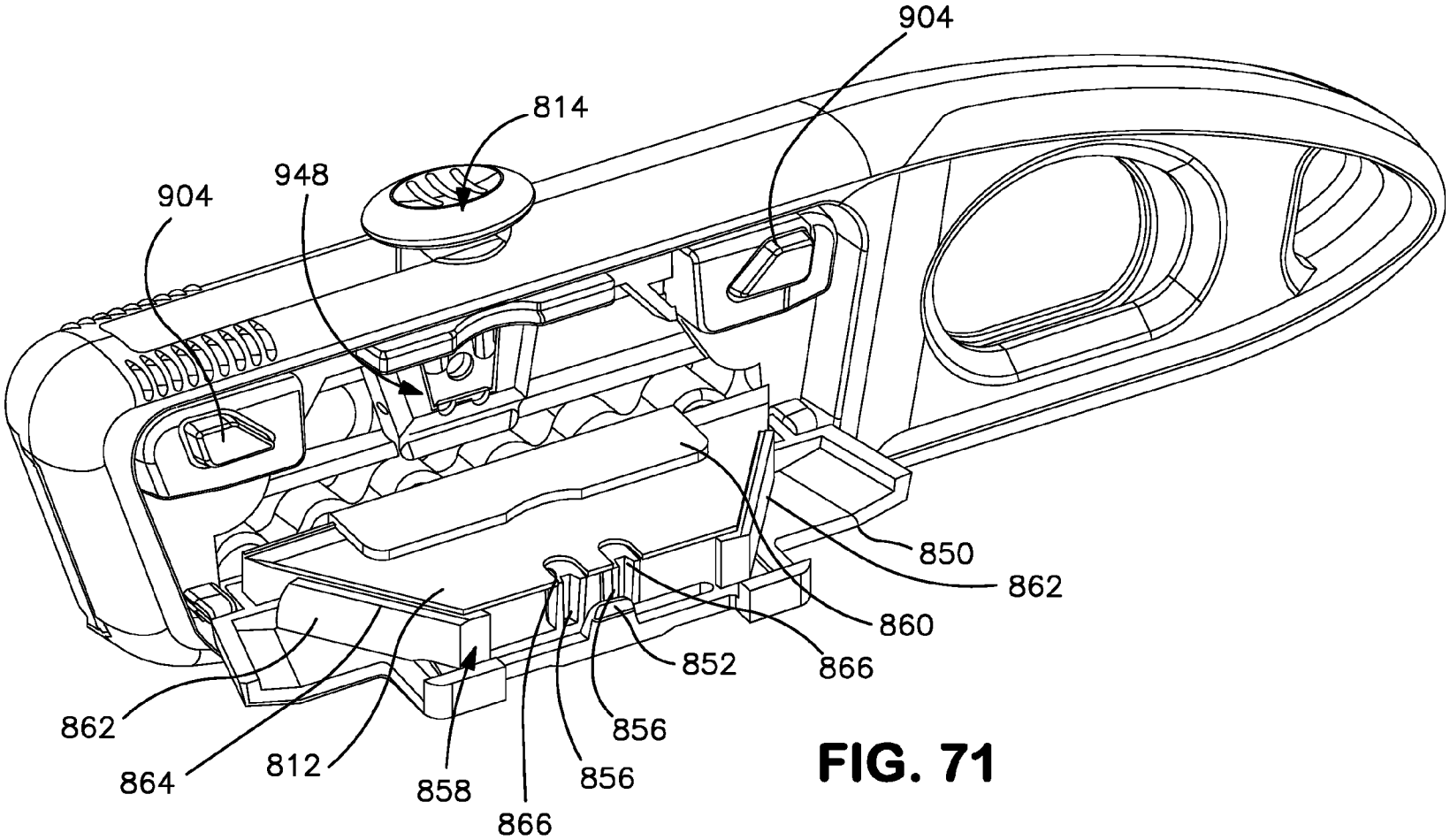
FIG. 71 is a perspective side view of the knife of FIG. 68 showing a carriage door in an open position and a cartridge containing a cutting blade inserted into the opening.
Figure 72:
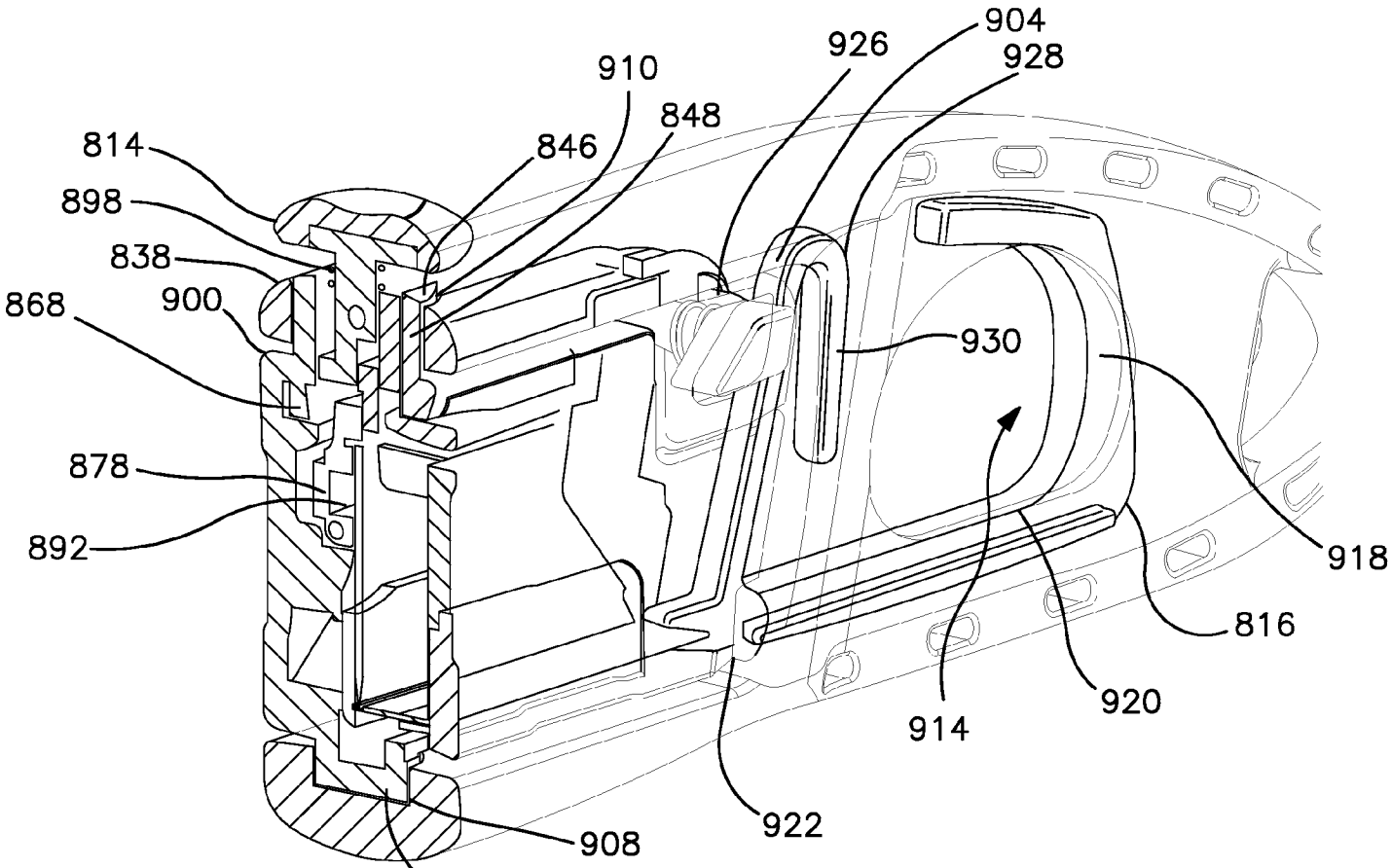
FIG. 72 is a partial sectional view in perspective of the knife taken along the lines 72-72 of FIG. 68.
Figure 73:
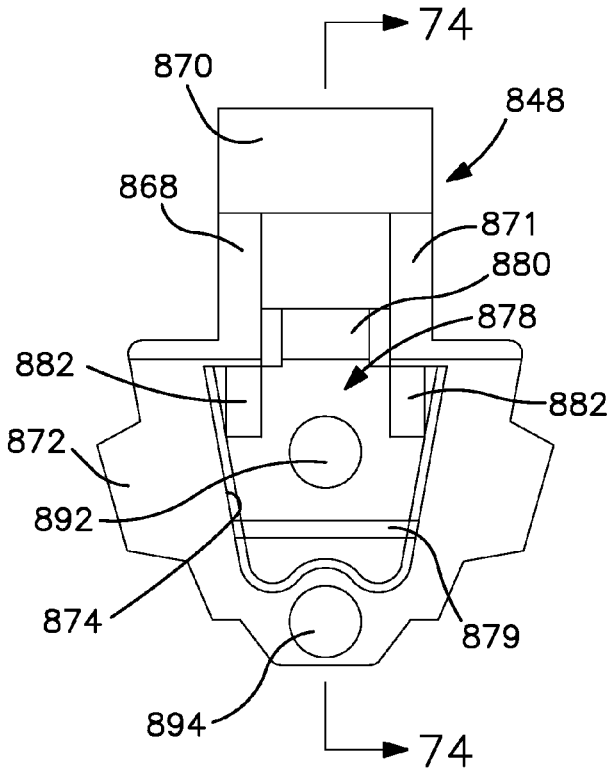
FIG. 73 is an enlarged side view of the blade carrier viewing the side that faces the blade.
Figure 74:
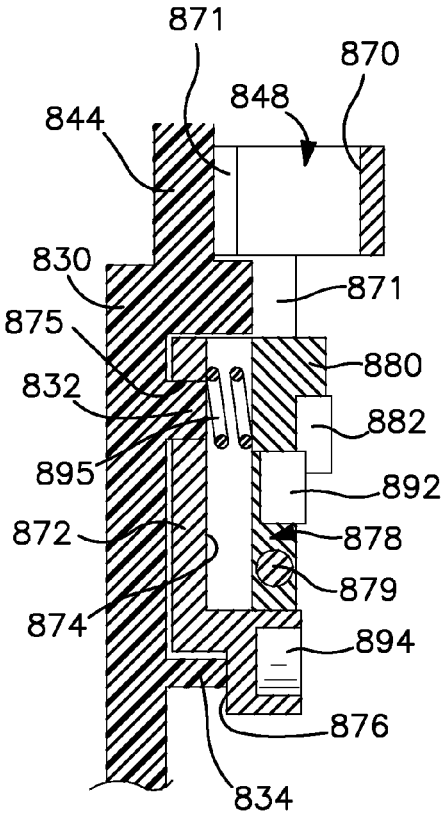
FIG. 74 is a sectional view of the blade carrier taken along the lines 74-74 of FIG. 73 and showing a portion of the blade carrier.
Figure 75:
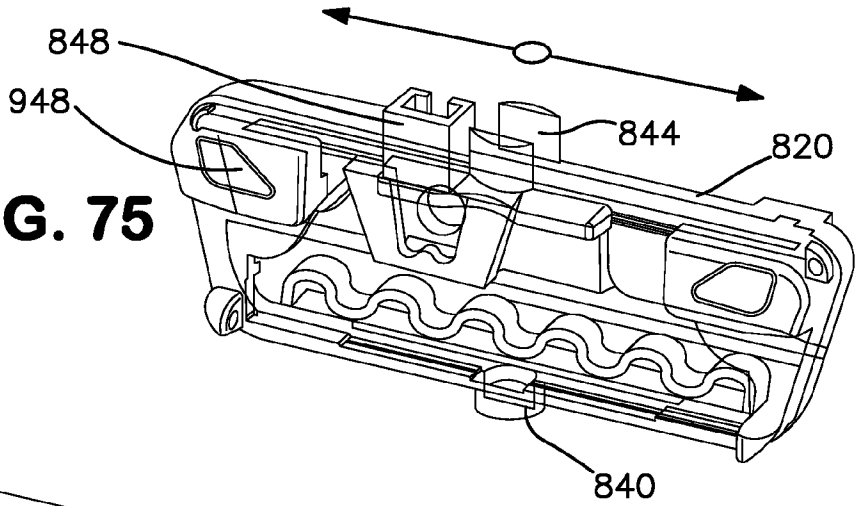
FIG. 75 is a sectional view in perspective showing an internal portion of the blade carriage with the blade carrier advancing the blade to its exposed position.
Figure 76:
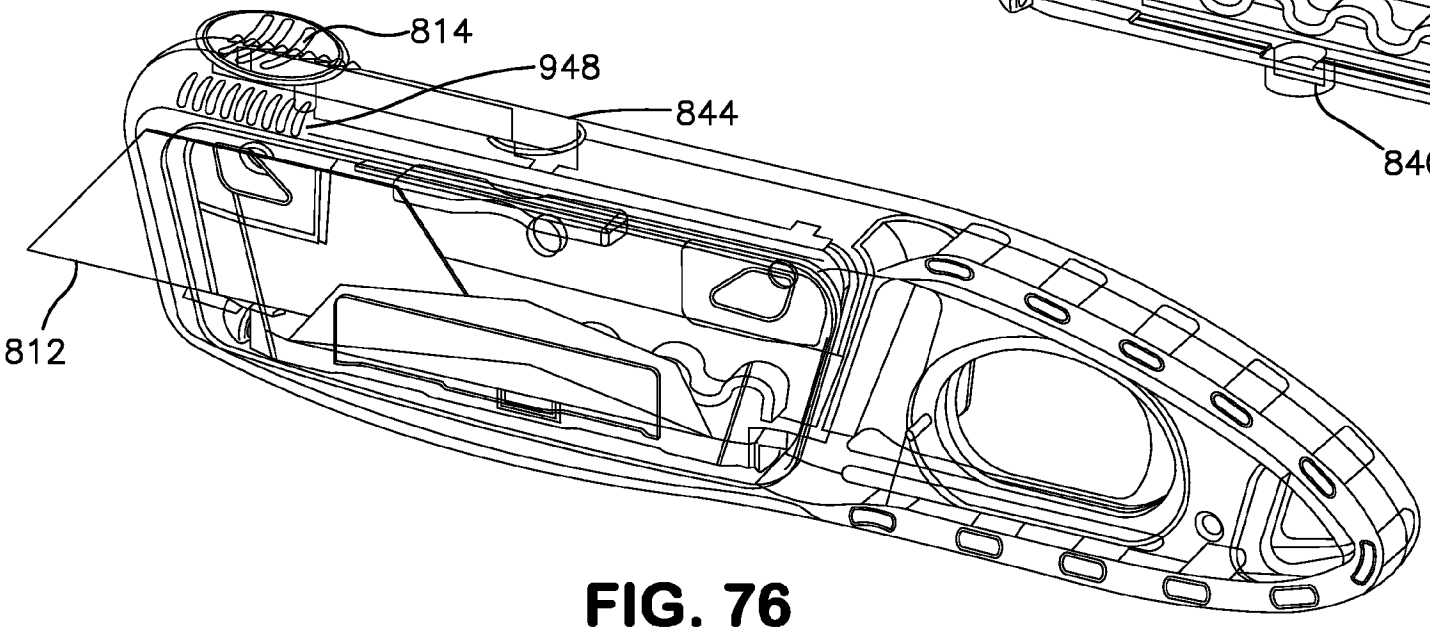
FIG. 76 is a perspective view showing the blade carrier positioned in its forward portion with the blade exposed.
Figure 77:
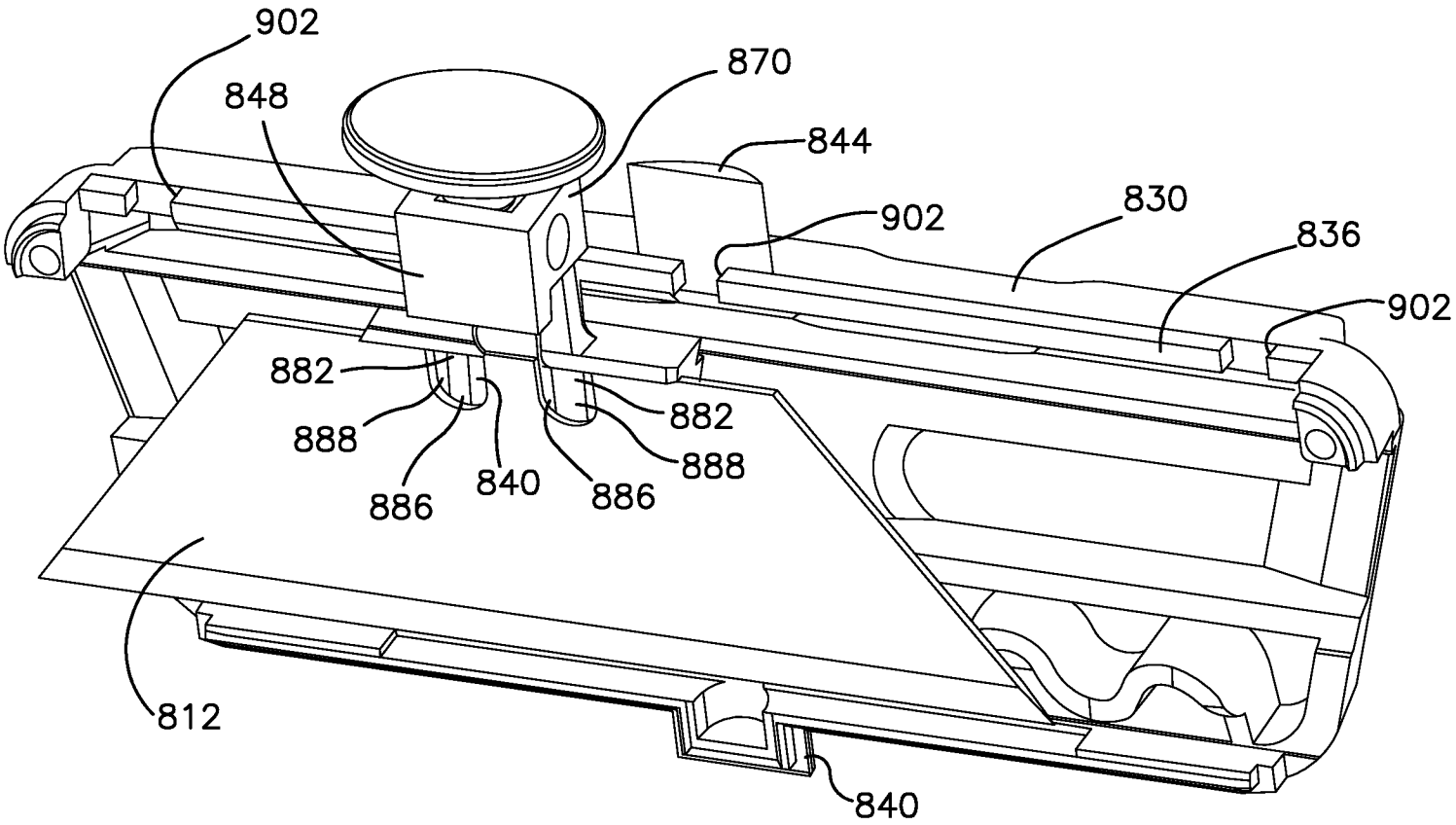
FIG. 77 is an isometric sectional view of the blade carriage showing the blade carrier in engagement with the blade.
Figure 78:
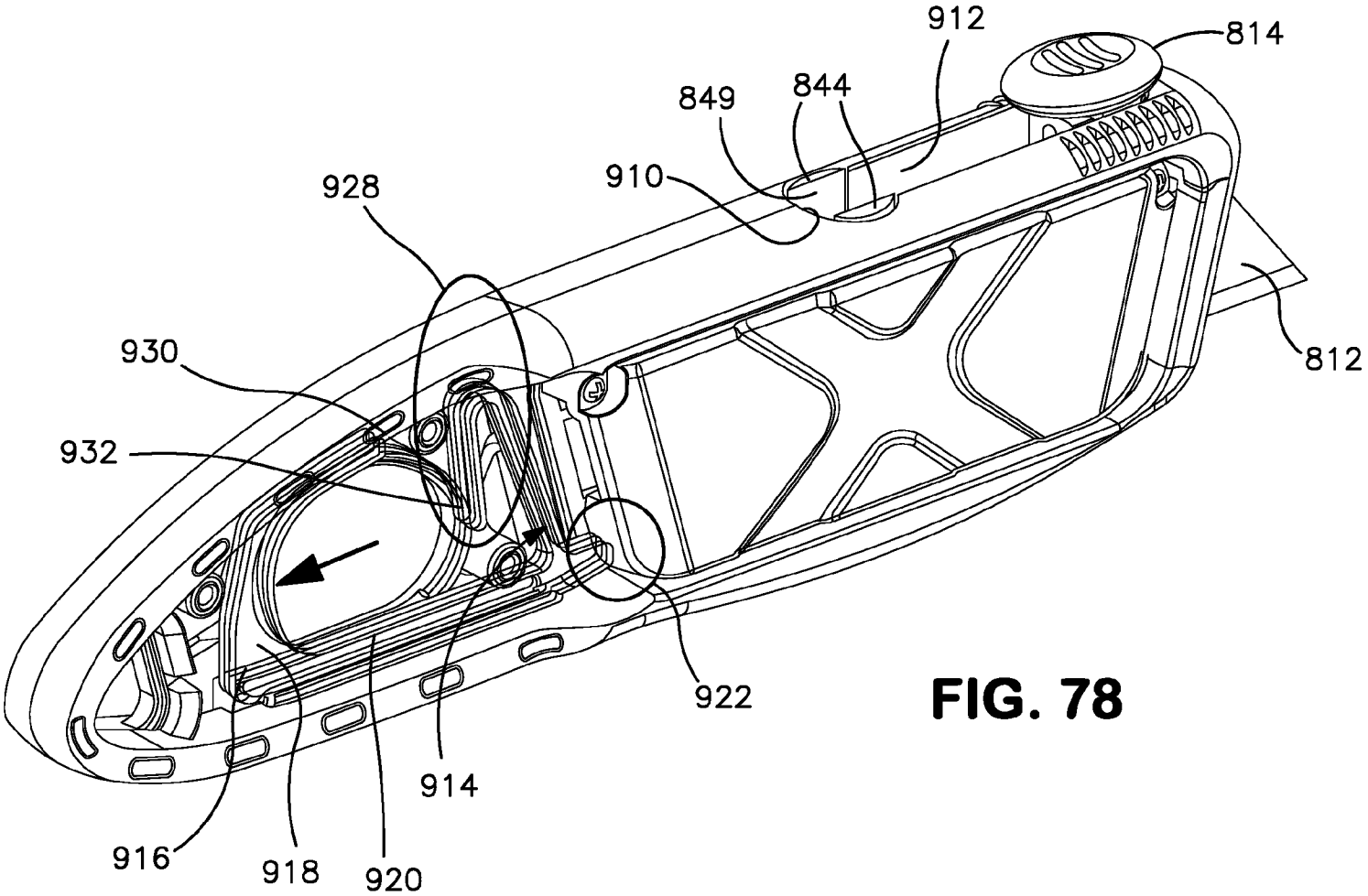
FIG. 78 is an isometric view, partially in section, showing the latching mechanism for locking the blade carriage in place.

As shown in FIG. 71, the first housing member 828 includes a door 850 that is pivotally attached to the housing member 828 along it bottom edge so that it opens outwardly and downwardly as shown. The door 850 has a catch 852 that is adapted to be received in a notch (not shown) in the underside of the top of the first housing member 828 to releaseably secure the door 850 in the closed position. The door 850 has two spaced projections 856 extending from its inner surface.

The blades 812 are contained in a cartridge 858 which is adapted to be placed in the carriage 826. The cartridge 858 includes two spaced side walls (only one 860 is shown), a bottom (not shown) and first and second end walls 862. The side wall 860 of the cartridge 858 adapted to face the interior of the blade carriage 826 has an open portion and has its inner surface spaced from the inner edge 864 of the end walls 862 so that a blade is free to move forwardly or rearwardly out of the cartridge 858 between the inner edge 864 and the interior of the slide wall 860 of the cartridge 858. The blades 812 are provided with a plurality of notches 866 in their upper edge. Although the blades 812 are shown as having a trapezoidal shape, other shaped blades may be used that have a cutting edge at both ends.

To load a fresh set of blades 812, the door 850 is opened. The cartridge 858 is placed on the interior of the door 850 with the projections 856 received in the notches 866 in the blades 812 and the door closed.

The blade carrier 848 is mounted in the interior of the carriage 826 and is adapted to ride along the rails 832 and 834. The blade carrier 848 includes a carrier body 868 having an upper portion 870 having a box-like configuration with an opening in the side facing the second housing member 830. The upper portion 870 is connected by posts 871 to a lower body portion 872 that has a cavity 874 therein. The outer wall of the body portion 872 has a slot 875 which is adapted to receive the upper rail 832 in the carriage 826. A notch 876 is provided at the bottom of the lower body portion 872 of the carrier body 868 which rests on the lower rail 834 of the carriage member 826.

The blade carrier 848 further includes a blade engaging member 878 that is mounted in the cavity 874 in lower body portion 872. The blade engaging member 878 is pivotally attached to the lower body portion 872 of the blade carrier 848 by means of a pivot pin 879. With this arrangement the upper portion of the blade engaging member 878 has limited pivoting movement toward and away from the blade 812.

The blade engaging member 878 includes an upper inwardly extending projection 880 and two lower inwardly extending projections 882 spaced below the upper projection 880. The upper projection 880 is adapted to be positioned immediately above the top of the blade 812 when a cartridge 858 is inserted in the carriage 826, while the two lower projections 882 are adapted to enter the notches 866 on the top edge of the innermost blade 812. The two lower projections 882 have a flat inner face 886 with the leading or outer side edge 888 being tapered and the inner side edge 890 being flat and at a right angle to the flat inner face.

A magnet 892 is positioned in the center of the blade engaging member 878 facing the blade 812. A magnet 892 is also positioned in the lower body portion 872 of the carrier body 868 facing the blade 812. The magnets serve to hold the inner blade 812 against the blade carrier 848.

A spring member 894 is positioned between the back of the blade engaging member 878 and the inside surface of the cavity 874 in the lower body portion 872 of the carrier body 868 to bias the blade engaging member 878 into engagement with a blade 812 so that the lower projections 882 extend into the notches 866 in the innermost blade 812.

The thumb button 814 includes a stem 896 which extends into the upper portion 870 of the blade carrier 848. A spring 898 biases the thumb button 814 into its upper position. The stem 896 includes a detent 900 which is adapted to extend into one of the notches 902 in the top inner edge of the second housing member 830 of the blade carriage 826. There is one notch 902 positioned at the center of the blade carriage 826 and one notch 902 positioned adjacent either end thereof. The detent 900 and notches 902 serve to hold the blade carrier 848 in either a central position where the blade is withdrawn into the blade carriage 826, or a position adjacent either end of the blade carriage 826 at which the blade is exposed. Pressing the thumb button 814 serves to release the detent 900 from a respective notch 902 so that blade carrier 848 can be moved.

The blade carriage 826 is provided with a spring biased blade release button 904 on its side adjacent both ends of the carriage 826. The blade release button 904 includes a post 906 (FIG. 79) adapted to extend into the interior of the carriage 826. When the blade release button 904 is depressed, the post 906 engages the upper projection 880 of the blade engaging member 878 and pivots the blade engaging member 878 about the pivot pin 879 to move the lower projections 882 out of engagement with the notches 886 in the blade 812. This permits a blade 812 to be removed from the knife.

The rotatable blade carriage 826 is mounted in the opening 824 in the forward portion of the housing 802 with the circular post 842 positioned in a bore 908 in the interior of the bottom of the housing 802. The post 846 extending upwardly from the rotatable blade carriage 826 extends into a throughbore 910 in the top of the housing 802. A slot 912 in top of the housing extends forwardly from the throughbore 910 to a point adjacent the forward end of the knife. The slot 912 provides an opening for the movement of the upper portion 870 of the blade carrier 848 to move forwardly the upper portion 870 rides in the slot 912 as it moves.

The knife 800 is provided with a latching mechanism 914 for locking the rotating blade carriage 826 in a position where it is parallel to the longitudinal axis of the knife 800 so that a blade 812 can be moved into its cutting position. The latching mechanism 914 includes a locking member 916 mounted between the two panel members 816 and 818 in the rearward end of the housing 802. The locking member 916 includes a rearward C-shaped trigger portion 918 having a portion exposed to the through opening 820, a forward extending portion 920 having an end 922 that extends through the partition 822 into a position wherein it can extend into a notch 924 in either rear surface of the blade carriage 826. A spring portion 926 extends upward from the forward extending portion 920 and includes a flexible end portion with an inverted U-bend 928. The free end 930 of the bend 920 of the spring portion 926 engages an abutment 932 in the panel members 816 and 818 so that the locking member 916 is biased in the forward direction with the end 922 of the locking member 916 being engaged in a notch 924 in the blade carriage 826. Thus, when it is desired desire to rotate the blade carriage, the operator can engage the trigger portion 918 and move it rearwardly to release the end 922 of the locking member 916 from the notch 924 in the rear of the blade carriage 826. With the thumb button 814 positioned in its retracted position (at the center of the blade carriage 826), the trigger portion 918 can be depressed and the blade carriage 826 rotated as shown in FIG. 70, so that the knife blade 812 can be extended in the opposite direction to present another cutting edge of the blade 912 for cutting. The locking member 916 is preferably molded from plastic as a one piece member.

In operation, with a cartridge 858 loaded into the blade carriage 826, when it is desired to expose a blade 812, the thumb button 814 is moved in a forward direction toward the front of the knife 800 which in turn moves the blade carrier 848 along the rails 832 and 834 in the blade carriage 868. The flat side edge 890 of a lower projection 882 on the blade engaging member 878 engages a notch 866 in the blade 812 so that the blade 812 is carried along with the blade carrier 848 into the forward position moving the forward end of the blade 812 through the opening 810. When the cutting edge on that portion of the blade becomes dull, the thumb button 814 is returned to the retracted position. The flat side edge 810 of the other lower projection 882 of the blade engaging member 878 engages the notch 866 in the blade 812, carrying the blade 812 back to the starting point.

The carriage 826 can then be rotated by releasing the latching mechanism 914 and rotating the carriage 826 about its central axis until the latch 914 engages with the notch 924 at the other end of the carriage 826. At this point the thumb button 814 can be depressed and moved into the forward position whereby the blade carrier 848 will carry the same blade 812 into its forward position exposing the cutting edge at the other end of the blade. When that cutting edge becomes dull, the blade 812 can be removed from the knife 800 by depressing the blade release button 904 and manually pulling the blade from the knife 800. With the blade removed, as the thumb button 814 is depressed and returned to its central position, the tapered side edge 888 of the lower projections cam the lower projections 882 over the front edge of the next blade so the lower projections 882 can ride over the front edge of the blade and enter the notches 866 in the blade.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt to a particular situation or material to the teachings of the disclosure without departing from the scope thereof. Furthermore, it should be understood that there is no intention to limit this disclosure to specific forms disclosed, but on the contrary, the intention is to cover all modifications, alternative constructions, and the equivalents falling within the spirit and scope of this disclosure. Therefore, it is intended that the present disclosure not be limited to the particular embodiment(s) disclosed as the best mode contemplated, but that the disclosure will include all embodiments falling within the scope of the appended claims.

What is claimed is:

1. A knife comprising:

a housing having a proximal end and a distal end and having a cutout therein and an opening defined in the proximal end, and a rotating blade carriage defining a blade path mounted in said cutout and rotatable about a pivot axis between a first position and a second position, said pivot axis being substantially perpendicular to said blade path, said rotating blade carriage communicating with said blade opening so that a blade with a first cutting end and an opposed second cutting end and positioned in said blade carriage can be advanced through said opening for applying a cutting action by said first cutting end of said blade when said rotating blade carriage is in the first position, wherein said rotating blade carriage can be rotated to the second position so that said blade can be advanced through said opening for applying a cutting action by said second cutting end of said blade.

2. A knife comprising:

a housing having a proximal end defining a blade opening and a distal end, and said housing having a carrier receiving opening therethrough, a rotating blade carriage for receiving at least one blade having a first end cutting portion and an opposed second end cutting portion, said blade carriage positioned in said carrier receiving opening and pivotally attached to said housing for rotation about a pivot axis between a first and a second position, said blade carriage blade defining a path, said pivot axis being perpendicular to said blade path, said rotating blade carriage aligning with said blade opening so that said first end cutting portion can be advanced through said opening for exposing a first end cutting portion when said rotating blade carriage is in the first position, wherein said rotating blade carriage can be rotated into the second position so that said second end cutting portion of the blade can be advanced through said opening for exposing the second end cutting portion of the blade.

3. The knife of claim 2 further including a latch for locking said carriage in the first position or the second position.

4. The knife of claim 3 where in said latch includes a locking lever having a locking tab and said carriage includes a locking slot, said locking tab being biased into engagement with said locking slot, and a locking lever adapted to be moved against said bias to disengage said locking tab from said locking slot.

5. The knife of claim 2 further including a blade engaging member for engaging a blade received in the blade carriage and a blade release member which engages the blade engaging member for disengaging a blade from the knife so the blade can be removed.

6. The knife of claim 5 wherein said carrier has opposed ends and said blade release member is positioned adjacent one end and further including a second blade release member positioned adjacent the other end of said carriage for disengaging a received blade from the blade engaging member when the blade engaging member is in said first or second advanced position to enable a blade to be removed from said knife.

7. The knife of claim 2 further including a blade engaging member in said carriage movable in one direction between a retracted position and a first advanced position and moveable in the opposite direction between the retracted position and a second advanced position, said blade engaging member adapted to engage a blade received in the carriage and move the blade so one cutter end portion of the blade is exposed when the blade engaging member is moved into the first advanced position and the other cutter end portion of the blade is exposed when the blade engaging member is moved into the second advanced position.

8. The knife of claim 7 wherein a received blade has a top with alignment slots and said blade engaging member has holding members adapted to engage said alignment slots to move the blade.

9. The knife of claim 8 wherein the blade has a side and the holding members extend into said alignment slots from the side of the blade.

10. The knife of claim 8 wherein the holding members extend into said alignment slots from the top of the blade.

11. The knife of claim 7 wherein said knife includes a storage compartment for used blades, said storage compartment being loaded by movement of a said blade engaging member moving a blade into a position to be released into the storage compartment.

12. The knife of claim 2 wherein said carriage has a door pivotally attached to said carriage, said door being pivotally openable to enable the blades to be inserted into the carriage.

13. A knife for a cutting blade having an opposed first end portion and a second end portion comprising:

a housing having a proximal end defining a blade opening and a distal end;

said housing having a carriage receiving opening therethrough, a rotating blade carriage defining a blade path and positioned in said carriage receiving opening and pivotally attached to said housing for rotation about a pivot axis between a first position and a second position, said rotating blade carriage aligning with said blade opening so that the first end portion of a cutting blade can be advanced through said opening for exposing the first end portion of the blade when said rotating blade carriage is in the first position; wherein said rotating blade carriage can be rotated into the second position so that the second end portion of the blade can be advanced through said opening for exposing the second end portion of the blade;

a blade carrier in said carriage movable in one direction between a retracted position and a first advanced position and moveable in the opposite direction between the retracted position and a second advanced position, said blade carrier adapted to engage a blade in the carriage and move the blade so the first end portion of the blade is exposed exteriorly of the housing when the blade engaging member is moved into said first advanced position and the second end portion of the knife is exposed exteriorly of the housing when the blade engaging member is moved into the second advanced position;

a thumb button positioned exteriorly of said housing and connected to said blade carrier for enabling movement of said blade carrier;

said carriage having a top and opposed ends and a plurality of notches extending into the top of said carriage, one positioned centrally of said carriage and one positioned adjacent either end of said carriage; and a detent on said thumb button for releaseably engaging a notch of said plurality of notches when the blade carrier is in said retracted position, said first advanced position and said second advanced position.

14. The knife of claim 13 wherein said detent is releasable from a said notch by depressing said thumb button.

15. The knife of claim 13 wherein said carriage has a door with a bottom edge and said door is pivotally attached to said carriage along the bottom edge of said door, said door opening in an outwardly and downwardly direction to enable a cartridge of blades to be inserted into the carriage.

16. The knife of claim 15 wherein the blades have a top surface with a plurality of blade notches and the door has a plurality of projections adapted to extend into said blade notches when a blade cartridge is inserted and the door closed.

17. The knife of claim 13 wherein said carriage receiving opening is defined by spaced panels each having a forward edge defining a partition.

18. The knife of claim 17 further including a locking member for locking said carriage in said first position or said second position, said locking member being mounted between said panels and having an end extending through said partition, said carriage having a first end portion with a notch and a second end portion with a notch, each carriage notch releaseably receiving said end of said locking member.

19. The knife of claim 18 wherein said locking member includes a spring portion having a flexible end portion with an inverted U-shaped bend having a free end, the free end of the U-shaped bend being in engagement with an abutment in said panels so that the locking member is biased in a forward direction with the end being engaged in a said notch.

20. The knife of claim 19 wherein said panels have a finger opening therein and said locking member includes a trigger portion having a portion exposed to the finger opening.

* * * * *